US009274462B2

(12) United States Patent
Yoshioka et al.

(10) Patent No.: US 9,274,462 B2
(45) Date of Patent: Mar. 1, 2016

(54) TRANSFER MEMBER AND IMAGE FORMING APPARATUS

(71) Applicant: FUJI XEROX CO., LTD., Minato-ku, Tokyo (JP)

(72) Inventors: Tomoaki Yoshioka, Kanagawa (JP); Masaaki Yamaura, Kanagawa (JP); Yasuhiro Shimada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/503,567

(22) Filed: Oct. 1, 2014

(65) Prior Publication Data

US 2015/0220024 A1 Aug. 6, 2015

(30) Foreign Application Priority Data

Feb. 5, 2014 (JP) ..... 2014-020471
Mar. 28, 2014 (JP) ..... 2014-069020

(51) Int. Cl.
*G03G 15/16* (2006.01)

(52) U.S. Cl.
CPC ..... *G03G 15/1685* (2013.01); *G03G 15/1605* (2013.01); *G03G 2215/0129* (2013.01); *G03G 2215/1614* (2013.01)

(58) Field of Classification Search
USPC ..... 399/101
See application file for complete search history.

(56) References Cited

U.S. PATENT DOCUMENTS 6,078,772 A * 6/2000 Takaya ..... G03G 15/167 399/297
7,907,878 B2 * 3/2011 Takagi ..... G03G 15/0818 399/286
7,912,411 B2 * 3/2011 Takagi ..... G03G 15/0818 399/286
2007/0258737 A1 11/2007 Ogiyama et al.
2014/0010564 A1 * 1/2014 Okubo ..... G03G 15/80 399/88

FOREIGN PATENT DOCUMENTS

JP 03-100579 A 4/1991
JP 09-044002 A 2/1997
JP 09-304997 A 11/1997
JP 2007-328317 A 12/2007

* cited by examiner

*Primary Examiner* — Clayton E Laballe
*Assistant Examiner* — Warren K Fenwick
(74) *Attorney, Agent, or Firm* — Sughrue Mion, PLLC

(57) ABSTRACT

A transfer member includes a shaft and a body. When a measurement member is brought into contact with an outer surface of the body and voltage applied to the measurement member is changed by electrically connecting the shaft to ground, a time constant τv is measured based on a change in electric potential occurring on a surface of the measurement member. When a first measurement member is brought into contact with the outer surface, a second measurement member is brought into contact with the outer surface while being spaced apart from the first member by a predetermined distance in a circumferential direction of the outer surface, and voltage applied to the first member is changed by electrically connecting the shaft to ground, a time constant τs is measured based on a change in electric potential occurring on a surface of the second member. τv is larger than τs.

15 Claims, 31 Drawing Sheets

| | P1 | P2 | P3 | P4 | P5 | P6 | P7 | P8 | σ | max−min | DETERMINATION OF UNIFORMITY |
|---|---|---|---|---|---|---|---|---|---|---|---|
| SAMPLE 1 | 11.00 | 13.00 | 13.00 | 13.00 | 13.00 | 13.00 | 13.00 | 15.00 | 1.07 | 4.00 | × |
| SAMPLE 2 | 11.00 | 15.00 | 15.00 | 15.00 | 15.00 | 15.00 | 15.00 | 15.00 | 1.41 | 4.00 | × |
| SAMPLE 3 | 13.00 | 13.00 | 13.00 | 15.00 | 15.00 | 15.00 | 15.00 | 15.00 | 1.04 | 2.00 | × |
| SAMPLE 4 | 13.00 | 13.00 | 15.00 | 15.00 | 15.00 | 15.00 | 15.00 | 15.00 | 0.93 | 2.00 | ○ |
| SAMPLE 5 | 13.00 | 15.00 | 15.00 | 15.00 | 15.00 | 15.00 | 15.00 | 17.00 | 1.07 | 4.00 | × |
| SAMPLE 6 | 18.00 | 15.00 | 15.00 | 15.00 | 15.00 | 15.00 | 15.00 | 15.00 | 1.06 | 3.00 | × |
| SAMPLE 7 | 17.00 | 17.00 | 15.00 | 15.00 | 15.00 | 15.00 | 15.00 | 15.00 | 0.93 | 2.00 | ○ |
| SAMPLE 8 | 14.00 | 14.00 | 14.00 | 14.00 | 16.00 | 16.00 | 16.00 | 16.00 | 1.07 | 2.00 | × |
| SAMPLE 9 | 15.40 | 14.80 | 15.80 | 14.50 | 15.20 | 14.80 | 15.60 | 15.30 | 0.44 | 1.30 | ○ |
| SAMPLE 10 | 14.40 | 13.60 | 14.30 | 14.70 | 15.60 | 15.80 | 15.40 | 15.10 | 0.75 | 2.20 | ○ |

FIG. 16

| | | Rs [logΩ] | 7.8 | 8.1 | 8.1 | 8.3 | 8.3 | 8.3 |
|---|---|---|---|---|---|---|---|---|
| H [DEGREES] | V [mm/s] | Rv [logΩ] | 8.3 | 8.0 | 8.3 | 8.0 | 8.3 | 8.7 |
| 75 | 600 | τs (Cs×Rs) [msec] | 13.22 | 23.89 | 23.89 | 35.60 | 35.60 | 35.60 |
| | | τv [msec] | 13.56 | 6.99 | 13.56 | 6.99 | 13.56 | 33.59 |
| | | DECREASE IN RESISTANCE | ○ | × | × | × | × | × |
| | | TRANSFERABILITY ONTO SMALL-SIZE THICK PAPER | ○ | ○ | ○ | ○ | ○ | ○ |
| | | (125/v)×(Rv/Rs) [sec] | 0.66 | 0.17 | 0.33 | 0.10 | 0.21 | 0.52 |
| | 440 | τs (Cs×Rs) [msec] | 13.22 | 23.89 | 23.89 | 35.60 | 35.60 | 35.60 |
| | | τv [msec] | 13.56 | 6.99 | 13.56 | 6.99 | 13.56 | 33.59 |
| | | DECREASE IN RESISTANCE | ○ | × | × | × | × | × |
| | | TRANSFERABILITY ONTO SMALL-SIZE THICK PAPER | ○ | ○ | ○ | ○ | ○ | ○ |
| | | (125/v)×(Rv/Rs) [sec] | 0.90 | 0.23 | 0.45 | 0.14 | 0.28 | 0.71 |
| 25 | 600 | τs (Cs×Rs) [msec] | 13.22 | 23.89 | 23.89 | 35.60 | 35.60 | 35.60 |
| | | τv [msec] | 40.68 | 20.96 | 40.68 | 20.96 | 40.68 | 100.77 |
| | | DECREASE IN RESISTANCE | ○ | × | ○ | × | ○ | ○ |
| | | TRANSFERABILITY ONTO SMALL-SIZE THICK PAPER | × | ○ | ○ | ○ | ○ | ○ |
| | | (125/v)×(Rv/Rs) [sec] | 0.66 | 0.17 | 0.33 | 0.10 | 0.21 | 0.52 |
| | 440 | τs (Cs×Rs) [msec] | 13.22 | 23.89 | 23.89 | 35.60 | 35.60 | 35.60 |
| | | τv [msec] | 40.68 | 20.96 | 40.68 | 20.96 | 40.68 | 100.77 |
| | | DECREASE IN RESISTANCE | ○ | × | ○ | × | ○ | ○ |
| | | TRANSFERABILITY ONTO SMALL-SIZE THICK PAPER | × | ○ | ○ | ○ | ○ | ○ |
| | | (125/v)×(Rv/Rs) [sec] | 0.90 | 0.23 | 0.45 | 0.14 | 0.28 | 0.71 |

FIG. 18

| | EXPERIMENTAL EXAMPLE 1–1 | EXPERIMENTAL EXAMPLE 1–2 | EXPERIMENTAL EXAMPLE 1–3 | COMPARATIVE EXAMPLE 1 | COMPARATIVE EXAMPLE 2 |
|---|---|---|---|---|---|
| CARBON BLACK [PARTS] IN BASE LAYER 8 | 3 | 6 | 4 | 5 | 4 |
| CARBON BLACK [PARTS] IN SURFACE LAYER 9 | 3 | 8 | 5 | 3 | 4 |
| ASKER C HARDNESS H | 25 | 75 | 75 | 25 | 75 |
| VOLUME RESISTANCE VALUE Rv [Ω] ([log Ω]) | $10^{8.6}$ (8.6) | $10^{7.8}$ (7.8) | $10^{8.6}$ (8.6) | $10^{7.8}$ (7.8) | $10^{8.6}$ (8.6) |
| SURFACE RESISTANCE VALUE Rs [Ω] ([log Ω]) | $10^{8.6}$ (8.6) | $10^{6.8}$ (6.8) | $10^{8.0}$ (8.0) | $10^{8.3}$ (8.3) | $10^{8.6}$ (8.6) |
| 0.5/H [msec] | 20.0 | 6.67 | 6.67 | 20.0 | 6.67 |
| TIME CONSTANT τs [msec] IN SURFACE DIRECTION | 67.6 | 3.6 | 19.8 | 35.6 | 67.6 |
| TIME CONSTANT τv [msec] IN VOLUME DIRECTION | 80.0 | 4.5 | 26.7 | 13.4 | 26.7 |
| DECREASE IN RESISTANCE [log Ω/sq.] | 0.06 | 0.08 | 0.13 | 2.46 | 3.81 |
| | ○ | ○ | ○ | × | × |
| TRANSFERABILITY ONTO SMALL-SIZE THICK PAPER | ○ | × | ○ | × | ○ |

FIG. 19

| | EXPERIMENTAL EXAMPLE 2–1 | EXPERIMENTAL EXAMPLE 2–2 | EXPERIMENTAL EXAMPLE 2–3 | EXPERIMENTAL EXAMPLE 2–4 | EXPERIMENTAL EXAMPLE 2–5 |
|---|---|---|---|---|---|
| CARBON BLACK [PARTS] IN BASE LAYER 8 | 3 | 6 | 4 | 3 | 4 |
| CARBON BLACK [PARTS]IN SURFACE LAYER 9 | 3 | 8 | 5 | 4 | 5 |
| ASKER C HARDNESS H | 25 | 75 | 75 | 75 | 75 |
| TRANSFER NIP WIDTH L [mm] | 5.0 | 1.7 | 1.7 | 1.7 | 1.3 |
| ROTATION SPEED v [mm/s] | 528 | 528 | 528 | 264 | 264 |
| VOLUME RESISTANCE VALUE Rv [Ω] ([log Ω]) | $10^{8.6}$ (8.6) | $10^{7.8}$ (7.8) | $10^{8.6}$ (8.6) | $10^{8.8}$ (8.8) | $10^{8.6}$ (8.6) |
| SURFACE RESISTANCE VALUE Rs [Ω] ([log Ω]) | $10^{8.6}$ (8.6) | $10^{6.8}$ (6.8) | $10^{8.0}$ (8.0) | $10^{8.3}$ (8.3) | $10^{8.0}$ (8.0) |
| (L/v)×(Rv/Rs) [msec] | 9.5 | 32.2 | 12.8 | 20.4 | 19.6 |
| TIME CONSTANT τs [msec] IN SURFACE DIRECTION | 67.6 | 3.6 | 19.8 | 35.6 | 19.8 |
| TIME CONSTANT τv [msec] IN VOLUME DIRECTION | 80.0 | 4.5 | 26.7 | 42.3 | 26.7 |
| DECREASE IN RESISTANCE [logΩ/sq.] | 0.06 | 0.08 | 0.13 | 0.07 | 0.08 |
| | ○ | ○ | ○ | ○ | ○ |
| TRANSFERABILITY ONTO SMALL-SIZE THICK PAPER | ○ | × | ○ | ○ | ○ |

| | 1 | 2 | 3 |
|---|---|---|---|
| $\tau$s [ms] | 3.6 | 67.6 | 23.9 |
| $\tau$v [ms] | 4.5 | 80 | 26.7 |
| $\tau$v/$\tau$s | 1.25 | 1.18 | 1.12 |
| L50 [mm] | 37.7 | 35.6 | 33.5 |
| ANGLE [deg] FROM NIP | 180 | 170 | 160 |

FIG. 25

| No. | $\tau s$ [ms] | $\tau v$ [ms] | $\tau v/\tau s$ | SURFACE ROUGHNESS Rz [$\mu$m] OF TRANSFER ROLLER | REVERSE BIAS | ARRANGEMENT DISTANCE La [mm] | GROUND CONNECTION OF BRUSH | CLEANING BLADE | EVALUATION RESULT OF REVERSE-FACE CONTAMINATION |
|---|---|---|---|---|---|---|---|---|---|
| EXPERIMENTAL EXAMPLE 3–1 | 23.9 | 26.7 | 1.12 | 1 | NONE | 30 | GROUND-CONNECTED | NONE | ○ |
| EXPERIMENTAL EXAMPLE 3–2 | 23.9 | 26.7 | 1.12 | 1 | NONE | 30 | GROUND-CONNECTED | YES | ◎ |
| EXPERIMENTAL EXAMPLE 3–3 | 23.9 | 26.7 | 1.12 | 3 | NONE | 30 | GROUND-CONNECTED | YES | ○ |
| EXPERIMENTAL EXAMPLE 3–4 | 23.9 | 26.7 | 1.12 | 2 | NONE | 30 | GROUND-CONNECTED | YES | ◎ |
| EXPERIMENTAL EXAMPLE 3–5 | 23.9 | 26.7 | 1.12 | 1 | NONE | 35 | GROUND-CONNECTED | NONE | △ |
| COMPARATIVE EXAMPLE 3–1 | 23.9 | 26.7 | 1.12 | 1 | NONE | 30 | FLOATING | NONE | × |

| ROLLER No. | 1 | 2 | 3 | 4 | 5 |
|---|---|---|---|---|---|
| $\tau s$ [ms] | 3.6 | 61.2 | 57.6 | 49.8 | 23.9 |
| $\tau v$ [ms] | 7 | 76.3 | 80 | 83.4 | 26.7 |
| $\tau v/\tau s$ | 1.94 | 1.25 | 1.39 | 1.67 | 1.12 |
| ANGLE CORRESPONDING TO −7 [kV] | 90 | 58 | 64 | 79 | 50 |
| PERIPHERAL LENGTH FROM NIP | 18.85 | 12.15 | 13.40 | 16.55 | 10.47 |

| ROLLER No. | $\tau s$ [ms] | $\tau v$ [ms] | $\tau s < \tau v$ | L [mm] |
|---|---|---|---|---|
| EXPERIMENTAL EXAMPLE 4-1 | 3.6 | 7 | ○ | 18.89 |
| EXPERIMENTAL EXAMPLE 4-2 | 57.6 | 80 | ○ | 13.49 |
| EXPERIMENTAL EXAMPLE 4-3 | 23.9 | 26.7 | ○ | 10.85 |
| COMPARATIVE EXAMPLE 4-1 | 67.6 | 62 | × | 8.91 |
| COMPARATIVE EXAMPLE 4-2 | 67.6 | 26.7 | × | 3.84 |

$Lb = \{(\tau v / \tau s)/1.94\} \times 6\pi$ [mm]

TRANSFER MEMBER AND IMAGE FORMING APPARATUS

CROSS-REFERENCE TO RELATED APPLICATIONS

This application is based on and claims priority under 35 USC 119 from Japanese Patent Application No. 2014-020471 filed Feb. 5, 2014 and Japanese Patent Application No. 2014-069020 filed Mar. 28, 2014.

BACKGROUND

Technical Field

The present invention relates to transfer members and image forming apparatuses.

SUMMARY

According to an aspect of the invention, there is provided a transfer member including a shaft and a body that is supported by the shaft. When a measurement member extending in an axial direction of the shaft is brought into contact with an outer surface of the body and voltage applied to the measurement member is changed by electrically connecting the shaft to ground, a time constant measured based on a change in electric potential occurring on a surface of the measurement member is defined as a first time constant $\tau v$ [s]. When a first measurement member extending in the axial direction is brought into contact with the outer surface of the body, a second measurement member extending in the axial direction is brought into contact with the outer surface of the body while being spaced apart from the first measurement member by a predetermined distance in a circumferential direction of the outer surface of the body, and voltage applied to the first measurement member is changed by electrically connecting the shaft to ground, a time constant measured based on a change in electric potential occurring on a surface of the second measurement member is defined as a second time constant $\tau s$ [s]. The first time constant $\tau v$ [s] is larger than the second time constant $\tau s$ [s].

BRIEF DESCRIPTION OF THE DRAWINGS

Exemplary embodiments of the present invention will be described in detail based on the following figures, wherein:

FIG. 16 illustrates evaluation results of a coefficient A;

FIG. 18 illustrates conditions and experimental results of an experimental example 1-1, an experimental example 1-2, an experimental example 1-3, a comparative example 1, and a comparative example 2;

FIG. 19 illustrates conditions and experimental results of an experimental example 2-1, an experimental example 2-2, an experimental example 2-3, an experimental example 2-4, and an experimental example 2-5;

FIG. 25 illustrates conditions and experimental results of experimental examples 3-1 to 3-5 and a comparative example 3-1;

DETAILED DESCRIPTION

Figure 1:
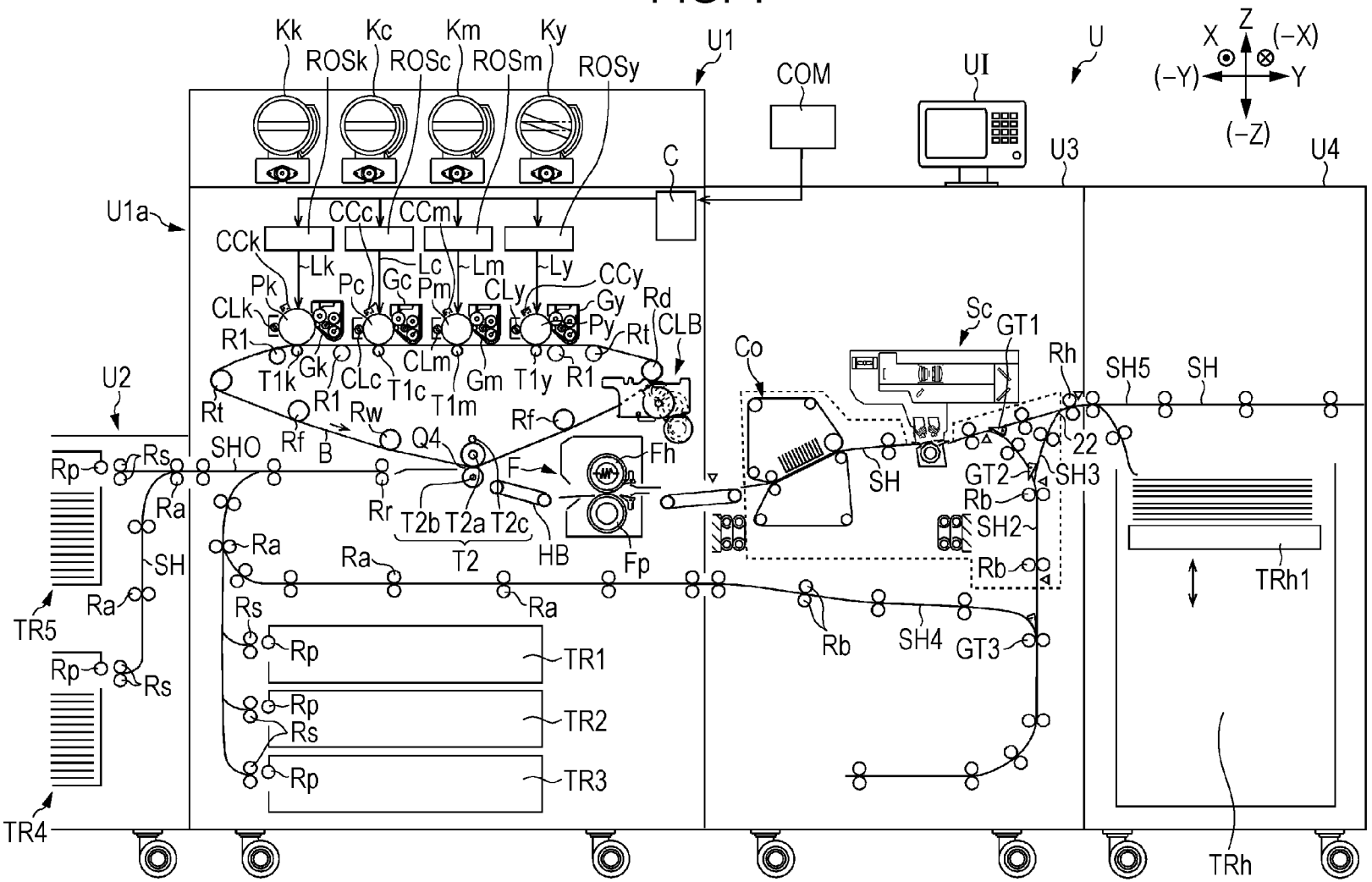
FIG. 1 is an overall view of an image forming apparatus according to a first exemplary embodiment of the present invention.

Although specific exemplary embodiments of the present invention will be described below with reference to the drawings, the present invention is not to be limited to the following exemplary embodiments.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

Overall Configuration of Printer U According to First Exemplary Embodiment

FIG. 1 is an overall view of an image forming apparatus according to a first exemplary embodiment of the present invention.

Figure 2:
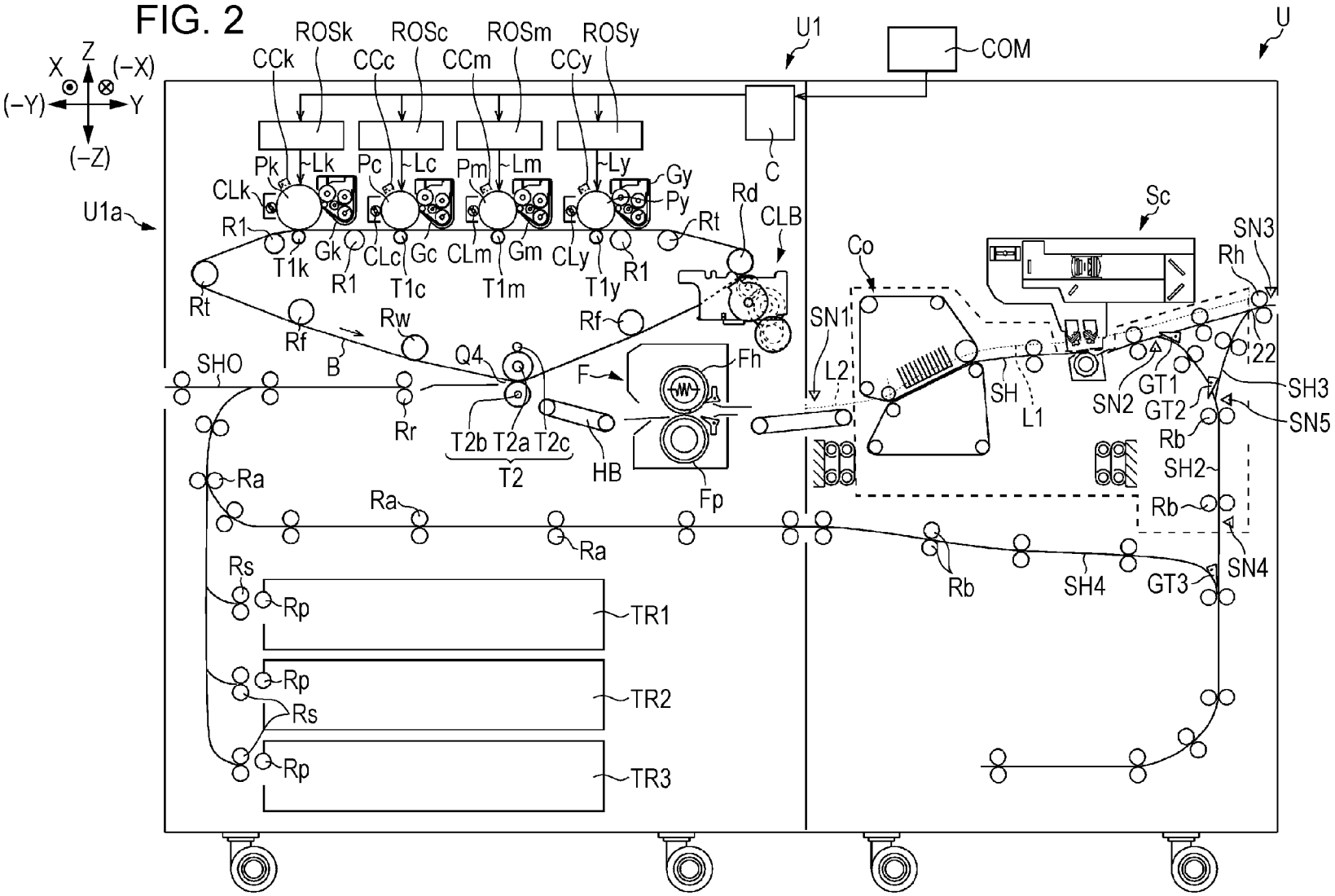
FIG. 2 illustrates a relevant part of the image forming apparatus according to the first exemplary embodiment of the present invention.

FIG. 2 illustrates a relevant part of the image forming apparatus according to the first exemplary embodiment of the present invention.

Referring to FIGS. 1 and 2, a printer U as an example of the image forming apparatus according to the first exemplary embodiment includes a printer body U1, a feeder unit U2 as an example of a feeding device that feeds a medium to the printer body U1, a processing unit U3 as an example of a post-processing device that performs processing on a medium having an image recorded thereon, an output unit U4 as an example of an output device to which the medium having the image recorded thereon is output, and an operable unit UI operable by a user.

Configuration of Marking Unit in First Exemplary Embodiment

Referring to FIGS. 1 and 2, the printer body U1 includes a controller C that controls the printer U, a communicator (not shown) that receives image information transmitted from a print image server COM as an example of an information transmitter externally connected to the printer U via a dedicated cable (not shown), and a marking unit U1*a* as an example of an image recorder that records an image onto a medium. The print image server COM is connected, via a line such as a cable or a local area network (LAN), to a personal computer PC as an example of an image transmitter that transmits information of an image to be printed in the printer U.

The marking unit U1*a* includes photoconductors Py, Pm, Pc, and Pk as an example of image bearing members for yellow (Y), magenta (M), cyan (C), and black (K) colors. The photoconductors Py to Pk have photoconductive dielectric surfaces.

Referring to FIGS. 1 and 2, in the rotational direction of the photoconductor Pk for the black color, a charger CCk, an exposure unit ROSk as an example of a latent-image forming unit, a developing unit Gk, a first-transfer roller Tlk as an example of a first-transfer unit, and a photoconductor cleaner CLk as an example of an image-bearing-member cleaner are arranged around the photoconductor Pk.

Likewise, chargers CCy, CCm, and CCc, exposure units ROSy, ROSm, and ROSc, developing units Gy, Gm, and Gc, first-transfer rollers T1*y*, T1*m*, and T1*c*, and photoconductor cleaners CLy, CLm, and CLc are respectively arranged around the remaining photoconductors Py, Pm, and Pc.

Toner cartridges Ky, Km, Kc, and Kk as an example of containers that accommodate therein developers to be supplied to the developing units Gy to Gk are detachably supported above the marking unit U1*a*.

An intermediate transfer belt B as an example of an intermediate transfer body and an image bearing member is disposed below the photoconductors Py to Pk. The intermediate transfer belt B is interposed between the photoconductors Py to Pk and the first-transfer rollers T1*y* to T1*k*. The undersurface of the intermediate transfer belt B is supported by a drive roller Rd as an example of a drive member, a tension roller Rt as an example of a tension applying member, a working roller Rw as an example of a meander prevention member, multiple idler rollers Rf as an example of driven members, a backup roller T2*a* as an example of a second-transfer opposing member, multiple retracting rollers R1 as an example of movable members, and the aforementioned first-transfer rollers T1*y* to T1*k*.

A belt cleaner CLB as an example of an intermediate-transfer-body cleaner is disposed on the top surface of the intermediate transfer belt B near the drive roller Rd.

A second-transfer roller T2*b* as an example of a second-transfer member is disposed facing the backup roller T2*a* with the intermediate transfer belt B interposed therebetween. The backup roller T2*a* is in contact with a contact roller T2*c* as an example of a contact member for applying voltage having a reversed polarity relative to the charge polarity of the developers to the backup roller T2*a*.

The backup roller T2*a*, the second-transfer roller T2*b*, and the contact roller T2*c* constitute a second-transfer unit T2 according to the first exemplary embodiment. The first-transfer rollers T1*y* to T1*k*, the intermediate transfer belt B, the second-transfer unit T2, and the like constitute a transfer device T1+B+T2 according to the first exemplary embodiment.

Feed trays TR1 to TR3 as an example of containers that accommodate therein recording sheets S as an example of media are provided below the second-transfer unit T2. A pickup roller Rp as an example of a fetching member and a separating roller Rs as an example of a separating member are disposed at the upper left side of each of the feed trays TR1 to TR3. A transport path SH that transports each recording sheet S extends from the separating roller Rs. Multiple transport rollers Ra as an example of transport members that transport each recording sheet S downstream are arranged along the transport path SH.

A registration roller Rr as an example of an adjusting member that adjusts the timing for transporting each recording sheet S toward the second-transfer unit T2 is disposed at the downstream side of the transport rollers Ra.

The feeder unit U2 is similarly provided with components, such as feed trays TR4 and TR5 that have configurations similar to those of the feed trays TR1 to TR3, the pickup rollers Rp, the separating rollers Rs, and the transport rollers Ra. A transport path SH from the feed trays TR4 and TR5 merges with the transport path SH in the printer body U1 at the upstream side of the registration roller Rr.

Multiple transport belts HB as an example of a medium transport device are arranged at the downstream side of the second-transfer roller T2*b* in the transport direction of the recording sheet S.

A fixing device F is disposed at the downstream side of the transport belts HB in the transport direction of the recording sheet S. The fixing device F includes a heating roller Fh as an example of a heating member and a pressing roller Fp as an example of a pressing member. The heating roller Fh accommodates therein a heater as an example of a heat source.

A cooling device Co is disposed within the processing unit U3 at the downstream side of the fixing device F.

An image reading device Sc that reads an image recorded on the recording sheet S is disposed at the downstream side of the cooling device Co.

A transport path SH extending toward the output unit U4 is formed at the downstream side of the image reading device Sc. An inversion path SH2 as an example of a transport path is formed inside the processing unit U3. The inversion path SH2 diverges downward from the transport path SH. A first gate GT1 as an example of a transport-direction switching member is disposed at the diverging point between the transport path SH and the inversion path SH2.

Multiple switchback rollers Rb as an example of transport members that are rotatable in forward and reverse directions are arranged along the inversion path SH2. A connection path SH3 as an example of a transport path that diverges from an upstream section of the inversion path SH2 and merges with the transport path SH at the downstream side of the diverging point of the inversion path SH2 is formed at the upstream side of the switchback rollers Rb. A second gate GT2 as an example of a transport-direction switching member is disposed at the diverging point between the inversion path SH2 and the connection path SH3.

A circulation path SH4 as an example of a transport path is disposed below the inversion path SH2. The circulation path SH4 diverges from the inversion path SH2, extends leftward, and merges with the transport path SH in the printer body U1 at the upstream side of the registration roller Rr. Transport rollers Ra as an example of transport members are arranged along the circulation path SH4. A third gate GT3 as an example of a transport-direction switching member is disposed at the diverging point of the circulation path SH4 from the inversion path SH2.

In the output unit U4, a stacker tray TRh as an example of a container on which output recording sheets S are stacked is disposed, and an output path SH5 diverging from the transport path SH extends toward the stacker tray TRh. The transport path SH in the first exemplary embodiment is configured such that, when an additional output unit (not shown) or an additional post-processing device (not shown) is attached to the right side of the output unit U4, the transport path SH is capable of transporting the recording sheet S to the added unit or device.

Operation of Marking Unit

When the printer U receives image information transmitted from the personal computer PC via the print image server COM, the printer U commences a job, which is image forming operation. When the job commences, the photoconductors Py to Pk, the intermediate transfer belt B, and the like rotate.

The photoconductors Py to Pk are rotationally driven by a drive source (not shown).

The chargers CCy to CCk receive a predetermined voltage so as to charge the surfaces of the photoconductors Py to Pk.

The exposure units ROSy to ROSk output laser beams Ly, Lm, Lc, and Lk as an example of latent-image write-in light in accordance with a control signal from the controller C so as to write electrostatic latent images onto the charged surfaces of the photoconductors Py to Pk.

The developing units Gy to Gk develop the electrostatic latent images on the surfaces of the photoconductors Py to Pk into visible images.

The toner cartridges Ky to Kk supply developers as the developers are consumed in the developing process performed in the developing units Gy to Gk.

The first-transfer rollers T1*y* to T1*k* receive a first-transfer voltage with a reversed polarity relative to the charge polarity of the developers so as to transfer the visible images on the surfaces of the photoconductors Py to Pk onto the surface of the intermediate transfer belt B.

The photoconductor cleaners CLy to CLk clean the surfaces of the photoconductors Py to Pk after the first-transfer process by removing residual developers therefrom.

When the intermediate transfer belt B passes through first-transfer regions facing the photoconductors Py to Pk, Y, M, C, and K images are transferred and superposed on the intermediate transfer belt B in that order, and the intermediate transfer belt B subsequently travels through a second-transfer region Q4 facing the second-transfer unit T2. When a monochrome image is to be formed, an image of a single color is transferred onto the intermediate transfer belt B and is transported to the second-transfer region Q4.

In accordance with the size of the received image information, the designated type of recording sheets S, the sizes and types of accommodated recording sheets S, and so on, one of the pickup rollers Rp feeds recording sheets S from the corresponding one of the feed trays TR1 to TR5 from which the recording sheets S are to be fed.

The corresponding separating roller Rs separates the recording sheets S fed by the pickup roller Rp in a one-by-one fashion.

The registration roller Rr feeds the recording sheet S in accordance with a timing at which the image on the surface of the intermediate transfer belt B is transported to the second-transfer region Q4.

In the second-transfer unit T2, a predetermined second-transfer voltage having the same polarity as the charge polarity of the developers is applied to the backup roller T2*a* via the contact roller T2*c* so that the image on the intermediate transfer belt B is transferred onto the recording sheet S.

The belt cleaner CLB cleans the surface of the intermediate transfer belt B after the image transfer process performed at the second-transfer region Q4 by removing residual developers therefrom.

The recording sheet S having the image transferred thereon at the second-transfer unit T2 is transported downstream by the transport belts HB while being supported on the surfaces thereof.

The fixing device F heats and presses the recording sheet S passing through a fixing region where the heating roller Fh and the pressing roller Fp are in contact with each other so as to fix an unfixed image onto the surface of the recording sheet S.

The cooling device Co cools the recording sheet S heated by the fixing device F.

The image reading device Sc reads the image from the surface of the recording sheet S having passed through the cooling device Co. The read image may be compared with a document image so as to be used for, for example, detecting print errors or detecting misregistration of the image.

In the case of duplex printing, the recording sheet S having passed through the image reading device Sc is transported to the inversion path SH2 by activation of the first gate GT1 and is switched back so as to be transported again to the registration roller Rr via the circulation path SH4, whereby printing is performed on the second face of the recording sheet S.

The recording sheet S to be output to the output unit U4 is transported along the transport path SH so as to be output onto the stacker tray TRh. In this case, if the recording sheet S to be output to the stacker tray TRh is in an inverted state, the recording sheet S is temporarily transported to the inversion path SH2 from the transport path SH. After the trailing edge of the recording sheet S in the transport direction thereof passes through the second gate GT2, the second gate GT2 is switched and the switchback rollers Rb are rotated in the reverse direction so that the recording sheet S is transported along the connection path SH3 toward the stacker tray TRh.

When multiple recording sheets S are stacked on the stacker tray TRh, a stacker plate TRh1 automatically moves upward or downward in accordance with the number of stacked recording sheets S so that the uppermost sheet is disposed at a predetermined height.

Figure 3:
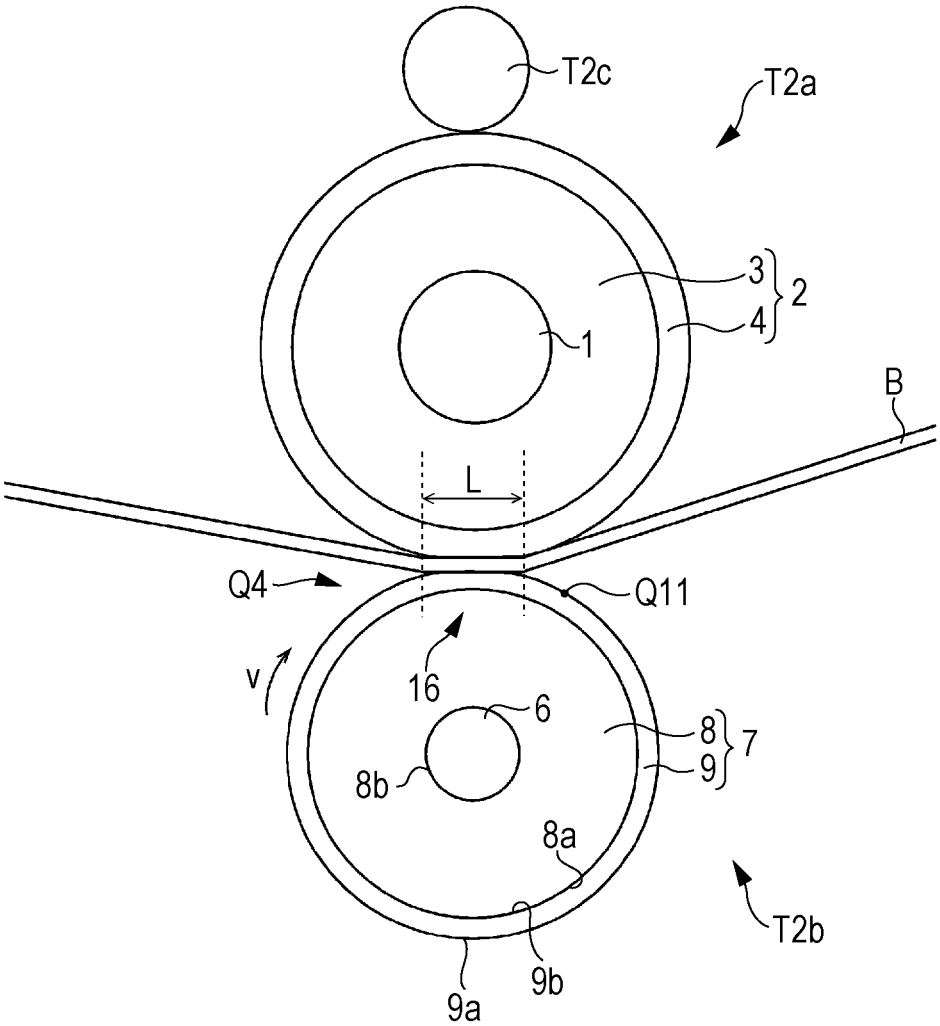
FIG. 3 illustrates a relevant part of a transfer device according to the first exemplary embodiment of the present invention.

Intermediate Transfer Body and Second-Transfer Unit According to First Exemplary Embodiment FIG. 3 illustrates a relevant part of the transfer device according to the first exemplary embodiment of the present invention.

Referring to FIGS. 1 to 3, the backup roller T2*a* as an example of a support member and an opposed member is disposed in the second-transfer region Q4. The backup roller T2*a* has a metallic shaft 1 as an example of a rotation shaft. The shaft 1 extends in the front-rear direction. The shaft 1 supports a roller layer 2 as an example of an opposed-member body. The roller layer 2 has a base layer 3 and a surface layer 4 supported by the outer side of the base layer 3. The base layer 3 is composed of rubber as an example of an elastic material. The rubber of the base layer 3 has an electrical-conductivity additive blended therein. The surface layer 4 is composed of resin. The surface layer 4 has an electrical-conductivity additive blended therein. The roller layer 2 is set to a predetermined hardness H1.

The backup roller T2*a* supports the intermediate transfer belt B, which is an endless belt, as an example of an intermediate transfer body according to the first exemplary embodiment. The intermediate transfer belt B is composed of resin having an electrical-conductivity additive blended therein.

Figure 4A:
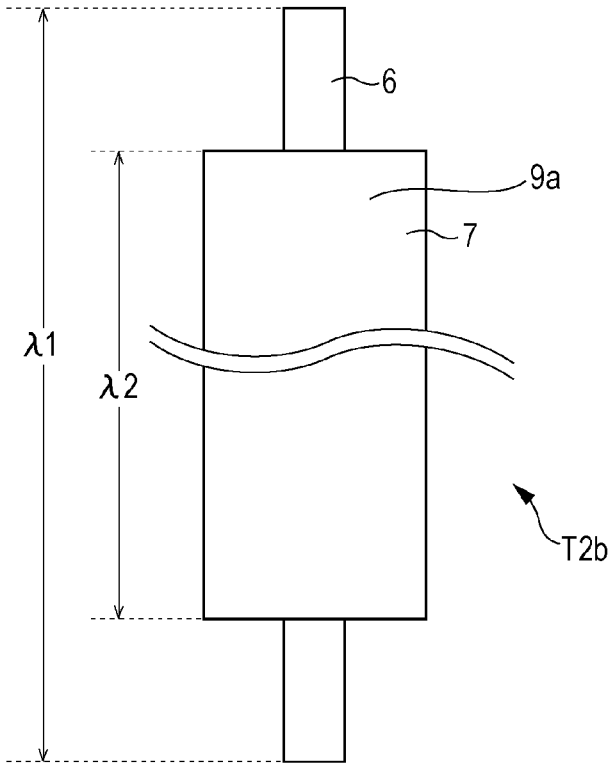
FIGS. 4A and 4B illustrate a transfer member according to the first exemplary embodiment of the present invention, FIG. 4A illustrating the length of the transfer member, FIG. 4B being is an enlarged view illustrating a relevant part of a body thereof.
Figure 4B:
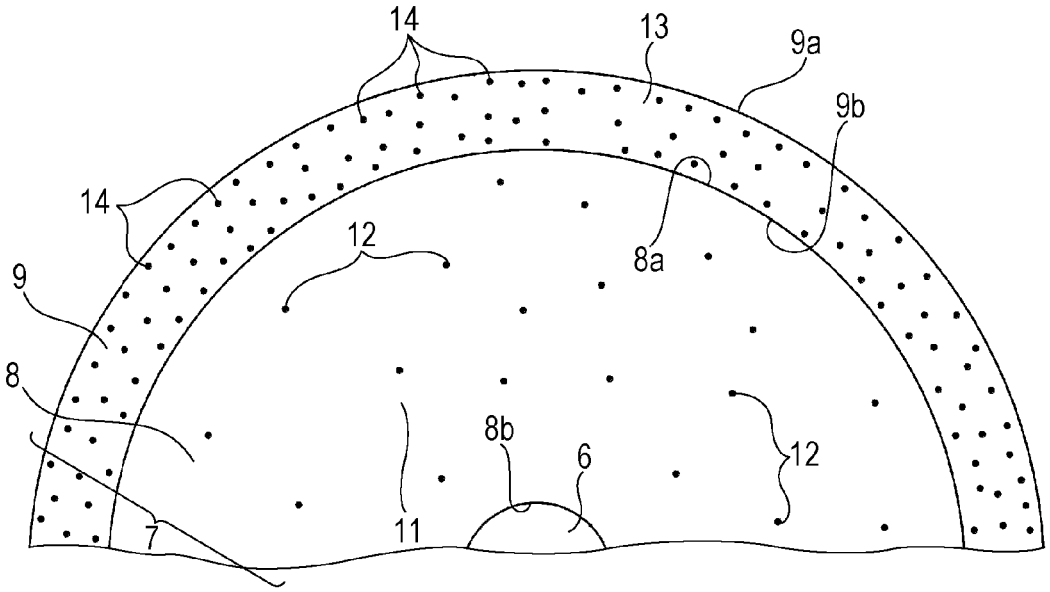

FIGS. 4A and 4B illustrate a transfer member according to the first exemplary embodiment of the present invention. Specifically, FIG. 4A illustrates the length of the transfer member, and FIG. 4B is an enlarged view illustrating a relevant part of a body thereof.

Referring to FIGS. 3 to 4B, the second-transfer roller T2*b* as an example of the transfer member according to the first exemplary embodiment is disposed at a position facing to the backup roller T2*a* with the intermediate transfer belt B interposed therebetween. The second-transfer roller T2*b* has a metallic shaft 6 as an example of a shaft. The shaft 6 extends in the front-rear direction. The shaft 6 supports a roller layer 7 as an example of a body. The roller layer 7 has a length $\lambda 2$ that is shorter, in the front-rear direction, than a length $\lambda 1$ of the shaft 6. The roller layer 7 has a base layer 8 as an example of a first layer. The roller layer 7 also has a surface layer 9, as an example of a second layer, which is supported radially outward than the base layer 8. Thus, the layers 8 and 9 have radially-inward inner surfaces 8*b* and 9*b* and radially-outward outer surfaces 8*a* and 9*a*, respectively.

In FIG. 4B, the base layer 8 is composed of rubber 11. The rubber 11 has an electrical-conductivity additive 12 blended therein. The surface layer 9 is composed of resin 13. The resin 13 of the surface layer 9 has an electrical-conductivity additive 14 blended therein. In the first exemplary embodiment, the percentage of electrical-conductivity additive blended in the surface layer 9 is higher than that in the base layer 8. In the layers 8 and 9 according to the first exemplary embodiment, the electrical-conductivity additives 12 and 14 are distributed within the layers 8 and 9, respectively, with low unevenness. Therefore, in contrast to a transfer roller in the related art in which the electrical-conductivity additive normally decreases toward the outer layer, the electrical-conductivity additive in the surface layer 9 is blended therein with higher density than in the base layer 8 in the first exemplary embodiment.

In FIGS. 3 to 4B, the roller layer 7 is given a hardness H2 in accordance with the hardness H1 of the backup roller T2*a*. In the first exemplary embodiment, the difference between the hardness H1 and the hardness H2 is small. Thus, in the second-transfer region Q4 in the first exemplary embodiment, a region formed between the backup roller T2*a* and the second-transfer roller T2*b*, that is, a nip region 16, is formed into a flat plane. In other words, the nip region 16 where the intermediate transfer belt B and the second-transfer roller T2*b* face each other is formed into a flat plane. The second-transfer roller T2*b* receives load such that the length of the nip region 16 in the transport direction of a recording sheet S, that is, a nip width, is equal to a predetermined length L.

Transfer-Member Manufacturing Method

Shaft 6

The shaft 6 is an electrically-conductive member functioning as a support member and an electrode of the second-transfer roller T2*b*.

The shaft 6 is composed of a metallic material such as iron (such as free-cutting steel), copper, brass, stainless steel, aluminum, or nickel.

Other examples of the shaft 6 include a member (such as a resin or ceramic member) whose outer surface is coated with metal and a member (such as a resin or ceramic member) having an electrically-conductive agent distributed therein.

The shaft 6 may be a hollow member (tubular member) or a non-hollow member.

Base Layer 8

The base layer 8 is an electrically-conductive layer and includes a rubber material (elastic material) 21 and an electrical-conductivity additive 22. The base layer 8 may contain other additives. Furthermore, the base layer 8 may be an electrically-conductive foamed elastic layer or an electrically-conductive non-foamed elastic layer. However, in view of prevention of liquid entering a foam material when forming the surface layer 9, a non-foamed elastic layer is desired.

The rubber material (elastic material) 21 is, for example, an elastic material at least having a double bond within its chemical structure.

Specific examples of the rubber material 21 include isoprene rubber, chloroprene rubber, epichlorohydrin rubber, butyl rubber, polyurethane, silicone rubber, fluorocarbon rubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene terpolymer (EPDM), acrylonitrile-butadiene copolymer rubber (NBR), natural rubber, and rubber containing a mixture of these materials.

Of the above examples of the rubber material 21, suitable examples include polyurethane, EPDM, epichlorohydrin-ethylene oxide copolymer rubber, epichlorohydrin-ethylene oxide-allyl glycidyl ether copolymer rubber, NBR, and rubber containing a mixture of these materials.

The electrical-conductivity additive 22 is to be used, for example, when the rubber material 21 has low electrical conductivity or when the rubber material 21 does not have electrical conductivity. Examples of the electrical-conductivity additive 22 include an electronic conductive agent and an ionic conductive agent.

For example, the electronic conductive agent may be a powder material, examples of which include carbon black, such as Ketjen black or acetylene black; pyrolytic carbon and graphite; electrically-conductive metal of various kinds, such as aluminum, copper, nickel, or stainless steel, or an alloy thereof; electrically-conductive metal oxide of various kinds, such as tin oxide, indium oxide, titanium oxide, a tin oxide-antimony oxide solid solution, or a tin oxide-indium oxide solid solution; and an insulating material whose surface has been processed to have electrical conductivity.

Specific examples of carbon black include "Special Black 350", "Special Black 100", "Special Black 250", "Special Black 5", "Special Black 4", "Special Black 4A", "Special Black 550", "Special Black 6", "Color Black FW200", "Color Black FW2", "Color Black FW2V", which are manufactured by Degussa Corporation, and "MONARCH 1000", "MONARCH 1300", "MONARCH 1400", "MOGUL-L", and "REGAL 400R", which are manufactured by Cabot Corporation.

The electronic conductive agent may be used alone or may be used by combining two or more kinds thereof.

For example, the content of the electronic conductive agent often ranges between 1 part by mass and 30 parts by mass relative to 100 parts by mass of the rubber material.

Examples of the ionic conductive agent include quaternary ammonium salt (e.g., perchlorate, such as lauryl trimethyl ammonium, stearyl trimethyl ammonium, octa dodecyl trimethyl ammonium, dodecyl trimethyl ammonium, hexadecyl trimethyl ammonium, and modified fatty acid-dimethyl ethyl ammonium, chlorate salt, fluoboric acid salt, sulfate salt, ethyl sulfate salt, halogenated benzyl salt (such as benzyl bromide salt or benzyl chloride salt), aliphatic sulfonate salt, fatty alcohol sulfate salt, fatty-alcohol ethylene-oxide-added sulfate salt, fatty alcohol phosphate salt, fatty-alcohol ethylene-oxide-added phosphate salt, various kinds of betaine, fatty alcohol ethylene oxide, polyethylene glycol fatty acid ester, and polyalcohol fatty acid ester.

The ionic conductive agent may be used alone or may be used by combining two or more kinds thereof.

For example, the content of the ionic conductive agent often ranges between 0.1 parts by mass and 5.0 by mass relative to 100 parts by mass of the rubber material.

Other additives that may be added to the rubber layer generally include, for example, a foaming agent, a foaming assistant, a softening agent, a plasticizing agent, a curing agent, a vulcanizing agent 23, a vulcanization accelerator 24, an antioxidant, a surfactant, a coupling agent, and a filler (such as silica or calcium carbonate).

Surface Layer 9

The surface layer 9 contains a resin material 31 and an electrical-conductivity additive 32. The surface layer 9 may also contain other additives.

Examples of the resin material 31 include acrylic resin, cellulose resin, polyamide resin, copolymer nylon, polyurethane resin, polycarbonate resin, polyester resin, polyethylene resin, polyvinyl resin, polyarylate resin, styrene-butadiene resin, melamine resin, epoxy resin, urethane resin, silicone resin, fluoro-resin (such as a tetrafluoroethylene-perfluoroalkyl vinyl ether copolymer, tetrafluoroethylene hexafluoropropylene copolymer, or polyvinylidene fluoride), and urea resin.

Copolymer nylon includes one of or multiple kinds of nylon 610, nylon 11, and nylon 12 as a polymer unit. Other examples of polymer unit included in this copolymer include nylon 6 and nylon 66. The resin material 31 may be curable resin 33 cured by using a curing agent 34.

Examples of the electrical-conductivity additive 32 include an electronic conductive agent and an ionic conductive agent. Examples of the electrical-conductivity additive 32 are similar to those of the electrical-conductivity additive 22 in the description of the base layer 8.

Other additives that may be added to the resin layer generally include a plasticizing agent, a curing agent, a softening agent, an antioxidant, and a surfactant.

In view of suppressing both cracking and scratches by adjusting Young's modulus and micro-hardness of the roller surface, the surface layer 9 may be a resin layer composed of constituents including the curable resin 33, the curing agent 34, and carbon black. In particular, the surface layer 9 may be a resin layer formed of a cured film composed of constituents including resin (curable resin) having a functional group reactable with an isocyanate group, an isocyanate curing agent, and carbon black.

The resin layer formed of this cured film is suitable due to the following reasons. Lower Young's modulus of the roller surface is achieved in accordance with, for example, the type, the amount, and the calcination temperature (curing temperature) of the curing agent, so that the occurrence of cracking is reduced. In addition, the micro-hardness of the roller surface is increased in accordance with the amount of carbon black, so that the occurrence of scratches is reduced.

Suitable examples of the curable resin 33 include a tetrafluoroethylene-vinyl monomer copolymer, polyamide, polyurethane, polyvinylidene fluoride, a tetrafluoroethylene copolymer, polyester, polyimide, silicone resin, acrylic resin, polyvinyl butyral, an ethylene tetrafluoroethylene copolymer, melamine resin, fluoro-rubber, epoxy resin, polycarbonate, polyvinyl alcohol, cellulose, polyvinylidene chloride, polyvinyl chloride, polyethylene, and an ethylene-vinyl acetate copolymer.

In particular, examples of resin having a functional group reactable with an isocyanate group include acrylic polyol, polyester polyol, polyether polyol, polycarbonate polyol, polycaprolactone polyol, and polyolefin polyol, each of which has a hydroxyl group within a molecule. For the purpose of functional improvements, for example, a fluoroolefin copolymer (such as a tetrafluoroethylene-vinyl monomer copolymer) or a vinyl fluoride copolymer may be used.

A low molecular-weight polyisocyanate compound having an isocyanate group at a molecular end thereof may be used as the curing agent 34. Specific examples include Coronate L, Coronate 2030, Coronate HX, Coronate HL (manufactured by Nippon Polyurethane Industry Co., Ltd.), Desmodur L, Desmodur N 3300, Desmodur HT (manufactured by Bayer Holding Ltd.), Takenate D-102, Takenate D-160N, Takenate D-170N (manufactured by Takeda Pharmaceutical Company Limited), Sumidur N3300 (manufactured by Sumika Bayer Urethane Co., Ltd.), T1890 (manufactured by Degussa Corporation), and diphenylmethane diisocyanate (MDI).

The isocyanate group (NCO group) and the hydroxyl group (OH group) within the polyol may be mixed such that the molar ratio (NCO/OH, R-value) of the isocyanate group (NCO group) to the hydroxyl group (OH group) ranges between 0.2 and 1.5, desirably between 0.3 and 1.3, and more desirably between 0.9 and 1.1. Furthermore, in addition to a reaction inhibitor and a metallic catalyst, additives for controlling physical properties, such as a surfactant, a foam stabilizer, a defoaming agent, a fire retardant, a plasticizing agent, a colorant, dye, a stabilizer, an antibacterial agent, and a filler, may be included.

The surface layer 9 is formed by preparing an application liquid while distributing each component in a solvent 36, applying the application liquid over the base layer 8, and then drying and baking (curing), where appropriate, the application liquid.

For the preparation of the application liquid, a colliding-type distribution device, such as a jet mill or a homogenizer, may be used for enhancing the distribution of the electrical-conductivity additive (carbon black). By enhancing the distribution of the electrical-conductivity additive (carbon black), the content of the electrical-conductivity additive within the surface layer 9 and the micro-hardness thereof may be increased while suppressing an excessive increase in resistivity of the surface layer 9.

As the solvent 36, a normal organic solvent may be used alone or a mixture of two or more kinds of organic solvents may be used. Examples of organic solvents include butyl acetate, methanol, ethanol, n-propanol, n-butanol, benzyl alcohol, methyl cellosolve, ethyl cellosolve, acetone, methyl ethyl ketone, cyclohexanone, n-butyl acetate, dioxane, tetrahydrofuran, chlorobenzene, and toluene.

Formation of Base Layer 8

Figure 5A:
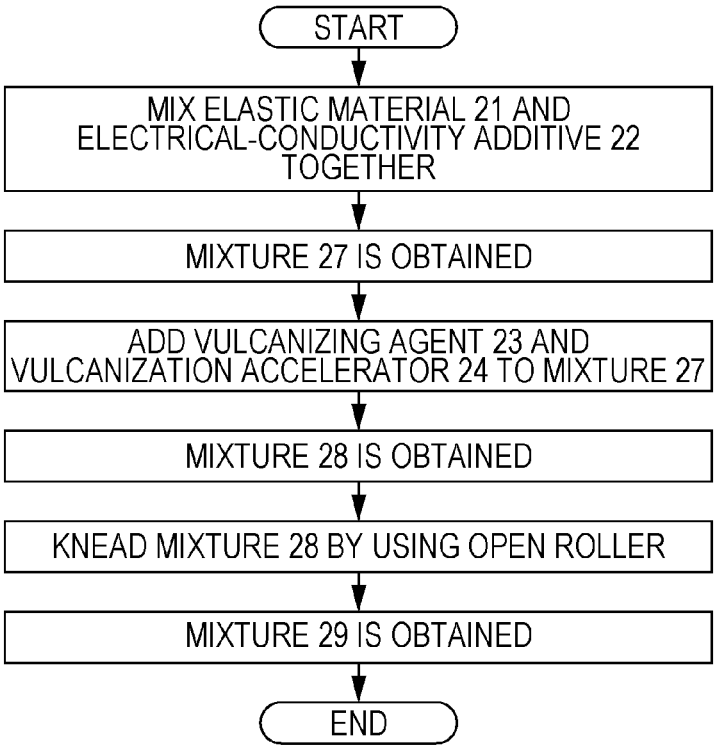
FIGS. 5A and 5B illustrate a transfer-member manufacturing method according to the first exemplary embodiment of the present invention, FIG. 5A illustrating a procedure for manufacturing a mixture constituting a first layer, FIG. 5B illustrating a procedure for forming the first layer.
Figure 5B:
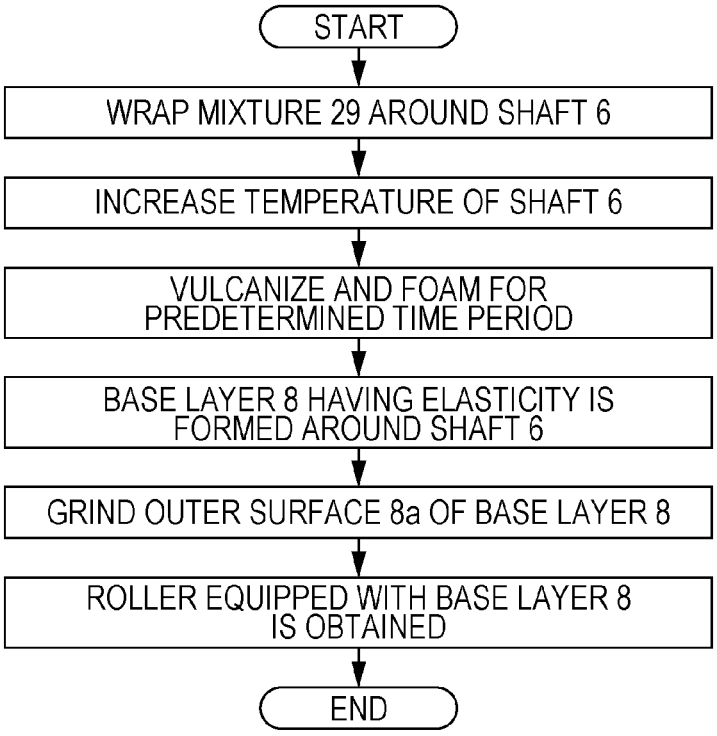

FIGS. 5A and 5B illustrate a transfer-member manufacturing method according to the first exemplary embodiment of the present invention. Specifically, FIG. 5A illustrates a procedure for manufacturing a mixture constituting the first layer, and FIG. 5B illustrates a procedure for forming the first layer.

In FIG. 5A, a mixture 29 as an example of a material constituting the base layer 8 according to the first exemplary embodiment is manufactured in accordance with the following process. First, the rubber material 21 and the electrical-conductivity additive 22 are mixed together so that a mixture 27 is obtained. Then, the vulcanizing agent 23 and the vulcanization accelerator 24 are added to the mixture 27 so that a mixture 28 is obtained. Subsequently, the mixture 28 is kneaded by using an open roller as an example of a kneading device, so that the mixture 29 is obtained.

Referring to FIG. 5B, the mixture 29 is then wrapped around the shaft 6. Subsequently, the shaft 6 is increased in temperature. The mixture 29 wrapped around the shaft 6 is then vulcanized and foamed for a predetermined time period. Consequently, the base layer 8, which has elasticity, is formed around the shaft 6. Then, the outer surface 8*a* of the base layer 8 is ground so that the base layer 8 is machined to a predetermined outside diameter, whereby a roller equipped with the base layer 8 is obtained.

Formation of Surface Layer 9

Figure 6A:
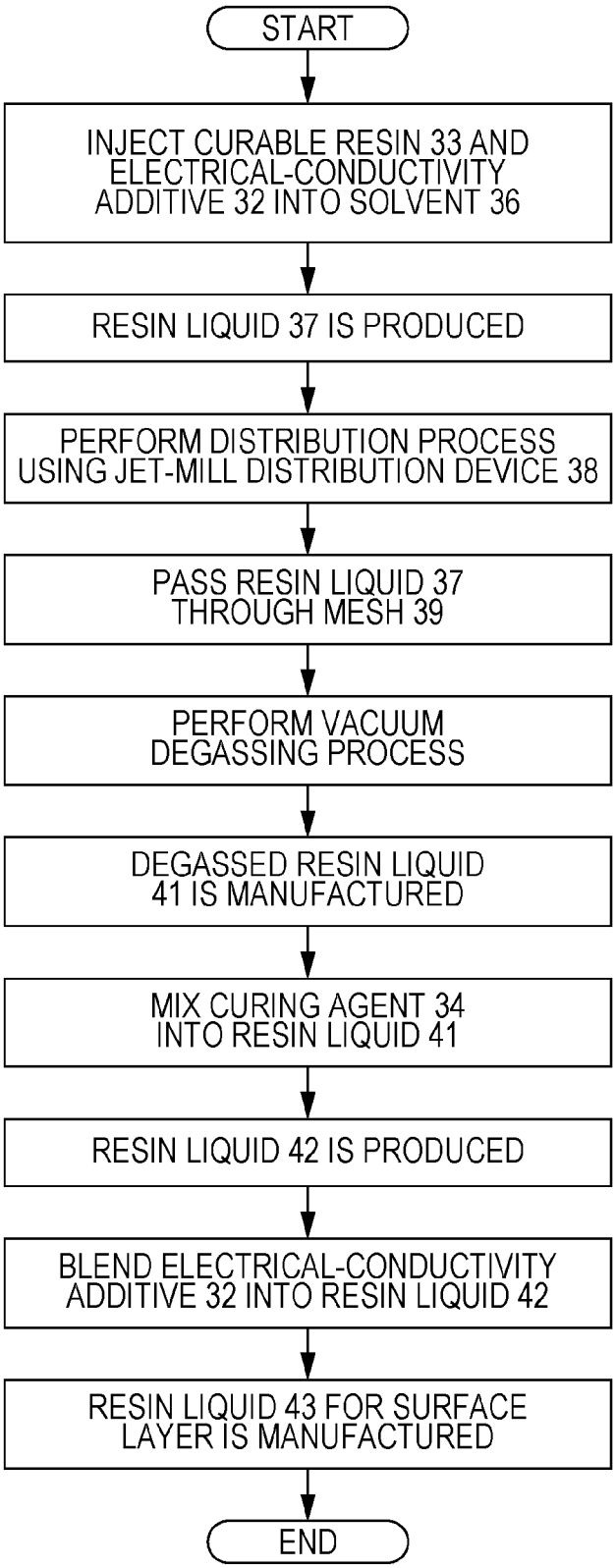
FIGS. 6A to 6C illustrate the transfer-member manufacturing method according to the first exemplary embodiment of the present invention, FIG. 6A illustrating a procedure for manufacturing a resin liquid constituting a second layer, FIG. 6B illustrating a procedure for forming the second layer, FIG. 6C illustrating a device used when forming the second layer.
Figure 6B:
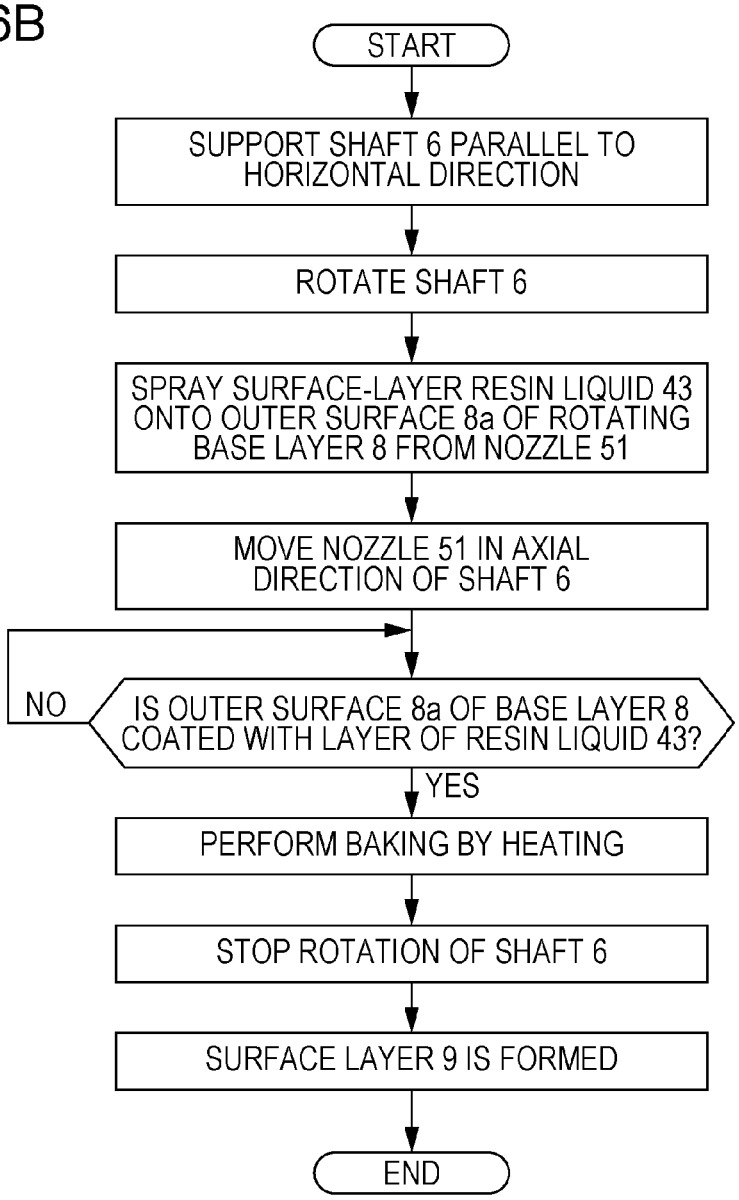
Figure 6C:
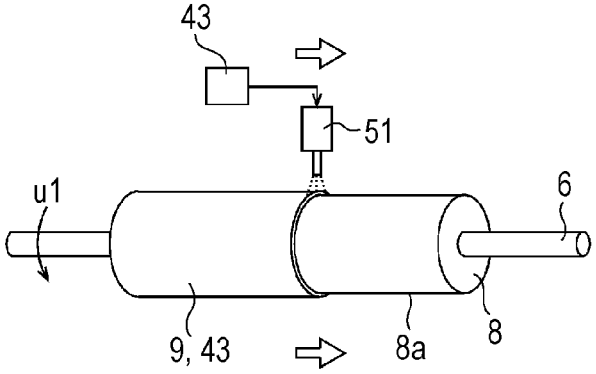

FIGS. 6A to 6C illustrate the transfer-member manufacturing method according to the first exemplary embodiment of the present invention. Specifically, FIG. 6A illustrates a procedure for manufacturing a resin liquid constituting the second layer, FIG. 6B illustrates a procedure for forming the second layer, and FIG. 6C illustrates a device used when forming the second layer.

In FIG. 6A, a resin liquid 43 as an example of a resin liquid constituting the second layer is manufactured in accordance with the following process. First, the curable resin 33 and the electrical-conductivity additive 32 are injected into the solvent 36 so that a resin liquid 37 is produced. The resin liquid 37 undergoes a distribution process in a jet-mill distribution device 38 as an example of a distribution device. The resin liquid 37 having undergone the distribution process is made to pass through stainless-steel mesh 39 as an example of a removing member. Thus, foreign matter in the resin liquid 37, aggregates in the electrical-conductivity additive 32, and the like are removed therefrom. The resin liquid 37 from which foreign matter has been removed undergoes a vacuum degassing process. Thus, air is removed from the resin liquid 37. Consequently, a degassed resin liquid 41 is manufactured. The degassed resin liquid 41 is mixed with the curing agent 34 so that a resin liquid 42 is manufactured. Then, the electrical-conductivity additive 32 is blended into the resin liquid 42. As a result, the resin liquid 43 for the surface layer according to the first exemplary embodiment is manufactured.

Referring to FIG. 6B, the outer surface 8*a* of the base layer 8 around the shaft 6 is coated with the surface-layer resin liquid 43. In the first exemplary embodiment, spray coating is performed as an example of a coating method. Specifically, the shaft 6 is supported in a state where the axial direction thereof is aligned with the horizontal direction. Then, the shaft 6 is rotated at a predetermined rotation speed u1. Thus, the base layer 8 rotates together with the shaft 6. Then, the surface-layer resin liquid 43 is sprayed onto the outer surface 8*a* of the rotating base layer 8 from a spray nozzle 51 as an example of a feeder. In this case, the nozzle 51 is moved at a predetermined relative speed in the axial direction of the shaft 6. Thus, the outer surface 8*a* of the base layer 8 becomes coated with the sprayed resin liquid 43, whereby a layer is formed. When the layer of the resin liquid 43 is formed, the layer is baked by being heated for a predetermined time period. In the first exemplary embodiment, the shaft 6 rotates even during the heating process. Consequently, the surface layer 9 of the roller layer 7 is formed, whereby the second-transfer roller T2*b* is formed.

Transfer-Member Measurement Method

Figure 7A:
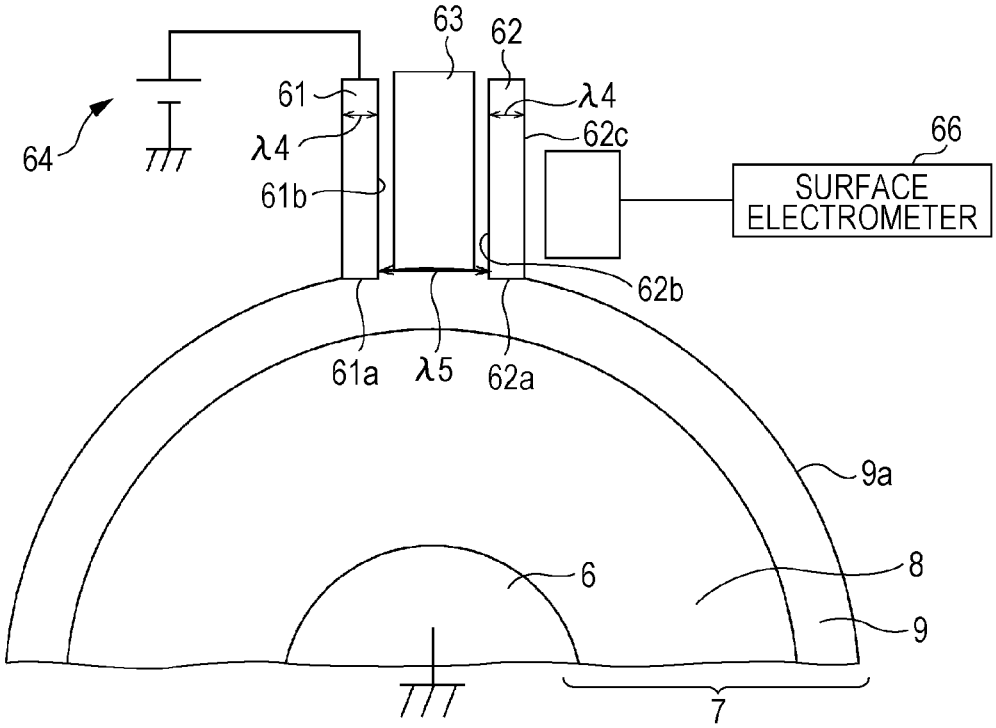
FIGS. 7A and 7B illustrate a second-time-constant measurement method according to the first exemplary embodiment of the present invention, FIG. 7A illustrating the configuration of the measurement method, FIG. 7B illustrating a change in electric potential relative to time.
Figure 7B:
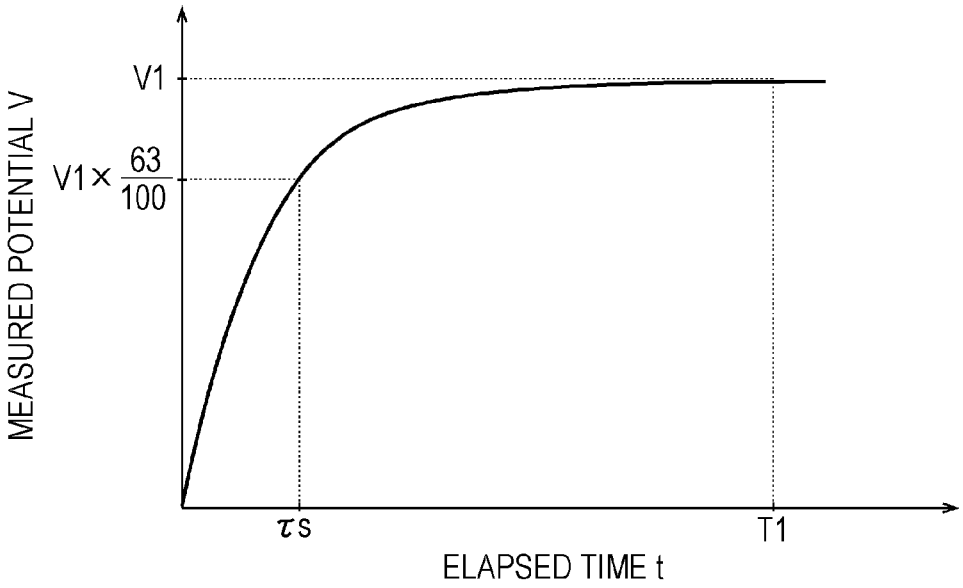

FIGS. 7A and 7B illustrate a second-time-constant measurement method according to the first exemplary embodiment of the present invention. Specifically, FIG. 7A illustrates the configuration of the measurement method, and FIG. 7B illustrates a change in electric potential relative to time.

In the second-transfer roller T2*b*, a time constant τs in the surface direction is set as an example of a second time constant. The time constant τs in the surface direction is measured with the following configuration.

In FIG. 7A, a first electrically-conductive metallic plate 61 and a second electrically-conductive metallic plate 62 as examples of measurement members are disposed on the outer surface of the second-transfer roller T2*b*, that is, the outer surface 9*a* of the roller layer 7. The first metallic plate 61 and the second metallic plate 62 have identical plate-like shapes. Each of the metallic plates 61 and 62 has a length λ3 in the front-rear direction that is longer than a length λ2 of the roller layer 7 of the second-transfer roller T2*b*. Furthermore, each of the metallic plates 61 and 62 has a length λ4 in the left-right direction, that is, the thickness direction thereof. The metallic plates 61 and 62 are supported such that surfaces 61*a* and 62*a* thereof having sides with the lengths λ3 and λ4 are pressed against the outer surface 9*a* of the roller layer 7.

The second metallic plate 62 is spaced apart from the first metallic plate 61 in the circumferential direction of the outer surface 9*a* of the roller layer 7. Specifically, in FIG. 7A, the first metallic plate 61 and the second metallic plate 62 are disposed such that the peripheral length between a right surface 61*b* of the first metallic plate 61 and a left surface 62*b* of the second metallic plate 62 is set to a predetermined length λ5. An insulating member 63 is disposed between the first metallic plate 61 and the second metallic plate 62. Thus, the right surface 61*b* of the first metallic plate 61 and the left surface 62*b* of the second metallic plate 62 are insulated from each other.

The shaft 6 of the second-transfer roller T2*b* is electrically connected to ground. On the other hand, the first metallic plate 61 is connected to a direct-current voltage source 64 as an example of a power source. The direct-current voltage source 64 applies voltage to the first metallic plate 61. The direct-current voltage source 64 is switchable between an on state in which the direct-current voltage source 64 applies a predetermined voltage V0 and an off state in which the direct-current voltage source 64 stops applying the voltage. Referring to FIG. 7A, in the first exemplary embodiment, a surface electrometer 66 is disposed in correspondence with a right surface 62*c* of the second metallic plate 62. The surface electrometer 66 measures an electric potential V of the right surface 62*c* of the second metallic plate 62.

When the direct-current voltage source 64 switches from the off state to the on state, the roller layer 7 of the second-transfer roller T2*b* receives voltage via the first metallic plate 61. Thus, an electrical change occurs in the surface direction and the volume direction of the roller layer 7 as the voltage application starts. Specifically, when an electrical change occurs in the surface direction of the roller layer 7, the electric potential V of the second metallic plate 62 changes. In this case, as shown in FIG. 7B, the surface electrometer 66 measures the electric potential V, which changes from zero toward a certain electric potential V1. In FIG. 7B, the abscissa axis denotes time t elapsed since the start of application of the voltage V0, and the ordinate axis denotes the measured electric potential V.

This phenomenon in which the electric potential V changes from zero to V1 is known as a so-called transient phenomenon. The electric potential V is known to change based on expression (1) shown below when Napier's constant is defined as e, the time elapsed since the start of voltage application is defined as t, and the time constant in the surface direction of the second-transfer roller T2*b* is defined as τs:

$$V = V1 \times (1 - e^{(-t/\tau s)}) \tag{1}$$

Therefore, it is clear from expression (1) that, when the time t is sufficiently large, the value of $e^{(-t/\tau s)}$ is small and the electric potential V hardly changes. Thus, when the time t is sufficiently large, the electric potential V is stable such that V≈V1.

Furthermore, by substituting the time t for the time constant τs in the surface direction in expression (1), expression (2) shown below is obtained:

$$\begin{aligned} V &= V1 \times (1 - e^{(-\tau_s/\tau_s)}) \\ &= V1 \times (1 - e^{-1}) \\ &= V1 \times (1 - 1/e) \\ &= V1 \times \{(e-1)/e\} \\ &\approx V1 \times (1.718/2.718) \\ &\approx V1 \times 0.6321 \end{aligned} \tag{2}$$

Therefore, it is clear from expression (2) that, when time τs elapses from the start of application of the voltage V0, the electric potential V becomes a value of about 63% of the electric potential V1.

Referring to FIG. 7B, in the first exemplary embodiment, a change in the electric potential V of the second metallic plate 62 since the start of application of the voltage V0 is measured. Furthermore, an electric potential V measured at a predetermined sufficiently large time T1 is defined as an electric potential V1. Moreover, the time t when the electric potential V of the second metallic plate 62 becomes 63% of the electric potential V1 is determined. Then, the determined time t is set as the time constant τs in the surface direction.

Figure 8A:
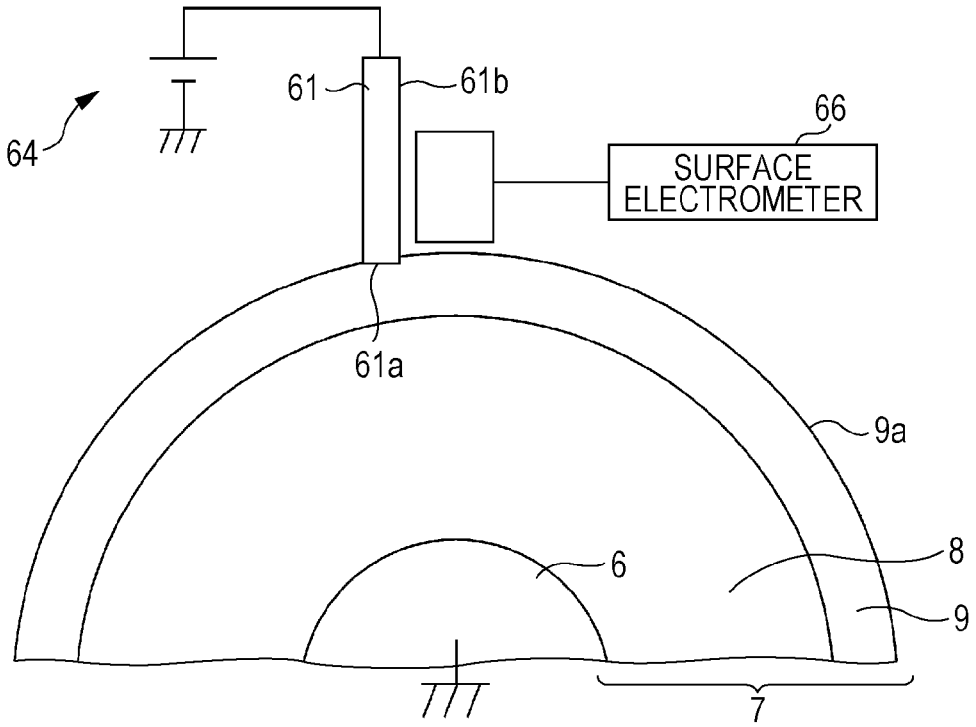
FIGS. 8A and 8B illustrate a first-time-constant measurement method according to the first exemplary embodiment of the present invention, FIG. 8A illustrating the configuration of the measurement method, FIG. 8B illustrating a change in electric potential relative to time.
Figure 8B:
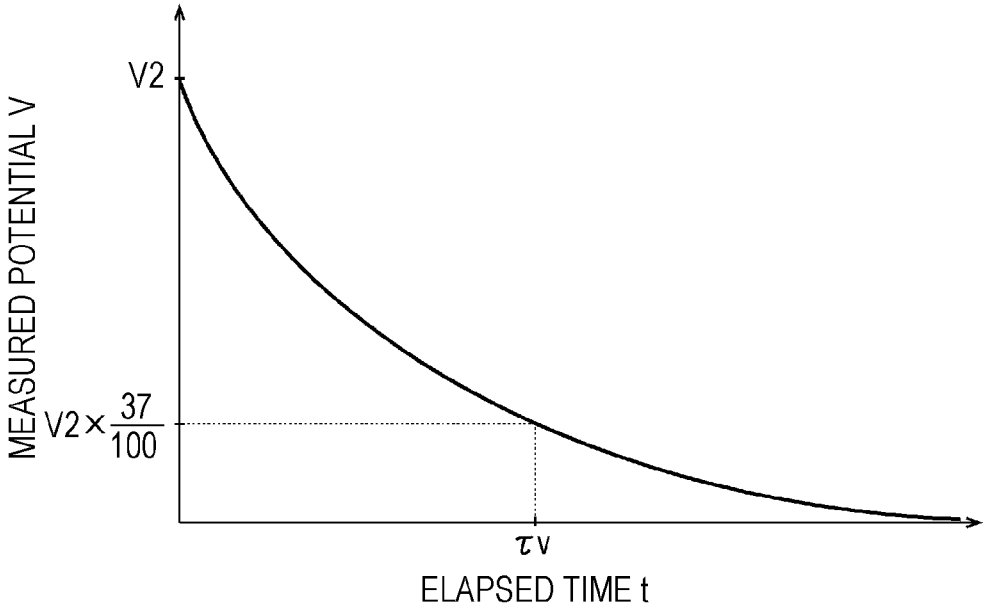

FIGS. 8A and 8B illustrate a first-time-constant measurement method according to the first exemplary embodiment of the present invention. Specifically, FIG. 8A illustrates the configuration of the measurement method, and FIG. 8B illustrates a change in electric potential relative to time.

In the second-transfer roller T2*b*, a time constant τv in the volume direction is set as an example of a first time constant. The time constant τv in the volume direction is measured with the following configuration.

In FIG. 8A, the same components 61, 64, and 66 used for measuring the time constant τs in the surface direction are used except that the second metallic plate 62 and the insulating member 63 are omitted. Specifically, when measuring the time constant τv in the volume direction, an electric potential V of the first metallic plate 61 supported by being pressed against the outer surface 9*a* of the second-transfer roller T2*b* is measured in place of the electric potential V of the second metallic plate 62. Referring to FIG. 8A, in the first exemplary embodiment, the surface electrometer 66 is disposed in correspondence with the right surface 61*b* of the first metallic plate 61. The surface electrometer 66 measures the electric potential V of the right surface 61*b* of the first metallic plate 61.

When the direct-current voltage source 64 switches from the on state to the off state, the direct-current voltage source 64 stops applying voltage to the roller layer 7 of the second-transfer roller T2*b*. Thus, an electrical change occurs in the surface direction and the volume direction of the roller layer 7 as the voltage application stops. As an electrical change occurs in the volume direction of the roller layer 7, the electric potential V of the first metallic plate 61 changes. Thus, as shown in FIG. 8B, the surface electrometer 66 measures the electric potential V, which changes from an initial electric potential V2 toward zero. In FIG. 8B, the abscissa axis denotes time t elapsed since the stoppage of voltage application, and the ordinate axis denotes the measured electric potential V.

This phenomenon in which the electric potential V changes from V2 to zero is known as a so-called transient phenomenon. The electric potential V is known to change based on expression (3) shown below when the time constant in the volume direction of the second-transfer roller T2*b* is defined as τv:

$$V=V2\times e^{(-t/\tau v)} \tag{3}$$

By substituting the time t for the time constant τv in the volume direction in expression (3), expression (4) shown below is obtained:

$$\begin{aligned} V &= V2\times e^{(-\tau_V/\tau_V)} \\ &= V2\times e^{(-1)} \\ &= V2\times(1/e) \\ &\approx V2\times(1/2.718) \\ &\approx V2\times 0.3679 \end{aligned} \tag{4}$$

Therefore, it is clear from expression (4) that, when time τv elapses from the stoppage of voltage application, the electric potential V becomes a value of about 37% of the initial electric potential V2.

Referring to FIG. 8B, in the first exemplary embodiment, a change in the electric potential V of the first metallic plate 61 since the stoppage of voltage application is measured. Furthermore, an electric potential V when the time t corresponding to the on state is equal to zero is defined as an initial electric potential V2. Moreover, the time t when the electric potential V of the first metallic plate 61 becomes 37% of the electric potential V2 is determined. Then, the determined time t is set as the time constant τv in the volume direction.

Value Settings of Transfer Member

In the second-transfer roller T2*b*, the time constant τs [s] in the surface direction and the time constant τv [s] in the volume direction are set so as to satisfy the relationship expressed by expression (11) shown below:

$$\tau s<\tau v \tag{11}$$

In particular, referring to FIG. 3, in the first exemplary embodiment, when the length of the nip region 16 in the sheet transport direction in the second-transfer region Q4 is denoted by L [mm] and the rotation speed as an example of a peripheral speed of the outer surface of the second-transfer roller T2*b* is denoted by v [mm/s], the second-transfer roller T2*b* is set such that the time constant τs [s] in the surface direction, the time constant τv [s] in the volume direction, a volume resistance value Rv [Ω] of the roller layer 7, and a surface resistance value Rs [Ω] of the roller layer 7 satisfy the relationship expressed by expression (12) shown below:

$$(L/v)\times(Rv/Rs)<\tau s<\tau v \tag{12}$$

Operation of First Exemplary Embodiment

In the printer U according to the first exemplary embodiment having the above-described configuration, when an image is to be recorded onto a recording sheet S, the second-transfer unit T2 receives a second-transfer voltage Va. Specifically, in the first exemplary embodiment, the second-transfer voltage Va is applied to the backup roller T2*a* via the contact roller T2*c*. Thus, a transfer electric field in accordance with the second-transfer voltage Va is generated between the intermediate transfer belt B supported by the backup roller T2*a* and the second-transfer roller T2*b*. Therefore, when a visible image on the intermediate transfer belt B passes through the nip region 16 between the intermediate transfer belt B and the second-transfer roller T2*b*, the transfer electric field acts on the visible image. Thus, the visible image is transferred from the intermediate transfer belt B onto the recording sheet S. In the first exemplary embodiment, the time constants τs and τv of the second-transfer roller T2*b* and so on are set so as to satisfy the relationships expressed by expression (11) and expression (12).

Figure 9A:
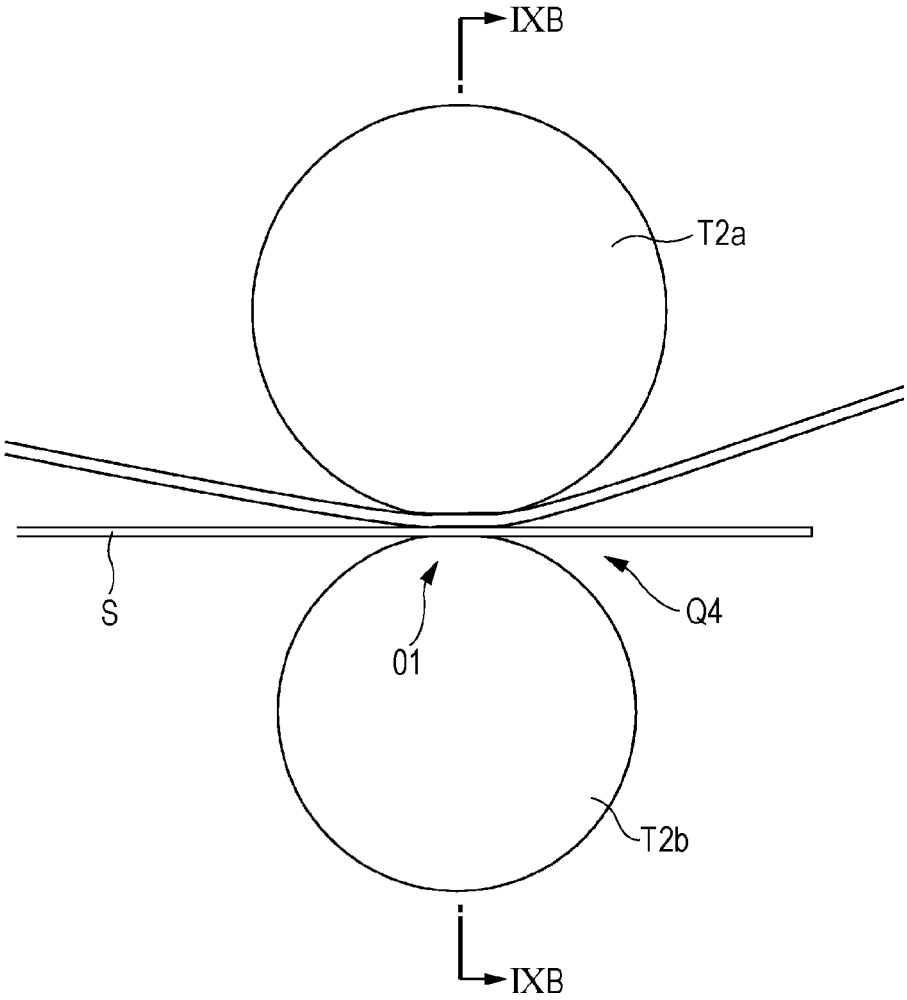
FIGS. 9A and 9B illustrate a facing region in the image forming apparatus, FIG. 9A corresponding to FIG. 3, FIG. 9B being a cross-sectional view taken along line IXB-IXB in FIG. 9A.
Figure 9B:
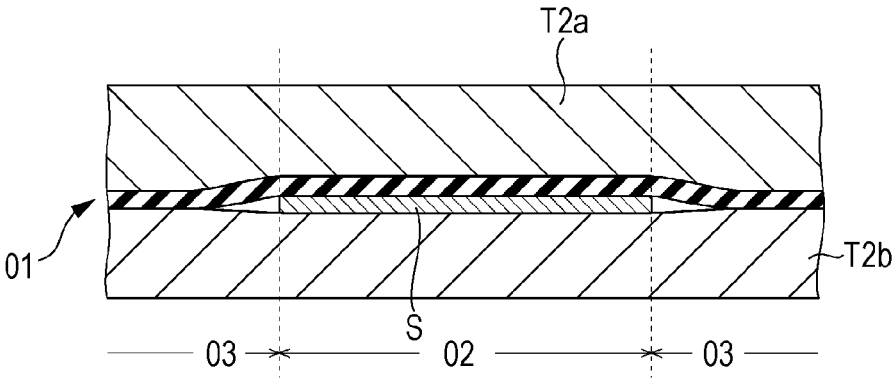

FIGS. 9A and 9B illustrate a facing region in the image forming apparatus. Specifically, FIG. 9A corresponds to FIG. 3, and FIG. 9B is a cross-sectional view taken along line IXB-IXB in FIG. 9A.

Referring to FIGS. 9A and 9B, in an image forming apparatus, a nip region 01 in the second-transfer region Q4 is normally given a length, in the front-rear direction, based on the size of the recording sheet S, that is, the size of the largest recording sheet S on which an image is to be recorded. Therefore, if the recording sheet S is not of the largest size, when the recording sheet S passes through the nip region 01, a passing section 02 through which the recording sheet S passes and a non-passing section 03 through which the recording sheet S does not pass occur in the nip region 01. If an image is to be recorded after such passing section 02 and non-passing section 03 occur multiple times, an image defect may possibly occur on a large-size recording sheet S. Specifically, the resistance value of the intermediate transfer belt B is known to decrease in the non-passing section 03. Thus, when recording an image onto a large-size recording sheet, the transfer electric field varies in the axial direction, causing an image defect, such as a decrease in density and scattering of toner, to occur.

A decrease in resistance value of the intermediate transfer belt B is caused by electric discharge occurring between the intermediate transfer belt B and the second-transfer roller T2*b*. Specifically, it is assumed that, when electric discharge occurs, the insulating properties of the resin are lost. As a result, a conductive path through which electricity travels easily is formed, causing the resistance to decrease. Therefore, it is assumed that, when the second-transfer voltage Va is high, the resistance tends to decrease because electric discharge increases due to an increase in potential difference between the intermediate transfer belt B and the second-transfer roller T2*b*.

Therefore, in order to suppress a decrease in resistance of the intermediate transfer belt B, it is conceivable that electric discharge has to be controlled and suppressed.

After further researching on control and suppression of electric discharge, it is conceivable that this electric discharge occurs due to variations in microscopical spaces in the electrical-conductivity additives 12 and 14 in the surface of the second-transfer roller T2*b*. Specifically, in the roller layer 7 of the second-transfer roller T2*b*, the electrical-conductivity additive 14 is blended in the surface layer 9. Thus, when the surface of the second-transfer roller T2*b* is viewed microscopically, it may be considered that the electrical-conductivity additive 14 having a small resistance value is scattered throughout the resin 13 having a large resistance value. Therefore, when the surface of the second-transfer roller T2*b* is viewed microscopically, the surface of the second-transfer roller T2*b* repeatedly has areas with a large resistance value and areas with a small resistance value. The accumulability and the movability of electric charge vary depending on the repeating cycle of these areas, that is, a microscopical spatial distance between resistance values according to the distance between the portions of the electrical-conductivity additive 14, thus affecting the electric discharge. A region in which the electrical-conductivity additive 14 is sparsely distributed has a large amount of resin 13, which has large resistance. In such a region, the aforementioned spatial distance is long. In contrast, in a region in which the electrical-conductivity additive 14 is densely distributed, the portions of the electrical-conductivity additive 14 are close to each other, so that the spatial distance is short.

Specifically, when voltage is applied between the intermediate transfer belt B and the second-transfer roller T2*b*, electric current flowing through the surface of the second-transfer roller T2*b* tends to flow toward the electrical-conductivity additive 14 having a small resistance value rather than through the resin 13 having a large resistance value. In other words, in the electrical-conductivity additive 14, electric charge readily moves therethrough and readily accumulates therein. Thus, when the transfer electric field becomes larger and electric discharge occurs, the electric discharge tends to occur between the electrical-conductivity additive 14 and the intermediate transfer belt B. In this case, in the intermediate transfer belt B, it is assumed that the electric discharge occurs near the electrical-conductivity additive 14. Therefore, if the spatial distance is long, since there are a small number of portions of the electrical-conductivity additive 14, it is considered that areas where electric discharge occurs tend to occur intensively also in the intermediate transfer belt B. Thus, in order to alleviate a decrease in resistance of the intermediate transfer belt B, the electric discharge may conceivably be spread by increasing microscopical points where the electric discharge occurs.

When an attempt to spread the electric discharge is performed by shortening the spatial distance near the surface of the second-transfer roller T2*b* by, for example, adjusting the blending quantities of the electrical-conductivity additives 12 and 14, concentration of the electric discharge in one area of the intermediate transfer belt B may sometimes be largely reduced. Specifically, it is discovered that, by adjusting the blending quantities of the electrical-conductivity additives 12 and 14, a decrease in resistance of the intermediate transfer belt B may be suppressed.

In this case, with regard to the electric discharge occurring from the electrical-conductivity additives 12 and 14 as points, the ease of occurrence thereof may vary depending on the sizes, the resistance values, the shapes, and so on of the electrical-conductivity additives 12 and 14. In other words, a minimal spatial distance for suppressing concentration of electric discharge may vary depending on the types of electrical-conductivity additives 12 and 14. In contrast, the present inventor has discovered that concentration of electric discharge in the second-transfer roller T2*b* may be suppressed by causing the time constant $\tau s$ in the surface direction and the time constant $\tau v$ in the volume direction to satisfy the relationship expressed by expression (11), regardless of the types of electrical-conductivity additives 12 and 14.

Specifically, in the first exemplary embodiment in which the time constant $\tau s$ in the surface direction of the second-transfer roller T2*b* is smaller than the time constant $\tau v$ in the volume direction, concentration of electric discharge is reduced. Therefore, in the first exemplary embodiment, a decrease in resistance of the intermediate transfer belt B is also suppressed. Thus, even when forming images onto recording sheets S of different sizes, the occurrence of an image defect on a large-size recording sheet S is reduced.

If the relationship expressed by expression (11) is not satisfied, that is, if the time constant $\tau s$ in the surface direction is larger than the time constant $\tau v$ in the volume direction, when electric current flows between the shaft 6 and the outer surface 9*a* of the second-transfer roller T2*b*, the electric current is less likely to flow along the outer surface 9*a*. In other words, when $\tau s > \tau v$, electric charge tends to be limited to moving in one area of the outer surface 9*a* so that the transfer electric field is generable only in one area, whereby the electric discharge is less likely to spread.

Figure 10A:
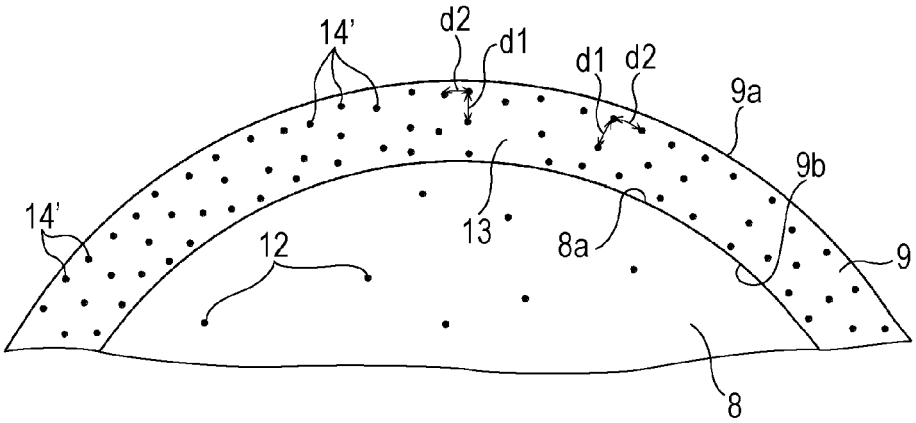
FIGS. 10A to 10C illustrate distribution of an electrical-conductivity additive, FIG. 10A corresponding to FIG. 4B, FIG. 10B being a comparative diagram, FIG. 10C being a comparative diagram different from FIG. 10B.
Figure 10B:
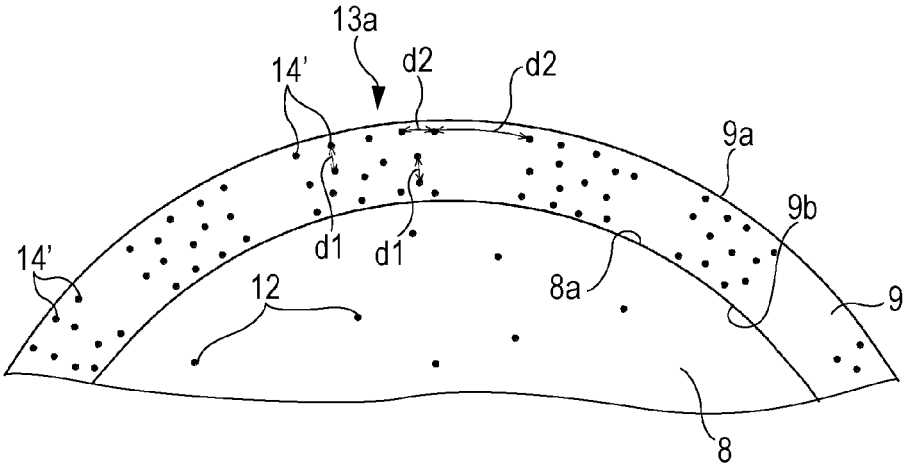
Figure 10C:
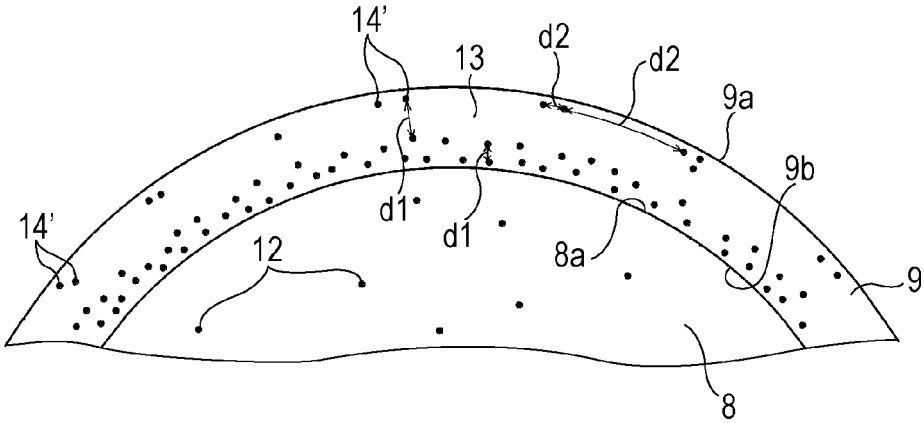

FIGS. 10A to 10C illustrate distribution of the electrical-conductivity additive. Specifically, FIG. 10A corresponds to FIG. 4B, FIG. 10B is a comparative diagram, and FIG. 10C is a comparative diagram different from FIG. 10B.

Expression (11) will be complemented here. Including a large amount of electrical-conductivity additive near the surface of a transfer roller is equivalent to, for example, including a large amount of electrical-conductivity additive 14 in the surface layer 9 in the case of the second-transfer roller T2*b* having a double-layer structure. In this case, the volume resistance value of the surface layer 9 and the surface resistance value of the second-transfer roller T2*b* decrease. However, for example, when carbon black 14' is used as the electrical-conductivity additive 14, the spatial distance varies as shown in FIGS. 10A to 10C even if the number of particles of carbon black 14' is the same.

For example, in the surface layer 9 shown in FIG. 10A, the carbon black 14' is distributed throughout the resin 13 with low unevenness, that is, in a uniform manner. Specifically, with regard to the distance between the particles of carbon black 14', there is little variation in a distance d1 in the volume direction extending from the shaft 6 toward the outer surface 9*a*. Furthermore, there is little variation in a distance d2 in the circumferential direction extending along the outer surface 9*a*. In FIG. 10A, with regard to the distance between the particles of carbon black 14' in the layer 9, the distance d2 in the circumferential direction is averagely shorter than the distance d1 in the volume direction.

The surface layer 9 shown in FIG. 10B repeatedly has, in the circumferential direction, dense areas 13*a* in which the carbon black 14' is densely distributed in the volume direction and non-dense areas 13*b* in which the carbon black 14' does not exist. Specifically, in the surface layer 9 shown in FIG. 10B, there is little variation with regard to the distance d1 in the volume direction. However, with regard to the distance d2 in the circumferential direction, the distance d2 is small in the dense areas, whereas the distance d2 is large in the non-dense areas. Thus, the distance d2 in the circumferential direction varies greatly and is nonuniform. In the surface layer 9 shown in FIG. 10C, the carbon black 14' is entirely lopsidedly distributed toward the inner surface 9*b*. Some of the carbon black 14' is clustered near the outer surface 9*a*. In this case, the clustered areas near the outer surface 9*a* are distant from each other in the circumferential direction. Therefore, in the surface layer 9 shown in FIG. 10C, the distances d1 and d2 between the particles of carbon black 14' vary greatly and are nonuniform. Thus, in the surface layer 9 shown in each of FIGS. 10B and 10C, the distance d2 between the particles of carbon black 14' in the circumferential direction near the outer surface 9*a* varies greatly and is nonuniform.

A case where electric discharge occurs will now be discussed. In the second-transfer roller T2*b* shown in FIG. 10A, the spatial distance of the carbon black 14' is small, making it easier for the electric discharge to spread since the electric discharge is less likely to concentrate in one area. Thus, electric-discharge energy per electrical conductive spot may spread readily. In contrast, in the second-transfer roller T2*b* shown in each of FIGS. 10B and 10C, the electric discharge tends to concentrate in the dense areas of the carbon black 14' near the outer surface 9*a*. Thus, the electric-discharge energy per electrical conductive spot tends to increase. If the distribution of the carbon black 14' is uniform in the circumferential direction, the electric discharge tends to spread with decreasing distance d2.

Therefore, simply making the surface resistance value smaller than the volume resistance value (surface resistance value<volume resistance value) or making the surface resistivity smaller than the volume resistivity (surface resistivity<volume resistivity) by increasing the blending quantity of an electrical-conductivity additive results in a transfer roller having areas with a large spatial distance as in FIG. 10B or 10C, possibly resulting in a situation where electric discharge between the intermediate transfer belt B and the second-transfer roller T2*b* is not alleviated. This may result in a high possibility of a decrease in resistance of the intermediate transfer belt B.

In contrast, in the first exemplary embodiment in which expression (11) is satisfied, the time constant $\tau s$ is smaller than the time constant $\tau v$. Thus, the spatial distance between the portions of the electrical-conductivity additive 14 near the outer surface 9*a* of the second-transfer roller T2*b* is maintained at a certain value or smaller. Therefore, the configuration is limited to a transfer roller with a small spatial distance, so that concentration of electric discharge is alleviated. Consequently, in the second-transfer roller T2*b* according to the first exemplary embodiment, concentration of electric discharge may be readily alleviated and a decrease in resistance of the intermediate transfer belt B may be readily suppressed, as compared with the configuration in the related art.

In the configuration in the related art, the cross section of the roller layer 7 has to be observed by disassembling the second-transfer roller T2*b* so as to determine whether or not the spatial distance is small enough for alleviating electric discharge. In other words, in the related art, the positional relationship between the portions of the electrical-conductivity additive 14 has to be observed. In contrast, in the first exemplary embodiment, the relationship $\tau s<\tau v$ is satisfied so that the spatial distance of the electrical-conductivity additive 14 is determined to be small without having to actually observe the cross section of the roller layer 7. In other words, based on the relationship $\tau s<\tau v$, the arrangement of the electrical-conductivity additive 14 in the volume direction and the surface direction is controlled so that the spatial distance of the electrical-conductivity additive 14 is made small enough for alleviating electric discharge.

Figures 11A, 11B:
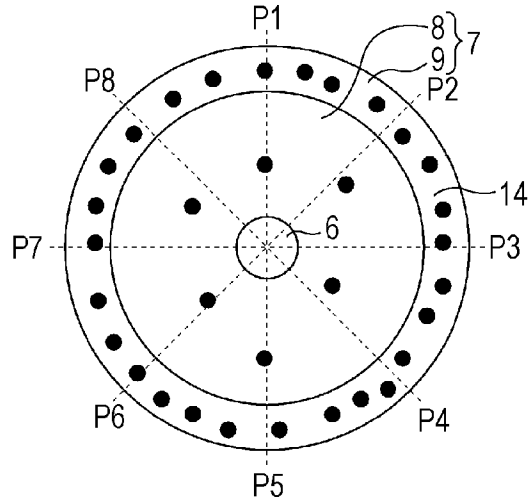
FIGS. 11A and 11B illustrate uniform distribution of an electrical-conductivity additive, FIG. 11A schematically illustrating a measurement method, FIG. 11B illustrating a measurement-result determination method.

FIGS. 11A and 11B illustrate uniform distribution of an electrical-conductivity additive. Specifically, FIG. 11A schematically illustrates a measurement method, and FIG. 11B illustrates a measurement-result determination method.

With regard to a case where there is little variation in the distribution of the electrical-conductivity additive 14 or 14', the reason for uniformly distributing the electrical-conductivity additive in the circumferential direction as shown in FIG. 10A will be described in particular. In this specification, the uniform distribution of the electrical-conductivity additive 14 or 14' in the circumferential direction will be defined by using a standard deviation $\sigma$ related to the time constant $\tau s$ of the transfer roller. Specifically, in FIG. 11A, the time constant $\tau s$ of the second-transfer roller T2*b* is measured at different points P1 to P8 located at 45° intervals in the circumferential direction. In this specification, a state where the standard deviation $\sigma$ with respect to the eight measured time constants $\tau s$ is smaller than 1.0 will be defined as uniform distribution of the electrical-conductivity additive 14 or 14' in the circumferential direction. Thus, for example, referring to FIG. 11B, assuming that the time constants $\tau s$ are measured at the positions P1 to P8 for each of samples 1 to 10 of second-transfer rollers T2*b*, the samples 4, 7, 9, and 10 in which the standard deviation $\sigma$ satisfies the condition $\sigma<1.0$ are regarded that the electrical-conductivity additive 14 is uniformly distributed therein.

Figure 12A:
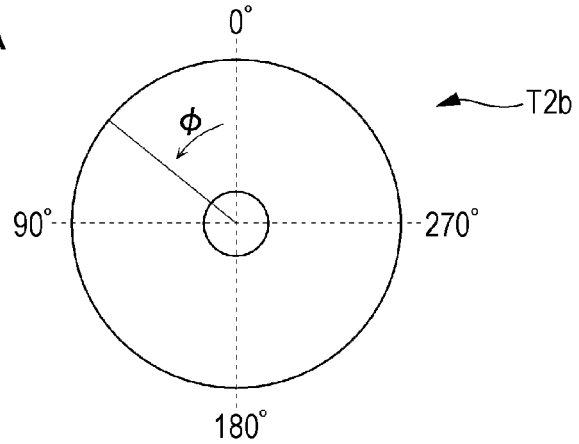
FIGS. 12A to 12D illustrate a distance in the volume direction and a distance in the circumferential direction between portions of an electrical-conductivity additive, FIG. 12A schematically illustrating a measurement method, FIG. 12B illustrating a measurement result corresponding to FIG. 10A, FIG. 12C illustrating a measurement result corresponding to FIG. 10B, FIG. 12D illustrating a measurement result corresponding to FIG. 10C.
Figure 12B:
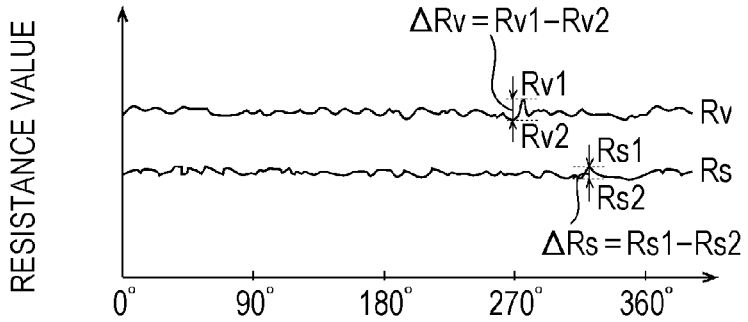
Figure 12C:
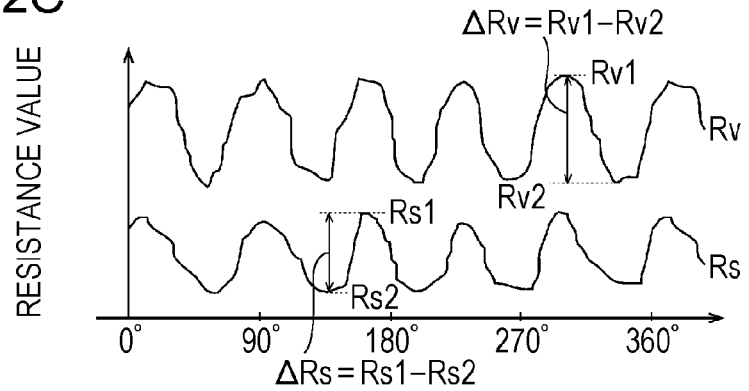
Figure 12D:
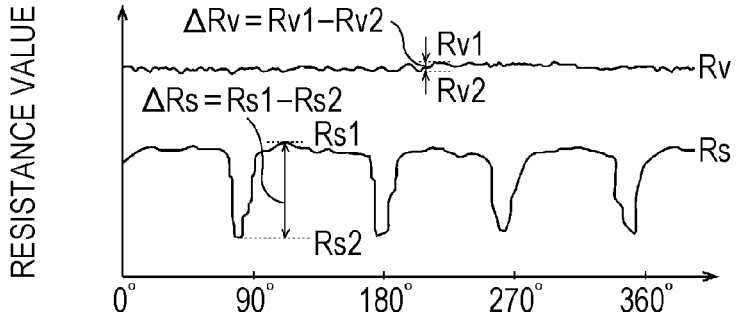

FIGS. 12A to 12D illustrate a distance in the volume direction and a distance in the circumferential direction between portions of an electrical-conductivity additive. Specifically, FIG. 12A schematically illustrates a measurement method, FIG. 12B illustrates a measurement result corresponding to FIG. 10A, FIG. 12C illustrates a measurement result corresponding to FIG. 10B, and FIG. 12D illustrates a measurement result corresponding to FIG. 10C.

With regard to the distances between the portions of the electrical-conductivity additive used in the above description, the magnitude relationship between the distance d1 in the volume direction and the distance d2 in the circumferential direction will be described. In this specification, the distances d1 and d2 are defined by using resistance values Rv and Rs measured for one perimeter of the second-transfer roller T2*b*. Specifically, in FIGS. 12A to 12D, for the distance d1 in the volume direction, a volume resistance value Rv for one perimeter of the second-transfer roller T2*b* is measured. A difference $\Delta Rv$ (=Rv1−Rv2) between a maximum value Rv1 and a minimum value Rv2 of the measured resistance value Rv expresses the aforementioned distance d1. For the distance d2 in the circumferential direction, a surface resistance value Rs for one perimeter of the second-transfer roller T2*b* is measured. A difference $\Delta Rs$ (=Rs1−Rs2) between a maximum value Rs1 and a minimum value Rs2 of the measured resistance value Rs expresses the aforementioned distance d2. Thus, in the second-transfer roller T2*b* in which $\Delta Rs<\Delta Rv$ is satisfied, it is regarded that each of the electrical-conductivity additives 12 and 14 is distributed in the roller layer 7 such that the distance d2 between the portions of the electrical-conductivity additive in the circumferential direction of the outer surface 9*a* is shorter than the distance d1 between the portions of the electrical-conductivity additive in the volume direction.

Normally, a resistance value of a transfer roller is dependent on voltage. This dependency on voltage is classifiable into two types, that is, an electronic conductive type and an ionic conductive type, from the inclination of a resistance value relative to applied voltage. An electronic conductive type is a type in which an electronic conductive agent typified by carbon black carries electric current, and has high voltage dependency. On the other hand, an ionic conductive type is a type in which ions carry electric current, and has low voltage dependency.

In transfer rollers in the related art, ionic conduction is dominant, and the volume resistance value often decreases gradually with increasing applied voltage. In this case, if the blending quantity of carbon black near the surface is to be increased for decreasing the surface resistance value, electronic conduction becomes dominant over ionic conduction near the surface. Thus, the surface resistance value has higher voltage dependency and decreases sharply with increasing voltage. In other words, the surface resistance value increases sharply with decreasing voltage.

Normally, a resistance value of the second-transfer roller T2*b* is measured with a voltage applied during a transfer process, such as 1000 V. Therefore, in the configuration in the related art, with regard to a volume resistance value and a surface resistance value measured at 1000 V, the surface resistance value is set to be smaller than the volume resistance value. However, if the surface resistance value is made smaller by increasing the blending quantity of carbon black, the surface resistance value would increase sharply with decreasing voltage, as described above. Thus, at the low voltage side, the surface resistance value becomes larger than the volume resistance value. Electric discharge occurs when the potential difference with respect to the transfer roller is about 300 V. Thus, in the case of the transfer roller in the related art in which the surface resistance value is set to be smaller than the volume resistance value, the surface resistance value becomes larger than the volume resistance value in a low voltage region of about 300 V, making it difficult to alleviate concentration of electric discharge. Specifically, in the configuration in the related art, expression (11) is not satisfied, resulting in $\tau s > \tau v$. Since the aforementioned resistance value may be read as resistivity, the condition $\rho s < \rho v$ in Japanese Unexamined Patent Application Publication No. 3-100579 generally results in $\tau s > \tau v$.

To describe this briefly, the idea of simply reducing the surface resistance value or the surface resistivity as in the related art only leads to an increase in the blending quantity of an electrical-conductivity additive. This is equivalent to making the electrical conducting mechanism into an electronic conductive type. Thus, it is difficult to cope with the problem regarding electric discharge occurring at the low voltage side. If carbon black is to be increased so as to decrease the surface resistance value in a transfer roller of an ionic conductive type, the behavior of electronic conduction becomes stronger. Thus, it is extremely difficult to decrease the resistance while maintaining ionic conduction. Therefore, in either case, it is difficult to prevent the surface resistance value from increasing sharply with decreasing voltage.

In a double-layer structure including a base layer and a surface layer, $\tau s < \tau v$ may conceivably be achieved by largely decreasing a resistance value of the surface layer. Specifically, the surface resistance value may conceivably be decreased largely in advance so that even when the surface resistance value increases sharply with decreasing voltage, the surface resistance value is smaller than the volume resistance value. However, in this state, the transfer current does not flow to the shaft 6 but flows along the surface of the second-transfer roller T2*b* to begin with. Thus, before the occurrence of a problem of a decrease in resistance of the non-passing section of the intermediate transfer belt B, a problem of the transfer roller losing its function occurs.

In contrast, in the first exemplary embodiment, the second-transfer roller T2*b* satisfies the condition $\tau s < \tau v$. Therefore, the function of the transfer roller is ensured by adjusting the relationship between the resistance values at about a voltage applied during a transfer process, while the relationship between the resistance values at about a voltage applied to the second-transfer roller T2*b* during actual electric discharge between the intermediate transfer belt B and the second-transfer roller T2*b* is defined.

In the relationship expressed by expression (11), it is conceivable that spreadability of electric discharge increases with decreasing time constant $\tau s$ in the surface direction. Thus, in view of suppressing concentration of electric discharge, it may seem it is more desirable that the time constant $\tau s$ in the surface direction be as small as possible. However, if the time constant $\tau s$ in the surface direction is too small, a decrease in image density may occur when recording an image onto, for example, thick paper.

The present inventor has discovered that, when the time constant $\tau s$ in the surface direction satisfies the relationship expressed by expression (12), a transfer electric field may be reliably ensured even when recording an image onto, for example, thick paper. Thus, in the printer U according to the first exemplary embodiment that satisfies the relationship expressed by expression (12), a decrease in image density occurring with a decrease in transfer electric field may be suppressed while an image defect occurring with a decrease in resistance of the intermediate transfer belt B may be suppressed.

Expression (12) will be complemented here:

$$(L/v)\times(Rv/Rs)<\tau s<\tau v \quad (12)$$

In expression (12), (L/v) is in units of seconds and denotes a time period from a point at which the outer surface 9*a* of the second-transfer roller T2*b* enters the nip region 16 to a point at which the outer surface 9*a* passes through the nip region 16, as shown in FIG. 3.

Furthermore, (Rv/Rs) is a ratio between a resistance value [Ω] and a resistance value [Ω] and denotes a dimensionless value, that is, a coefficient.

In expression (12), (L/v) is equivalent to a time period during which a certain position on the second-transfer roller T2*b* passes through the nip region 16. Specifically, (L/v) indicates an electric-potential rising period within the nip region 16, that is, a transfer-electric-field rising period within the nip region 16. Thus, although a transfer electric field for a second-transfer process has to be generated within the passing time period (L/v), the way in which the transfer electric field rises is dependent on the resistance values of the second-transfer roller T2*b*. Therefore, it is not desirable to randomly set a rotation speed v and the nip width L. Specifically, the rotation speed v and the nip width L are normally set by also taking into account a transfer voltage to be applied in accordance with the resistance values of the second-transfer roller T2*b*.

In expression (12), Rv denotes a volume resistance value and thus has an effect on the transfer voltage.

If the passing time period (L/v) is short, the transfer electric field has to rise rapidly. Therefore, Rv is set to a relatively small value. In contrast, if the passing time period (L/v) is long, the transfer electric field may rise gently. Therefore, Rv may be set to a relatively large value.

By setting Rv to a relatively small value, the capacity of a second-transfer power source may be reduced. This allows for use of a low-voltage power source, thereby achieving lower cost. However, this may lead to deterioration in image quality since there is a large amount of electric discharge within the nip region 16. In contrast, by setting Rv to a relatively large value, electric discharge within the nip region 16 may be suppressed, thereby achieving higher image quality. However, in this case, a high-voltage power source may be necessary.

Consequently, the volume resistance value Rv is set in accordance with the intended purpose.

Furthermore, Rv/Rs obtained by dividing the volume resistance value Rv by the surface resistance value Rs increases with decreasing surface resistance value Rs. This implies that flowability of electric current in the surface direction of the second-transfer roller T2*b* increases with decreasing surface resistance value Rs. Thus, this implies that a current loss of electric current that bypasses in the surface direction of the second-transfer roller T2*b*, that is, a current loss of electric current less likely to contribute to the transfer electric field, increases. Therefore, (L/v)×(Rv/Rs) in its entirety indicates the degree of current loss in the surface direction of the second-transfer roller T2*b* during the transfer-electric-field rising period (L/v).

In expression (12), the magnitude relationship between the time constant τs in the surface direction and the time constant τv in the volume direction is similar to that in expression (11). Specifically, this implies that concentration of electric discharge between the intermediate transfer belt B and the second-transfer roller T2*b* is alleviated. In other words, when τs>τv, the spatial distance of the electrical-conductivity additive near the surface of the second-transfer roller T2*b* is not sufficient for alleviating concentration of electric discharge.

Second Exemplary Embodiment

Next, a second exemplary embodiment of the present invention will be described. In the description of the second exemplary embodiment, components that correspond to those in the first exemplary embodiment are given the same reference characters, and detailed descriptions thereof will be omitted.

The second exemplary embodiment differs from the first exemplary embodiment in the following points but is similar to the first exemplary embodiment in other points.

Figure 13:
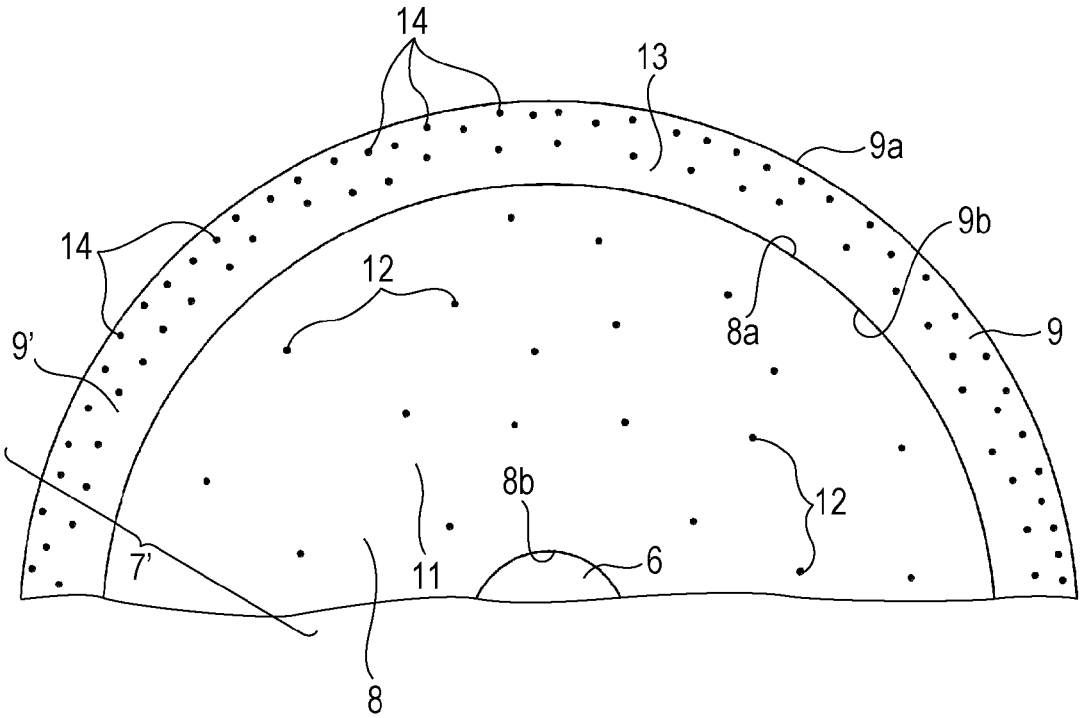
FIG. 13 is an enlarged view illustrating a relevant part of a transfer member according to a second exemplary embodiment of the present invention and corresponds to FIG. 4B in the first exemplary embodiment.

FIG. 13 is an enlarged view illustrating a relevant part of a transfer member according to the second exemplary embodiment of the present invention and corresponds to FIG. 4B in the first exemplary embodiment.

In FIG. 13, in a roller layer 7' of the second-transfer roller T2*b* according to the second exemplary embodiment, the electrical-conductivity additives 12 and 14 are distributed more densely toward the outer surface 9*a* from the shaft 6. Specifically, the roller layer 7' in the second exemplary embodiment has the base layer 8 similar to that in the first exemplary embodiment. Furthermore, the outer surface 8*a* of the base layer 8 in the second exemplary embodiment supports a surface layer 9' according to the second exemplary embodiment in place of the surface layer 9 according to the first exemplary embodiment. In the surface layer 9' according to the second exemplary embodiment, the electrical-conductivity additive 14 is distributed lopsidedly toward the outer surface 9*a*. With regard to the electrical-conductivity additive 14 distributed lopsidedly toward the outer surface 9*a*, there is little variation in the distance d2 between the portions of the electrical-conductivity additive 14 in the circumferential direction extending along the outer surface 9*a*. Specifically, the electrical-conductivity additive 14 is uniformly distributed in a state where there is little lopsidedness in the circumferential direction.

Transfer-Member Manufacturing Method According to Second Exemplary Embodiment

In the second exemplary embodiment, an electrode plate is disposed facing the outer surface 8*a* of the base layer 8. Furthermore, in the second exemplary embodiment, the resin liquid 43 is sprayed onto the outer surface 8*a* of the base layer 8 while applying voltage between the shaft 6 and the electrode plate. In other words, in the second exemplary embodiment, an electric field that causes the electrical-conductivity additive 32 within the resin liquid 43 to move toward the outer surface 9*a* is generated. The electric field is set in view of the movability of the electrical-conductivity additive 32, such as the viscosity of the resin liquid 43. Then, the electrical-conductivity additive 32 is moved so as to be lopsided toward the outer surface 9*a*, whereby the surface layer 9' is formed. The electrical-conductivity additive 32 may be preliminarily charged, or frictional electrification or the like during feeding may be utilized. Alternatively, the electrical-conductivity additive 32 may be lopsided by applying the electric field during a drying and baking period after spraying.

Operation of Second Exemplary Embodiment

In the second-transfer roller T2*b* according to the second exemplary embodiment, expression (11) and expression (12) are satisfied. Thus, the second exemplary embodiment is similar to the first exemplary embodiment in that concentration of electric discharge may be alleviated, and transferability onto thick paper may be ensured.

In particular, in the surface layer 9' of the second-transfer roller T2*b* according to the second exemplary embodiment, the electrical-conductivity additive 14 is distributed lopsidedly toward the outer surface 9*a*. In a configuration in which the electrical-conductivity additive 14 is uniformly distributed without any lopsidedness, if the number of portions of the electrical-conductivity additive is to be increased in the surface layer so as to satisfy expression (11), the volume resistance value of the transfer roller tends to decrease. Thus, even if concentration of electric discharge is alleviated in the non-passing section by satisfying expression (11), there is a possibility that electric discharge toward the toner in the passing section within the nip region 16 may increase. In other words, image quality may possibly deteriorate. In contrast, in the second exemplary embodiment, expression (11) may be readily satisfied without causing the volume resistance value to largely decrease. Therefore, in the second exemplary embodiment, concentration of electric discharge may be readily alleviated without causing deterioration in image quality, and a decrease in resistance of the intermediate transfer belt B may be readily suppressed, as compared with a case where the electrical-conductivity additive is uniformly distributed within the surface layer.

Figure 14A:
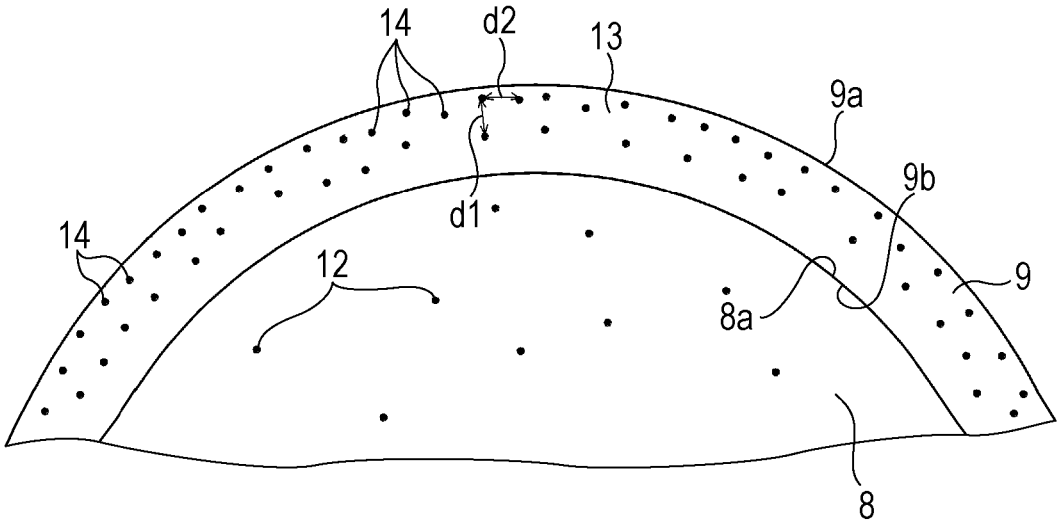
FIGS. 14A and 14B illustrate distribution of an electrical-conductivity additive in accordance with the second exemplary embodiment, FIG. 14A corresponding to FIG. 13, FIG. 14B being a comparative diagram in a case where the electrical-conductivity additive is uniformly distributed.
Figure 14B:
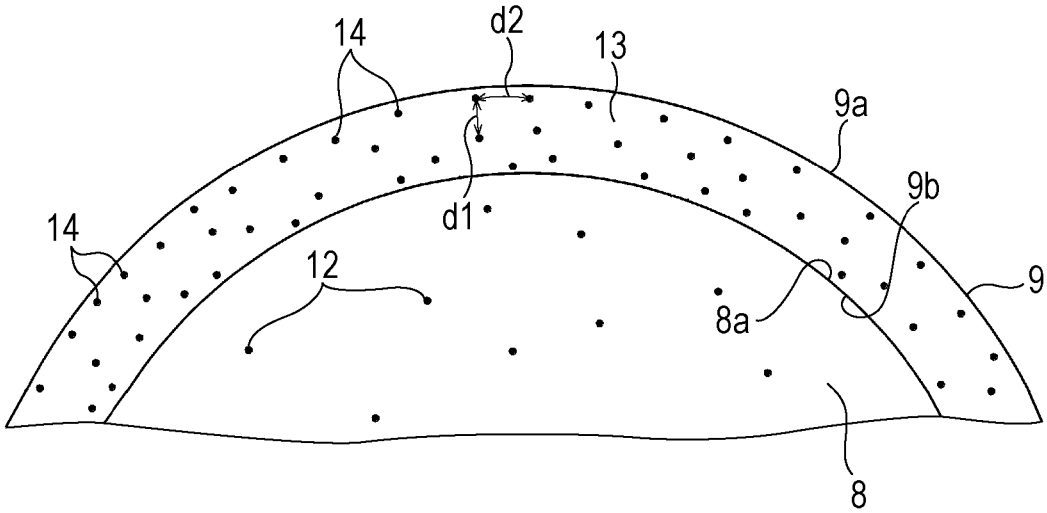

FIGS. 14A and 14B illustrate distribution of the electrical-conductivity additive in accordance with the second exemplary embodiment. Specifically, FIG. 14A corresponds to FIG. 13, and FIG. 14B is a comparative diagram in a case where the electrical-conductivity additive is uniformly distributed.

Furthermore, for example, in FIG. 14B, in a case where the number of portions of the electrical-conductivity additive in the surface layer is small, if the electrical-conductivity additive 14 is uniformly distributed without any lopsidedness, expression (11) may sometimes be not satisfied. Specifically, in a configuration in which a small number of portions of the electrical-conductivity additive are uniformly distributed, the time constant τs becomes larger than the time constant τv, resulting in a large spatial distance. In this case, in the second exemplary embodiment in which the electrical-conductivity additive 14 is distributed lopsidedly toward the outer surface 9*a*, the number of portions of the electrical-conductivity additive 14 is the same as that in FIG. 14B, and the time constant τs may become smaller than the time constant τv even if the surface resistance value and the volume resistance value are not different from those in FIG. 14B. Therefore, in the lopsided configuration as in the second exemplary embodiment, concentration of electric discharge may readily be alleviated and a decrease in resistance of the intermediate transfer belt B may be readily suppressed with a smaller number of portions of the electrical-conductivity additive, as compared with a configuration in which the electrical-conductivity additive is uniformly distributed in the entire layer.

Third Exemplary Embodiment

Next, a third exemplary embodiment of the present invention will be described. In the description of the third exemplary embodiment, components that correspond to those in the first and second exemplary embodiments are given the same reference characters, and detailed descriptions thereof will be omitted.

The third exemplary embodiment differs from the first and second exemplary embodiments in the following points but is similar to the first and second exemplary embodiments in other points.

Value Settings of Transfer Member According to Third Exemplary Embodiment

With regard to the second-transfer roller T2*b* according to the third exemplary embodiment, a second-transfer roller T2*b* that satisfies the relationship expression by expression (21) shown below in place of expression (12) is used. Specifically, in the third exemplary embodiment, when an Asker C hardness of the outer surface 9*a* of the roller layer 7 of the second-transfer roller T2*b* is defined as H, the time constant τs [s] in the surface direction and the time constant τv [s] in the volume direction satisfy the relationship expressed by expression (21) shown below:

$$(1/H)\times 0.5<\tau s<\tau v \quad (21)$$

Figure 15:
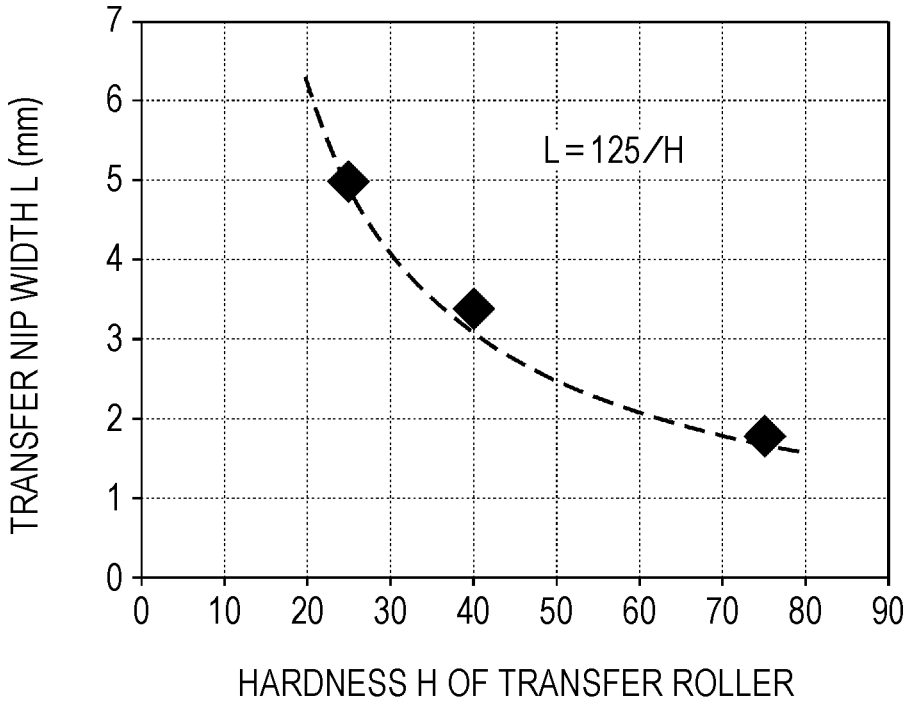
FIG. 15 illustrates the relationship between a nip width of a second-transfer roller and the hardness of the second-transfer roller.

FIG. 15 illustrates the relationship between the nip width of the second-transfer roller and the hardness of the second-transfer roller.

Normally, the transfer pressure in the second-transfer region Q4 is set in advance. Load is applied onto the second-transfer roller T2*b* in accordance with a hardness H2 of the second-transfer roller T2*b* so that the transfer pressure is achieved. In this case, expression (22) shown below stands between the hardness H (=H2) of the second-transfer roller T2*b* and the width L of the nip region 16 in the second-transfer region Q4 relative to an experimentally-determined coefficient Z:

$$L=Z/H \quad (22)$$

In FIG. 15, for example, when the roller length λ3 of the second-transfer roller T2*b* in the axial direction is 320 mm and the transfer pressure is about 4.3 N/cm$^2$, experimentally-based expression (22') shown below stands between H and L:

$$L=125/H \quad (22')$$

In the aforementioned second-transfer roller T2*b*, when the hardness H is 25 degrees or 40 degrees, foamed rubber is used for the base layer 8. If the hardness H is 75 degrees, solid rubber is used for the base layer 8. Furthermore, in the second-transfer roller T2*b*, in order to maintain the transfer pressure at 4.3 N/cm$^2$, 68 N is set when the transfer-roller hardness is 25 degrees, 47 N is set when the transfer-roller hardness is 40 degrees, and 25 N is set when the transfer-roller hardness is 75 degrees.

By incorporating expression (22) into expression (12) in the first exemplary embodiment and reorganizing the leftmost side of expression (12), expression (23) shown below is obtained:

$$(L/v)\times(Rv/Rs)=\{(Z/H)/v\}\times(Rv/Rs) \quad (23)$$
$$=(1/H)\times(Z/v)\times(Rv/Rs)$$

Thus, expression (12) is transformable into expression (24) shown below by using expression (23):

$$(1/H)\times(Z/v)\times(Rv/Rs)<\tau s<\tau v \quad (24)$$

Next, (Z/v)×(Rv/Rs), which is a coefficient part of (1/H) in expression (24), will be described.

By substituting A for (Z/v)×(Rv/Rs), a coefficient A of (1/H) is estimated.

First, before estimating the coefficient A, the physical meaning of expression shown above will be confirmed. When the rotation speed v is low, Rv/Rs is set to a small value. This implies that, the lower the rotation speed v, the smaller the threshold value for a current loss in the surface direction of the second-transfer roller T2*b*. In other words, Rs may be set to a smaller value as the rotation speed v increases, so that Rv/Rs is set to a large value. Specifically, this implies that a current loss in the surface direction of the second-transfer roller T2*b* tends to occur more with decreasing rotation speed.

Next, expression (24) is transformed. A time constant of a dielectric member is normally determined based on the resistance value and the electrostatic capacitance of the dielectric member. Specifically, the time constant τs in the surface direction may be considered as a product of the surface resistance value Rs and an electrostatic capacitance Cs in the surface direction. The electrostatic capacitance Cs in the surface direction is an electrostatic capacitance of a surface section of the second-transfer roller T2*b*. Therefore, by substituting τs=Rs×Cs for τs in expression (24), expression (25) shown below with respect to the relationship between the left side of expression (24) and the time constant τs in the surface direction is obtained:

$$(1/H)\times(Z/v)\times(Rv/Rc)<Cs\times Rs \quad (25)$$

Consequently, expression (26) shown below is obtained from the relationship between expression (25) and A:

$$(Z/v)\times(Rv/Rs)<H\times Cs\times Rs$$

$$A=A(v,Rv,Rs)<H\times Cs\times Rs \quad (26)$$

Thus, A is set as a value that satisfies expression (26). In this case, A(v,Rv,Rs) denotes that the coefficient A is a function of v, Rv, and Rs. Then, a maximum value, that is, a threshold value, of A that satisfies expression shown above (a random combination does not satisfy expression shown above) when v, Rv, Rs, H, and Cs are set is determined.

However, it is extremely difficult to analytically determine the coefficient A. Thus, the coefficient A is experimentally estimated based on several conditions. With regard to the experimental conditions, suitably usable numerical values are used for the second-transfer roller. In the third exemplary embodiment, experiments are performed on a total of 12 second-transfer rollers T2*b*. Specifically, when the surface resistance value Rs and the volume resistance value Rv of each second-transfer roller T2*b* are expressed as (Rs[log Ω], Rv[log Ω]), for example, the second-transfer rollers T2*b* have six patterns of resistance values, i.e., (7.8, 8.3), (8.1, 8.0), (8.1, 8.3), (8.3, 8.0), (8.3, 8.3), and (8.3, 8.7), and two patterns of Asker C hardness, i.e., 25 degrees and 75 degrees. With regard to the hardness H of the second-transfer roller T2*b*, an Asker C hardness ranging between 25 degrees and 75 degrees are suitably usable. Therefore, the boundary values are used as the experimental conditions.

Furthermore, the electrostatic capacitance Cs in the surface direction is estimated by measuring the impedance. Specifically, the impedance is measured by using a dielectric-constant measurement interface of model 1296 and an impedance analyzer of model 1260, which are manufactured by Solartron Group Ltd. In this case, the applied voltage is 1 V and 3 V based on alternating current. Furthermore, the measurement frequencies of real and imaginary parts are measured in conditions from 10 mHz to 1 MHz. Then, by using a value obtained by fitting as an example of an approximate-expression deriving technique, the electrostatic capacitance Cs is estimated with a capacitor-resistor (CR) circuit using analysis software based on the measurement value of each of the real and imaginary parts. Evaluations are performed by setting the rotation speed v to 440 mm/s and 600 mm/s.

As the volume resistance value of the backup roller T2*a*, $10^{7.0}\Omega$ is used. However, electric discharge between the intermediate transfer belt B and the second-transfer roller T2*b* is determined based on voltage applied to a so-called gap between the intermediate transfer belt B and the second-transfer roller T2*b*. Therefore, the energy during the electric discharge is dependent on the electrical conductive spots of the second-transfer roller T2*b*, that is, the spatial distance of the electrical-conductivity additive. Thus, the volume resistance value of the backup roller T2*a* substantially has no effect.

FIG. 16 illustrates evaluation results of the coefficient A.

Figure 17:
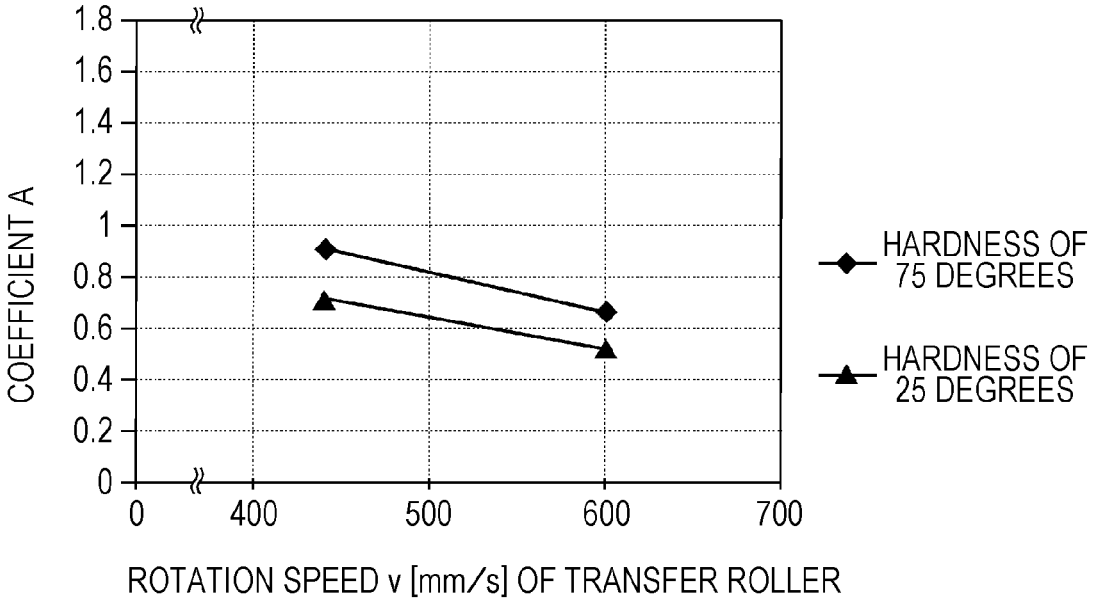
FIG. 17 illustrates a maximum coefficient A that satisfies expression (26) for each speed and each hardness.

FIG. 17 illustrates a maximum coefficient A that satisfies expression (26) for each speed and each hardness.

In FIG. 16, when the coefficient A satisfies expression (26), transferability onto small-size thick paper is satisfactory. Thus, as shown in FIG. 16, when the coefficient A satisfies expression (26), a cell corresponding to transferability onto small-size thick paper is given a circle. A maximum coefficient A that satisfies expression (26) for each hardness H and each speed v is shown in FIG. 17. Specifically, in FIG. 17, a threshold value for the coefficient A, which indicates that transferability onto small-size thick paper is satisfactory when the coefficient A is smaller than or equal to this value, is shown.

As a result, in FIGS. 16 and 17, it is confirmed that when the coefficient A is smaller than or equal to 0.9, a transfer defect on small-size thick paper may be suppressed. Specifically, it is confirmed that when the hardness is 75 degrees and the rotation speed v is 440 mm/s, a transfer defect may be suppressed even if the coefficient A is 0.9. However, in a case of high-speed rotation, that is, when the rotation speed v is 400 mm/s or higher, high transfer voltage may generally be necessary. When the hardness or the rotation speed changes, it is confirmed that the coefficient A has to be further reduced from 0.9. It is confirmed that when the coefficient A is smaller than or equal to 0.5 and is sufficiently small, a transfer defect on small-size thick paper may be suppressed even when the hardness or the rotation speed changes, as shown in FIGS. 16 and 17.

Consequently, based on the above evaluation results, a coefficient A that satisfies expression (27) shown below may be estimated:

$$A<0.5 \tag{27}$$

Thus, by undoing A by dividing both sides of expression (27) by H, expression (28) shown below is obtained:

$$(1/H)\times(Z/v)\times(Rv/Rs)<(1/H)\times 0.5 \tag{28}$$

In view of expression (24), expression (28), and the magnitude relationship of τs, τv, and A in the evaluation results shown in FIG. 16, expression (21) is obtained:

$$(1/H)\times 0.5<\tau s<\tau v \tag{21}$$

Operation of Third Exemplary Embodiment

In the second-transfer roller T2*b* according to the third exemplary embodiment having the above-described configuration, the time constant τs in the surface direction and the time constant τv in the volume direction satisfy the relationship expressed by expression (11). Thus, similar to the first exemplary embodiment, concentration of electric discharge may be alleviated. In particular, in the third exemplary embodiment, the time constant τs in the surface direction, the time constant τv in the volume direction, and the Asker C hardness H of the second-transfer roller T2*b* satisfy the relationship expressed by expression (21). Thus, in the printer U according to the third exemplary embodiment that satisfies expression (21), even when an image is to be recorded onto, for example, thick paper, a transfer electric field may be readily ensured, as compared with a case where a lower limit for the time constant τs in the surface direction is not set. Thus, in the printer U according to the third exemplary embodiment, a decrease in image density occurring with a decrease in transfer electric field may be suppressed while an image defect occurring with a decrease in resistance of the intermediate transfer belt B may be suppressed.

EXPERIMENTAL EXAMPLE

Next, experiments for checking the effects of the first to third exemplary embodiments are performed.

Intermediate Transfer Body and Second-Transfer Unit According to Experimental Example Referring to FIGS. 1 to 3, the following configuration is used in the experimental example.

With regard to the backup roller T2*a*, the shaft 1 has a diameter of 14 mm, the roller layer 2 has a thickness of 5 mm, the hardness H1 is an Asker C hardness of 60 degrees, and the volume resistance value is $10^{7.0}\Omega$ at an applied voltage of 1 kV.

The intermediate transfer belt B is composed of polyimide with carbon black blended therein. The intermediate transfer belt B according to the experimental example has a thickness of 80 μm, a volume resistivity of $10^{10}$ Ω·cm at an applied voltage of 100 V, and a surface resistivity of $10^{10}$ Ω/sq. at an applied voltage of 100 V.

With regard to the second-transfer roller T2*b*, the shaft 6 has a diameter of 14 mm, and the roller layer 7 has a double-layer configuration in which the base layer 8 has a thickness of 5 mm and the surface layer 9 has a thickness of 20 μm. The length λ2 of the roller layer 7 according to the experimental example in the front-rear direction is set to 320 mm. The volume resistance value Rv and the surface resistance value Rs of the second-transfer roller T2*b* according to the experimental example are adjusted by independently controlling the resistance of the base layer 8 and the resistance of the surface layer 9. A specific configuration of the second-transfer roller T2*b* according to the experimental example will be described later.

In the experimental example, Fuji Xerox J paper at 82 grams per square meter, which is plain paper, is used as a recording sheet S to be used for evaluation. As a recording sheet S of small-size thick paper, a postcard is used.

An evaluation experiment is performed at a temperature of 10° C. and a relative humidity of 15%.

Constant current control is performed by using a constant current source as a second-transfer power source. When the transport speed v is 528 mm/s, an electric current of 110 μA is applied. When the transport speed v is 264 mm/s, an electric current of 55 μA is applied.

For the second-transfer roller T2*b*, transfer load with a transfer pressure of 4.3 N/cm$^2$ is set. Specifically, when the hardness of the transfer roller is 25 degrees, the transfer load is set to 68 N. When the hardness of the transfer roller is 40 degrees, the transfer load is set to 47 N. When the hardness of the transfer roller is 75 degrees, the transfer load is set to 25 N.

Transfer-Member Manufacturing Method According to Experimental Example

Referring to FIGS. 5A and 5B, in the experimental example, a specific configuration of the mixture 29 is as follows.

As the rubber material 21, epichlorohydrin rubber and acrylonitrile-butadiene rubber, which have excellent ion conductivity by containing an ethylene oxide group, are used. Specifically, Epichlomer CG-102 manufactured by Daiso Co., Ltd. is used as epichlorohydrin rubber. Moreover, Nipol DN-219 manufactured by Zeon Corporation is used as acrylonitrile-butadiene rubber.

Furthermore, carbon black is used as the electrical-conductivity additive 22. Specifically, Special Black 4A manufactured by Degussa Corporation is used. The blending quantity of carbon black is adjusted in accordance with the conditions of the second-transfer roller to be formed. A description regarding the blending quantity will be provided later.

Furthermore, sulfur is used as the vulcanizing agent 23. Specifically, 200 mesh manufactured by Tsurumi Chemical Industry Co., Ltd. is used.

Furthermore, Nocceler M manufactured by Ouchi Shinko Chemical Industrial Co., Ltd. is used as the vulcanization accelerator 24.

The mixture 29 containing the above components is wrapped around the shaft 6.

The shaft 6 having the mixture 29 wrapped therearound is increased in temperature to 160° C. and is vulcanized and foamed for a predetermined time period, whereby a roller equipped with a base layer is obtained.

Referring to FIGS. 6A to 6C, in the experimental example, a specific configuration of the resin liquid 43 is as follows.

Butyl acetate is used as the solvent 36.

A tetrafluoroethylene-vinyl monomer copolymer is used as the curable resin 33. Specifically, 100 parts of Zeffle GK-510 manufactured by Daikin Industries, Ltd. are used.

Carbon black is used as the electrical-conductivity additive 32. Specifically, Special Black 4A manufactured by Degussa Corporation is used. The blending quantity of carbon black is adjusted in accordance with the conditions of the second-transfer roller to be formed. A description regarding the blending quantity will be provided later.

Geanus PY manufactured by Geanus Co., Ltd. is used as the jet-mill distribution device 38.

With regard to the distribution process by the jet-mill distribution device 38, a collision step is performed five times under a pressure of 200 N/mm$^2$.

As the mesh 39, 20-μm mesh is used.

Takenate D-140N manufactured by Mitsui Chemicals, Inc. is used as the curing agent 34. Specifically, 20 parts of Takenate D-140N relative to 100 parts of Zeffle GK-510 in the base-layer resin liquid 43 are used.

Referring to FIGS. 6A to 6C, the outer surface 8*a* of the base layer 8 around the shaft 6 is coated with a layer of the resin liquid 43 and is baked by being heated at 140° C. for 20 minutes, whereby the second-transfer roller T2*b* is formed.

Transfer-Member Measurement Method According to Experimental Example

Referring to FIG. 7A, the length λ3 of each of the metallic plates 61 and 62 in the front-rear direction is set to 330 mm. The length λ4 of each of the metallic plates 61 and 62 in the thickness direction is set to 2 mm. The metallic plates 61 and 62 are pressed against the outer surface 9*a* of the roller layer 7 such that they are engaged therewith by 0.2 mm.

The peripheral length λ5 between the right surface 61*b* of the first metallic plate 61 and the left surface 62*b* of the second metallic plate 62 is set to 2 mm.

Referring to FIG. 7B, the voltage V0 to be applied by the direct-current voltage source 64 is set to 1000 V.

Furthermore, the time T1 is set to 10 seconds.

Based on this configuration, the time constant τs in the surface direction is measured.

Referring to FIG. 8A, for measuring the time constant τv in the volume direction, the voltage application is stopped from the state where 1000 V is applied by the direct-current voltage source 64.

Based on this configuration, the time constant τv in the volume direction is measured.

In the experimental example, the volume resistance value Rv [Ω] of the second-transfer roller T2*b* is measured using the following measurement method.

Specifically, the shaft 6 is pressed with a load of 6 kg·f toward a ground-connected metal plate so that the outer surface 9*a* of the second-transfer roller T2*b* is pressed thereon. A metallic rod is brought into contact with the outer surface 9*a* of the second-transfer roller T2*b* in a state where the metallic rod is engaged therewith by 0.2 mm. Then, a voltage of 1000 V is applied to the metallic rod, and the shaft 6 is connected to ground. An electric current I [A] flowing through the shaft 6 is measured. Subsequently, the volume resistance value Rv is calculated and measured based on Rv [Ω]=1000 [V]/I[A].

In the experimental example, the surface resistance value Rs [Ω] of the second-transfer roller T2*b* is measured using the following measurement method.

Specifically, the shaft 6 of the second-transfer roller T2*b* is connected to ground, and two metallic rods are disposed on the surface of the second-transfer roller T2*b*. The two metallic rods each have a diameter of 12 mm and a length of 330 mm. The two metallic rods are disposed away from each other by 10 mm in the circumferential direction of the second-transfer roller T2*b* and are brought into contact therewith in a state where they are engaged therewith by 0.2 mm. Then, a voltage of 1000 V is applied to one of the two metallic rods while the other metallic rod is connected to ground. An electric current I [A] flowing through the other metallic rod is measured. Subsequently, the surface resistance value Rs is calculated and measured based on Rs [Ω]=1000 [V]/I [A].

Experimental Example 1-1

In an experimental example 1-1, the hardness H of the second-transfer roller T2*b* is set to an Asker C hardness of 25 degrees. Furthermore, the relationship $(1/H)\times 0.5<\tau s$ and the relationship $\tau s<\tau v$ are satisfied by adjusting τs, τv, Rs, and Rv of the second-transfer roller T2*b*.

Then, in the experimental example 1-1, an evaluation experiment is performed by using the second-transfer roller T2*b*. In the evaluation method according to the experimental example 1-1, various kinds of measurement and evaluation processes are performed after successively feeding 50,000 sheets of J paper, which is size-A3 evaluation paper, at a processing speed of 528 mm/s. Thus, the rotation speed v of the second-transfer roller T2*b* corresponds to 528 mm/s. In this case, with regard to the non-passing section of the intermediate transfer belt B, the surface resistivity of a surface facing the second-transfer roller T2*b* is measured. Then, it is confirmed whether an amount of change in surface resistivity from an initial state where there is no problem in image quality is smaller than or equal to 0.20 log Ω/sq. Furthermore, for checking for a transfer defect caused by a current loss related to the lower limit of the time constant τs, a blue solid image is printed on the entire face of a postcard having high sensitivity, and transferability thereon is checked. In the experimental example 1-1, three parts of carbon black are blended in the base layer 8, and three parts of carbon black are blended in the surface layer 9.

Experimental Example 1-2

In an experimental example 1-2, the hardness H of the second-transfer roller T2*b* is set to an Asker C hardness of 75 degrees. Furthermore, the relationship τs<τv is satisfied by adjusting τs, τv, Rs, and Rv of the second-transfer roller T2*b*. However, in the experimental example 1-2, the relationship (1/H)×0.5<τs is not satisfied. In the experimental example 1-2, six parts of carbon black are blended in the base layer 8, and eight parts of carbon black are blended in the surface layer 9. Other conditions and the evaluation method are the same as those in the experimental example 1-1.

Experimental Example 1-3

In an experimental example 1-3, the hardness H of the second-transfer roller T2*b* is set to an Asker C hardness of 75 degrees. Furthermore, the relationship (1/H)×0.5<τs and the relationship τs<τv are satisfied by adjusting τs, τv, Rs, and Rv of the second-transfer roller T2*b*. In the experimental example 1-3, four parts of carbon black are blended in the base layer 8, and five parts of carbon black are blended in the surface layer 9. Other conditions and the evaluation method are the same as those in the experimental example 1-1.

Comparative Example 1

In a comparative example 1, a second-transfer roller having a configuration normally used in the related art is used. In the second-transfer roller T2*b* according to the comparative example 1, the hardness H is set to an Asker C hardness of 25 degrees. Furthermore, in the second-transfer roller according to the comparative example 1, the relationship (1/H)×0.5<τs is satisfied. However, the relationship τs<τv is not satisfied. In the comparative example 1, five parts of carbon black are blended in the base layer 8, and three parts of carbon black are blended in the surface layer 9. Other conditions and the evaluation method are the same as those in the experimental example 1-1.

Comparative Example 2

In a comparative example 2, the hardness H of the second-transfer roller T2*b* is set to an Asker C hardness of 75 degrees. Furthermore, in the comparative example 2, Rs and Rv of the second-transfer roller T2*b* are the same as Rs and Rv used in the experimental example 1-1. However, τs and τv of the second-transfer roller T2*b* according to the comparative example 2 do not satisfy the relationship τs<τv. Moreover, τs and τv in the comparative example 2 satisfy the relationship (1/H)×0.5<τs. In the second-transfer roller T2*b* according to the comparative example 2, four parts of carbon black are blended in the base layer 8, and four parts of carbon black are blended in the surface layer 9. Other conditions and the evaluation method are the same as those in the experimental example 1-1.

Experimental Results of Experimental Examples 1-1 to 1-3 and Comparative Examples 1 and 2

FIG. 18 illustrates conditions and experimental results of the experimental example 1-1, the experimental example 1-2, the experimental example 1-3, the comparative example 1, and the comparative example 2.

Referring to FIG. 18, in the experimental examples 1-1 to 1-3 that satisfy the relationship τs<τv, it is confirmed that the surface resistivity of the intermediate transfer belt B has not decreased. On the other hand, in the comparative examples 1 and 2 that do not satisfy the relationship τs<τv, it is confirmed that the surface resistivity of the intermediate transfer belt B has decreased. Thus, it is confirmed that a decrease in resistance in the non-passing section of the intermediate transfer belt B may be suppressed and that a change in density in the non-passing section may be suppressed regardless of the hardness H of the transfer roller so long as the transfer roller satisfies the relationship τs<τv, that is, expression (11). In other words, it is confirmed that concentration of electric discharge may be suppressed by satisfying expression (11).

The resistance values Rv and Rs are the same between the experimental example 1-1 and the comparative example 2. However, a decrease in resistance of the intermediate transfer belt B is not confirmable in the experimental example 1-1. In contrast, a decrease in resistance of the intermediate transfer belt B has occurred in the comparative example 2. Thus, it is confirmed that it is conceivably difficult to determine whether or not concentration of electric discharge is alleviated based only on the resistance values Rv and Rs of the second-transfer roller T2*b*. In other words, in the first to third exemplary embodiments in which definition is made based on the relationship between the time constants τs and τv, it is possible to accurately evaluate whether or not concentration of electric discharge may be alleviated, unlike the related art in which a value related to a resistance value, such as resistivity, is used.

Furthermore, in the experimental examples 1-1 and 1-3 that satisfy the relationship (1/H)×0.5<τs when τs<τv, it is confirmed that a transfer defect on a postcard does not occur. On the other hand, in the experimental example 1-2 that does not satisfy the relationship (1/H)×0.5<τs when τs<τv or the comparative example 1 in which τs>τv, it is confirmed that a transfer defect on a postcard does occur. Thus, it is confirmed that, by satisfying the relationship (1/H)×0.5<τs, that is, the relationship expressed by expression (21), a decrease in resistance in the non-passing section of the intermediate transfer belt B may be suppressed and a change in density in the non-passing section may be suppressed while ensuring satisfactory transferability onto small-size thick paper.

Experimental Example 2-1

In an experimental example 2-1, the values of H, τs, τv, Rs, and Rv are the same as those of the second-transfer roller T2*b* according to the experimental example 1-1. Thus, the relationship expressed by expression (11) is satisfied. In the experimental example 2-1, the hardness H is 25 degrees, and the nip width is 5.0 mm in accordance with expression (22').

In the experimental example 2-1, an evaluation experiment is performed by using the second-transfer roller T2*b* having the above-described configuration. In the evaluation method according to the experimental example 2-1, the evaluation experiment is performed similarly to the experimental example 1-1 except that transferability onto small-size thick paper is evaluated in view of the effect of the processing speed, that is, the effect of the transfer-electric-field rising period. In the experimental example 2-1, the processing speed v is 528 mm/s, and the relationship $(L/v)\times(Rv/Rs)<\tau s$ is satisfied.

Experimental Example 2-2

In an experimental example 2-2, the values of H, τs, τv, Rs, and Rv are the same as those of the second-transfer roller T2*b* according to the experimental example 1-2. Thus, the relationship expressed by expression (11) is satisfied. In the experimental example 2-2, the hardness H is 75 degrees, and the nip width is 1.7 mm. Other conditions and the evaluation method are the same as those in the experimental example 2-1. In the experimental example 2-2, the processing speed v is 528 mm/s, and the relationship $(L/v)\times(Rv/Rs)<\tau s$ is not satisfied.

Experimental Example 2-3

In an experimental example 2-3, the values of H, τs, τv, Rs, and Rv are the same as those of the second-transfer roller T2*b* according to the experimental example 1-3. Thus, the relationship expressed by expression (11) is satisfied. In the experimental example 2-3, the hardness H is 75 degrees, and the nip width is 1.7 mm. Other conditions and the evaluation method are the same as those in the experimental example 2-1. In the experimental example 2-3, the processing speed v is 528 mm/s, and the relationship $(L/v)\times(Rv/Rs)<\tau s$ is satisfied.

Experimental Example 2-4

In an experimental example 2-4, the relationship $(L/v)\times(Rv/Rs)<\tau s<\tau v$ is satisfied under the pressing speed v of 264 mm/s by adjusting τs, τv, Rs, and Rv of the second-transfer roller T2*b*. Other conditions and the evaluation method are the same as those in the experimental example 2-3.

Experimental Example 2-5

In an experimental example 2-5, the values of H, τs, τv, Rs, and Rv are the same as those of the second-transfer roller T2*b* according to the experimental example 2-3. Thus, the relationship expressed by expression (11) is satisfied. However, in the experimental example 2-5, the width L of the nip region is set to 1.3 mm by weakening the transfer load. Furthermore, in the experimental example 2-5, the processing speed v is 264 mm/s. Specifically, in the experimental example 2-5, of L, v, Rv, Rs, and τs in the experimental example 2-3 related to $(L/v)\times(Rv/Rs)$ and τs, the relationship $(L/v)\times(Rv/Rs)<\tau s$ is satisfied by changing L and v. Other conditions and the evaluation method are the same as those in the experimental example 2-3.

Experimental Results of Experimental Examples 2-1 to 2-5

FIG. 19 illustrates conditions and experimental results of the experimental example 2-1, the experimental example 2-2, the experimental example 2-3, the experimental example 2-4, and the experimental example 2-5.

Referring to FIG. 19, in the experimental examples 2-1 to 2-5, the relationship expressed by expression (11) is satisfied. In the experimental examples 2-1 to 2-5, it is confirmed that the surface resistivity of the intermediate transfer belt B is less likely to decrease. Thus, it is reconfirmed that concentration of electric discharge may be suppressed by satisfying expression (11).

Furthermore, in the experimental examples 2-1, 2-3, 2-4, and 2-5 that satisfy the relationship $(L/v)\times(Rv/Rs)<\tau s<\tau v$, it is confirmed that a transfer defect on a postcard does not occur. On the other hand, in the experimental example 2-2 that does not satisfy the relationship $(L/v)\times(Rv/Rs)<\tau s$, it is confirmed that a transfer defect on a postcard does occur. Thus, it is confirmed that, by satisfying the relationship $(L/v)\times(Rv/Rs)<\tau s<\tau v$, that is, the relationship expressed by expression (12), a decrease in resistance in the non-passing section of the intermediate transfer belt B may be suppressed and a change in density in the non-passing section may be suppressed while ensuring satisfactory transferability onto small-size thick paper.

Fourth Exemplary Embodiment

Next, a fourth exemplary embodiment of the present invention will be described. In the description of the fourth exemplary embodiment, components that correspond to those in the first to third exemplary embodiments are given the same reference characters, and detailed descriptions thereof will be omitted.

The fourth exemplary embodiment differs from the first exemplary embodiment in the following points but is similar to the first exemplary embodiment in other points.

Figure 20:
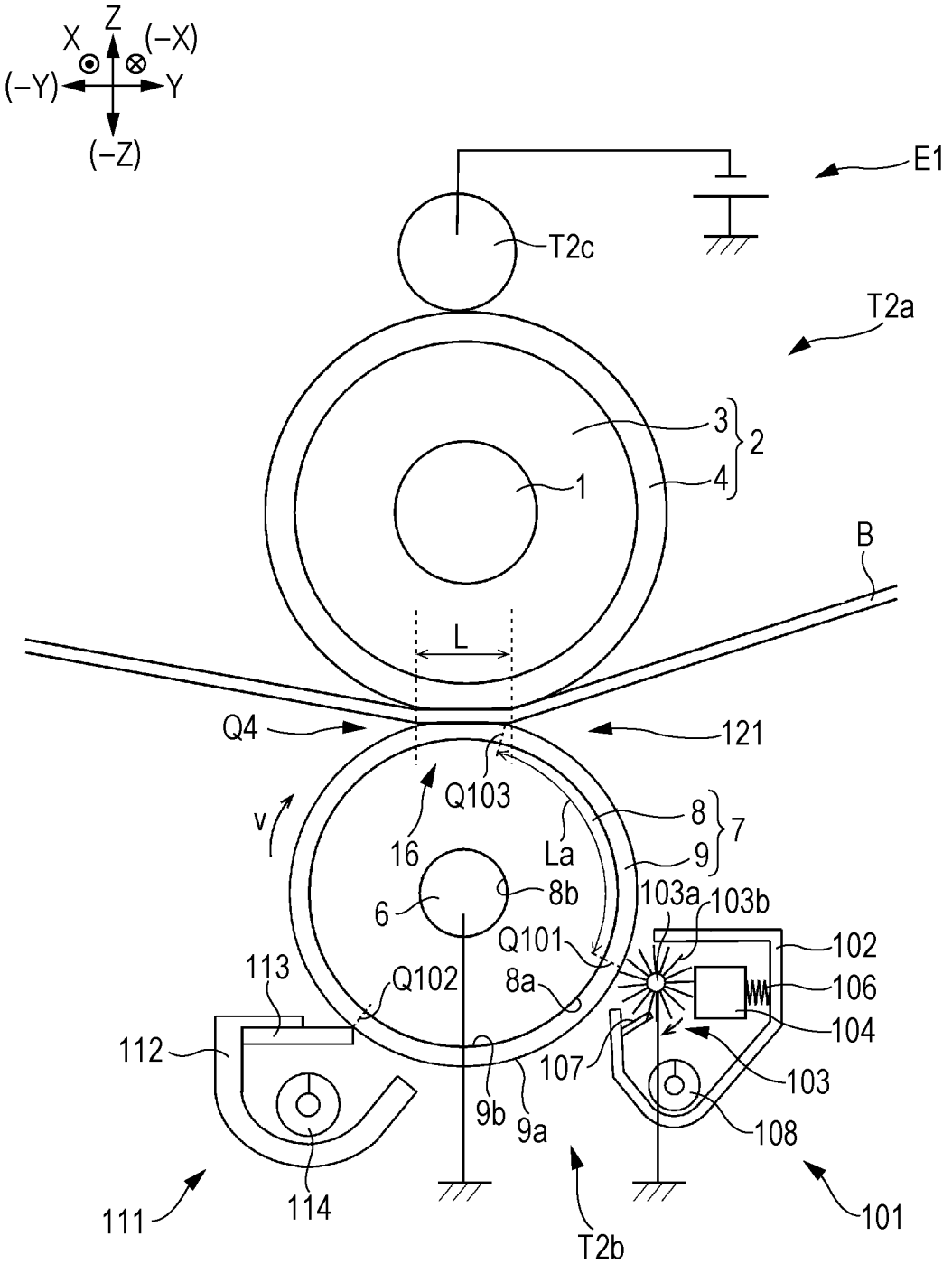
FIG. 20 illustrates a relevant part of a transfer device according to a fourth exemplary embodiment of the present invention.

FIG. 20 illustrates a relevant part of a transfer device according to the fourth exemplary embodiment of the present invention.

Referring to FIG. 20, the second-transfer unit T2 as an example of a transfer device according to the fourth exemplary embodiment has a second-transfer roller T2*b* similar to that in the first exemplary embodiment. Specifically, with regard to the second-transfer roller T2*b* according to the fourth exemplary embodiment, the time constant τs in the surface direction and the time constant τv in the volume direction are set such that $\tau s<\tau v$. Furthermore, in the fourth exemplary embodiment, the outer surface 9*a* of the second-transfer roller T2*b* is formed to have a predetermined surface roughness Rz. The surface roughness Rz, that is, a ten-point medium height Rz, is desirably 2.0 μm or smaller. The contact roller T2*c* is connected to a power source E1. The power source E1 according to the fourth exemplary embodiment only applies voltage with a polarity for transferring a visible image on the intermediate transfer belt B onto a recording sheet S. Specifically, the power source E1 according to the fourth exemplary embodiment only applies voltage with the same polarity as the charge polarity of toner Tn as an example of a developer to the backup roller T2*a* via the contact roller T2*c*. The shaft 6 of the second-transfer roller T2*b* is electrically connected to ground.

A brush device 101 as an example of a first cleaning device is disposed downstream of the second-transfer region Q4 in the rotational direction of the second-transfer roller T2*b*. The brush device 101 has a cleaning container 102. The cleaning container 102 rotatably supports an electrostatic brush 103 as an example of a first electrically-conductive cleaning member. The electrostatic brush 103 has a shaft 103*a* as an example of a rotation shaft. The shaft 103*a* is composed of a metallic material as an example of an electrically-conductive material. The shaft 103*a* is electrically connected to ground. The outer peripheral surface of the shaft 103*a* has multiple electrically-conductive bristles implanted therein at a predetermined density. Specifically, the shaft 103*a* supports a brush portion 103*b* as an example of a brush portion having multiple electrically-conductive bristles extending radially therefrom. The brush portion 103*b* comes into contact with the surface of the second-transfer roller T2*b* at a cleaning position Q101 as an example of a position where the brush portion 103*b* comes into contact with the second-transfer roller T2*b*. The shaft 103*a* receives a driving force from a driving source (not shown). Thus, at the cleaning position Q101, the electrostatic brush 103 rotates at a predetermined speed in a direction opposite to the rotational direction of the second-transfer roller T2*b*.

In the brush device 101, a lubricant 104 is disposed downstream of the cleaning position Q101 in the rotational direction of the electrostatic brush 103. The lubricant 104 is supported by a bias member 106. The bias member 106 biases the lubricant 104 with a predetermined bias force such that the lubricant 104 comes into contact with the brush portion 103*b* of the electrostatic brush 103. Thus, the lubricant 104 is supplied to the surface of the second-transfer roller T2*b* via the electrostatic brush 103. The lubricant 104 may be composed of a solid material, such as zinc stearate (ZnSt). The lubricant 104 and the bias member 106 constitute a lubricant supplying section 104+106 according to the fourth exemplary embodiment. A flicker 107 as an example of an adjusting member is disposed downstream of the lubricant 104 in the rotational direction of the electrostatic brush 103. The flicker 107 is disposed in contact with the brush portion 103*b*. A discharge transport member 108 is disposed below the electrostatic brush 103. The developer collected by the electrostatic brush 103 from the second-transfer roller T2*b* is transported toward a collecting container (not shown) by the discharge transport member 108.

In FIG. 20, a blade device 111 as an example of a second cleaning device is disposed downstream of the cleaning position Q101 in the rotational direction of the second-transfer roller T2*b*. The blade device 111 has a cleaning container 112. The cleaning container 112 supports a plate-shaped cleaning blade 113 as an example of a second cleaning member. The cleaning blade 113 comes into contact with the surface of the second-transfer roller T2*b* at a second cleaning position Q102 as an example of a second contact position. The cleaning blade 113 is in contact with the surface of the second-transfer roller T2*b* with a predetermined pressure. A discharge transport member 114 is disposed below the cleaning blade 113. The developer removed from the second-transfer roller T2*b* by the cleaning blade 113 is transported toward a collecting container (not shown) by the discharge transport member 114.

In the fourth exemplary embodiment, when the distance from a nip exit Q103, as an example of a downstream end of the nip region in the rotational direction of the second-transfer roller T2*b*, to the cleaning position Q101 is defined as La [mm], La is set such that expression (41) shown below is satisfied:

$$La \leq \{(\tau w/\tau s)/1.25\} \times 12\pi \quad (41)$$

In the fourth exemplary embodiment, when the nip region 16 is formed by the backup roller T2*a* and the second-transfer roller T2*b*, a position where the backup roller T2*a* and the second-transfer roller T2*b* are less likely to receive pressure from each other is set as the downstream end of the nip region 16, that is, the nip exit Q103. Specifically, when a recording sheet S moves through the nip region 16 in the transport direction thereof, a position where a gap 121 forms between the outer surface 9*a* of the second-transfer roller T2*b* and the outer surface of the backup roller T2*a* is defined as the nip exit Q103.

Operation of Fourth Exemplary Embodiment

In the printer U according to the fourth exemplary embodiment having the above-described configuration, when an image is to be recorded onto a recording sheet S, the second-transfer unit T2 receives a second-transfer voltage from the power source E1. Thus, a transfer electric field in accordance with the second-transfer voltage is generated between the intermediate transfer belt B and the second-transfer roller T2*b*. Therefore, the transfer electric field acts on a visible image on the intermediate transfer belt B so that the visible image becomes transferred from the intermediate transfer belt B onto the recording sheet S. In the second-transfer roller T2*b* according to the fourth exemplary embodiment, expression (11) and expression (12) are satisfied. Therefore, the fourth exemplary embodiment is similar to the first exemplary embodiment in that concentration of electric discharge may be alleviated, and transferability onto thick paper may be ensured.

The intermediate transfer belt B sometimes bears a developer Tn, which constitutes a visible image, in the non-passing section of the intermediate transfer belt B, through which a recording sheet S does not pass, or in an area between a recording sheet S and a recording sheet S, that is, an inter-image area. In this case, when the transfer electric field acts on the intermediate transfer belt B, the developer becomes transferred onto the second-transfer roller T2*b* instead of a recording sheet S. Thus, the developer adheres to the outer surface of the second-transfer roller T2*b*, thus contaminating or staining the outer surface of the second-transfer roller T2*b*. Therefore, for example, when transferring a visible image onto a subsequent recording sheet S, the face of the recording sheet S facing toward the second-transfer roller T2*b*, that is, the reverse face of the sheet S, may become contaminated or stained by coming into contact with the second-transfer roller having the developer adhered thereon. Furthermore, when the developer or a paper particle adheres to the second-transfer roller T2*b*, the resistance of the second-transfer roller T2*b* increases. Thus, a predetermined transfer electric field is not formed, possibly leading to a transfer defect and deterioration in image quality.

In the fourth exemplary embodiment, the brush device 101 and the blade device 111 are disposed so that the surface of the second-transfer roller T2*b* is cleaned.

In the brush device 101, the electrostatic brush 103 rotates so as to clean the second-transfer roller T2*b*. Specifically, when the outer surface of the second-transfer roller T2*b* passes through the cleaning position Q101, the brush portion 103*b* removes extraneous matter, such as a developer, from the second-transfer roller T2*b* and collects such extraneous matter, such as a developer, by adsorption using an electrostatic force generated between the second-transfer roller T2*b* and the electrostatic brush 103. When the electrostatic brush 103 rotationally moves from the cleaning position Q101, the lubricant 104 is supplied from the supplying section 104+106. Then, the electrostatic brush 103 supplied with the lubricant 104 comes into contact with the flicker 107. Thus, a lubricant excessively supplied to the brush portion 103*b*, a developer remaining in the brush portion 103*b*, and so on are removed therefrom. Then, when the brush portion 103*b* returns to the cleaning position Q101, the brush portion 103*b* supplies the lubricant 104 to the second-transfer roller T2*b* and cleans the surface of the second-transfer roller T2*b*.

Furthermore, in the blade device 111, the cleaning blade 113 is in contact with the surface of the second-transfer roller T2*b* with a predetermined contact pressure. Thus, extraneous matter, such as a developer, is scraped off from the surface of the rotating second-transfer roller T2*b*. The outer surface of the second-transfer roller T2*b* is supplied with the lubricant 104 at the cleaning position Q101. Therefore, the lubricant 104 is supplied from the first cleaning position Q101 to the second cleaning position Q102, whereby excessive friction is reduced between the cleaning blade 113 and the second-transfer roller T2*b*. Thus, friction of the cleaning blade 113 is reduced.

Consequently, in the fourth exemplary embodiment, contamination of the reverse face of a recording sheet S caused by extraneous matter, such as a developer, adhered on the second-transfer roller T2*b* may be reduced. Moreover, deterioration in image quality caused by a change in resistance value of the second-transfer roller T2*b* due to the developer may be reduced.

Figure 21B:
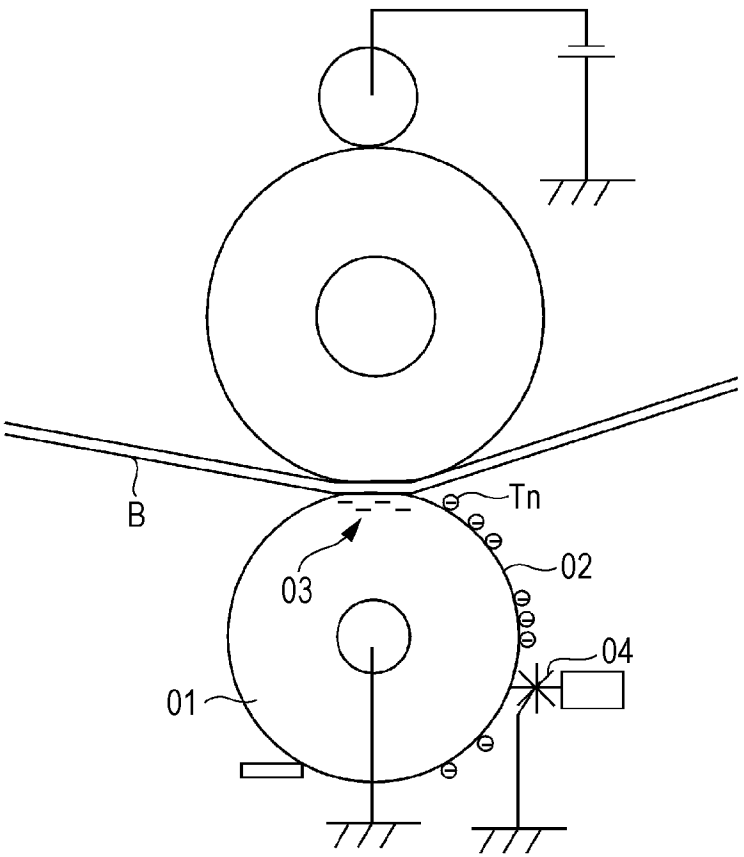
FIGS. 21A and 21B illustrate a comparison between the fourth exemplary embodiment of the present invention and the related art, FIG. 21A illustrating the operation of a second-transfer roller according to the fourth exemplary embodiment, FIG. 21B illustrating a second-transfer roller according to the related art.
Figure 21A:
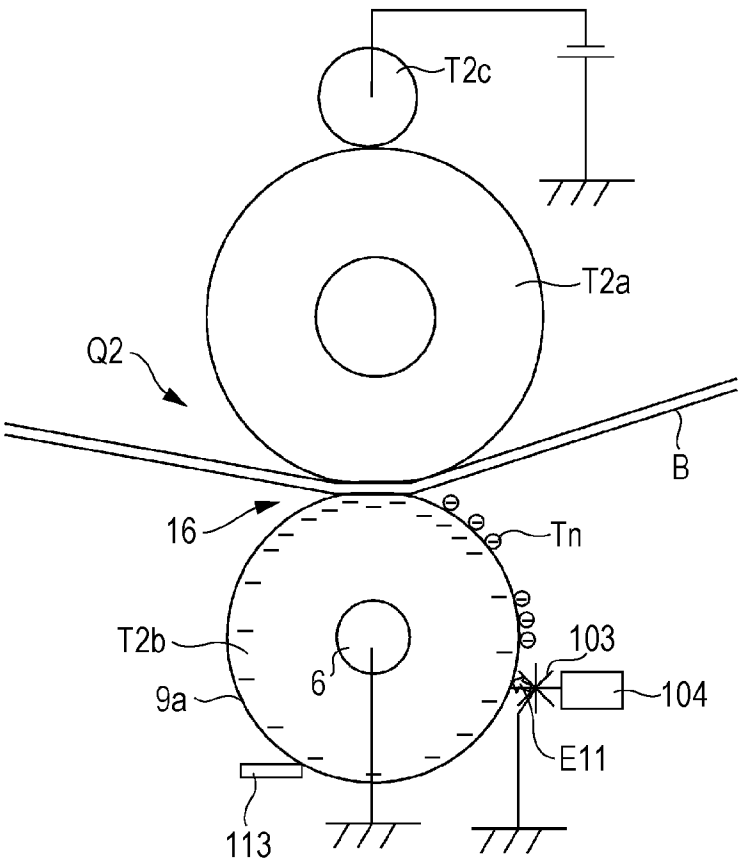

FIGS. 21A and 21B illustrate a comparison between the fourth exemplary embodiment of the present invention and the related art. Specifically, FIG. 21A illustrates the operation of the second-transfer roller according to the fourth exemplary embodiment, and FIG. 21B illustrates a second-transfer roller according to the related art.

Referring to FIG. 21B, in a transfer roller 01 according to the related art in which $\tau s > \tau v$, electric current is less likely to flow along an outer surface 02 of the transfer roller 01. Specifically, in the transfer roller 01 according to the related art, even when a transfer electric field is effective, an electric potential in accordance with the transfer electric field tends to occur only within a nip region 03, whereas the electric potential is less likely to change outside the nip region 03. Thus, assuming that an electrostatic brush 04 similar to the electrostatic brush 103 according to the fourth exemplary embodiment is electrically connected to ground, a potential difference between the outer surface 02 of the transfer roller 01 and the electrostatic brush 04 is small. Therefore, an electric field that causes the developer Tn to move from the second-transfer roller T2*b* to the electrostatic brush 103 is less likely to be generated. Consequently, when using the transfer roller 01 according to the related art, it is difficult to collect the developer Tn by simply electrically connecting the electrostatic brush to ground. Thus, in the configuration in which the electrostatic brush 04 is disposed relative to the second-transfer roller 01 according to the related art, a power source that generates a cleaning electric field, which causes the developer to be adsorbed to the electrostatic brush, may be necessary.

In contrast, in the second-transfer roller T2*b* according to the fourth exemplary embodiment, the time constant $\tau s$ in the surface direction and the time constant $\tau v$ in the volume direction satisfy the relationship expressed by expression (11). Specifically, the relationship $\tau s < \tau v$ is satisfied. Thus, in the second-transfer roller T2*b* according to the fourth exemplary embodiment, electric current flows readily along the outer surface 9*a* of the second-transfer roller T2*b*. In other words, when electric current flows between the nip region 16 and the shaft 6, the electric current flows readily even in a bypassing state. Specifically, referring to FIG. 21A, when a transfer electric field is effective, an area where an electric potential in accordance with the transfer electric field occurs spreads not only in the nip region 16 but also outside the nip region 16. In other words, spreading of the electric potential is achieved. Thus, when the electrostatic brush 103 is electrically connected to ground, a potential difference occurs between the area where the electric potential has spread and the electrostatic brush 103, whereby an electric field E11 is generated.

The electric potential of the electrostatic brush 103 corresponds to the electric potential of the ground-connected shaft 6 of the second-transfer roller T2*b*. Thus, the electric field E11 corresponds to the polarity of electric field extending from the outer surface 9*a* of the second-transfer roller T2*b* toward the shaft 6. Specifically, the electric field E11 corresponds to the polarity of the transfer electric field. Thus, when the electric field E11 acts on the developer adhered on the second-transfer roller T2*b*, the developer tends to move from the outer surface of the second-transfer roller T2*b* toward the electrostatic brush 103. Therefore, the electric field E11 acts as a cleaning electric field. Consequently, in the fourth exemplary embodiment in which the second-transfer roller T2*b* that satisfies expression (11) is used, the developer may be electrostatically adsorbed readily by ground connection without having to provide a cleaning power source. Thus, in the fourth exemplary embodiment, the developer may be readily removed and cleaned off from the second-transfer roller T2*b* with a simple configuration, as compared with the configuration in the related art in which $\tau s > \tau v$.

In particular, in the fourth exemplary embodiment, an arrangement distance La of the electrostatic brush 103 satisfies expression (41). Expression (41) is an experimentally-determined expression that expresses the arrangement distance La that readily causes the cleaning electric field E11 to become larger. Therefore, in the fourth exemplary embodiment, the cleaning electric field E11 tends to become larger, as compared with a case where expression (41) is not satisfied, so that the developer may be removed readily from the second-transfer roller T2*b*. In other words, cleanability of the electrostatic brush 103 is improved.

Expression (41) will now be described. When the second-transfer roller T2*b* satisfies expression (11), an electric potential in accordance with the transfer electric field tends to occur also outside the nip region 16 in the second-transfer roller T2*b*. However, the magnitude of the electric potential decreases with increasing distance from the nip region 16, and an absolute value of the electric potential at the outer surface 9*a* of the second-transfer roller T2*b* becomes small. Thus, when the cleaning position Q101 is far away from the nip region 16, the potential difference between the electrostatic brush 103 and the second-transfer roller T2*b* tends to decrease. Therefore, the electric field E11 also tends to become small. Consequently, it may sometimes be difficult to improve cleanability of the electrostatic brush 103 depending on how the electric potential spreads from the nip region 16. Thus, a particularly desired condition for the position at which the electrostatic brush 103 is arranged, that is, the arrangement distance La, is defined.

Figure 22:
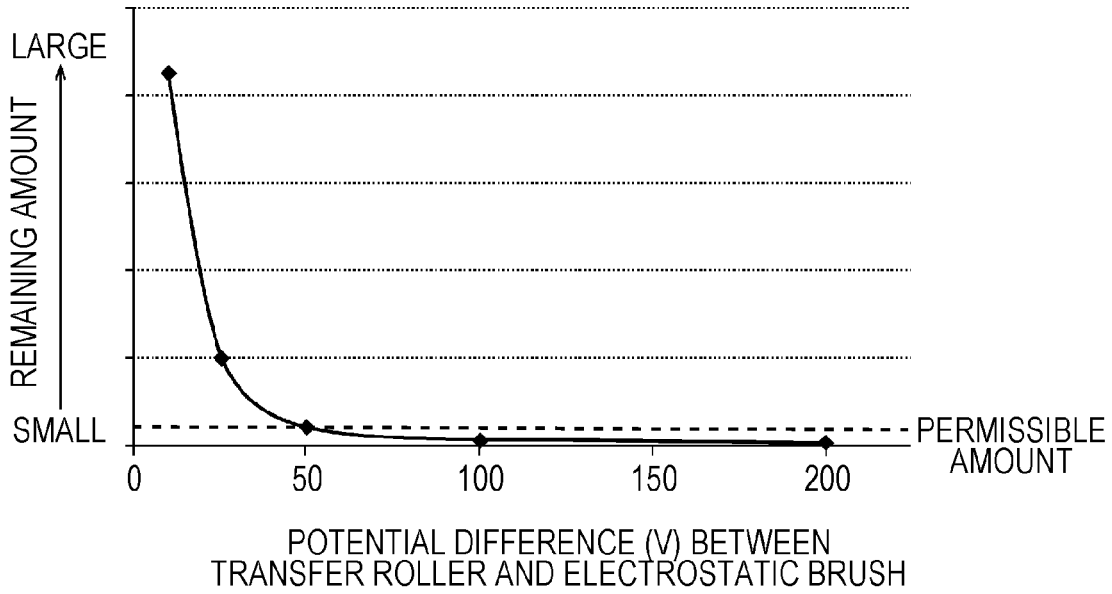
FIG. 22 illustrates the relationship between a potential difference between the transfer roller and an electrostatic brush and the remaining amount of developer.

FIG. 22 illustrates the relationship between a potential difference between the transfer roller and the electrostatic brush and the remaining amount of developer.

First, with regard to the potential difference between the electrostatic brush 103 and the second-transfer roller T2*b*, a particularly desired potential difference for cleaning will be discussed. A desired potential difference is experimentally determined. Specifically, a visible image of 4.5 g/m$^2$, that is, a toner patch equivalent to Cin 100%, is adhered onto the surface of the transfer roller. Then, the adhered toner patch is removed by the electrostatic brush 103. In this case, the relationship between the potential difference between the surface of the second-transfer roller T2*b* and the electrostatic brush 103 and the amount of developer remaining on the surface of the second-transfer roller T2*b* is checked. FIG. 22 illustrates obtained results. Referring to FIG. 22, it is confirmed that the remaining amount of developer decreases drastically as the potential difference increases from 0 V. However, a change in decrease in the remaining amount becomes smaller as the potential difference becomes larger than or equal to 25 V. Then, when the potential difference is larger than or equal to 50V, the change in decrease also becomes small in a state where the remaining amount is close to zero. Thus, when the potential difference is larger than or equal to 50V, it is confirmed that the remaining amount of developer is small and that cleanability of the electrostatic brush 103 is high. In this state, the electrostatic brush 103 according to the fourth exemplary embodiment is connected to ground. Thus, it is conceivable that the desired condition is that the absolute value of the electric potential on the second-transfer roller T2*b* at the cleaning position Q101 is higher than 50 V.

Furthermore, with regard to the magnitude of the electric potential occurring in the nip region 16 of the second-transfer roller T2*b*, a minimum value thereof is normally 100 V in an actual device. Thus, the magnitude of the electric potential in the nip region 16 may be considered to be higher than or equal to 100 V. In many cases, it is conceivable that the electric potential of the nip region 16 is higher than 100 V, and that the electric potential in the area outside the nip region 16 also increases.

When a voltage of 100 V is applied, a distance L50 from the voltage application position to a position at which the magnitude of the electric potential decreases to 50 V is measured. Specifically, with reference to the distance L50 when 100 V is applied, the arrangement distance La may be set to be shorter than the reference distance L50 so that particularly favorable cleanability of the electrostatic brush 103 may conceivably be obtained in normal use.

However, the spreading of electric potential varies depending on the time constants τs and τv of the second-transfer roller T2*b*. Specifically, flowability of electric current in the volume direction decreases with increasing τv of the second-transfer roller T2*b*. Furthermore, a change in electric potential in the surface direction becomes smaller with decreasing τs. Therefore, an electrical change in the surface direction becomes faster with increasing ratio τv/τs, thus making the electric potential spread readily in the surface direction. Consequently, it is conceivable that a desired arrangement position changes in accordance with the ratio τv/τs of the time constants of the second-transfer roller T2*b*.

An experiment for measuring the relationship between the ratio τv/τs and the distance L50 is performed.

Figure 23:
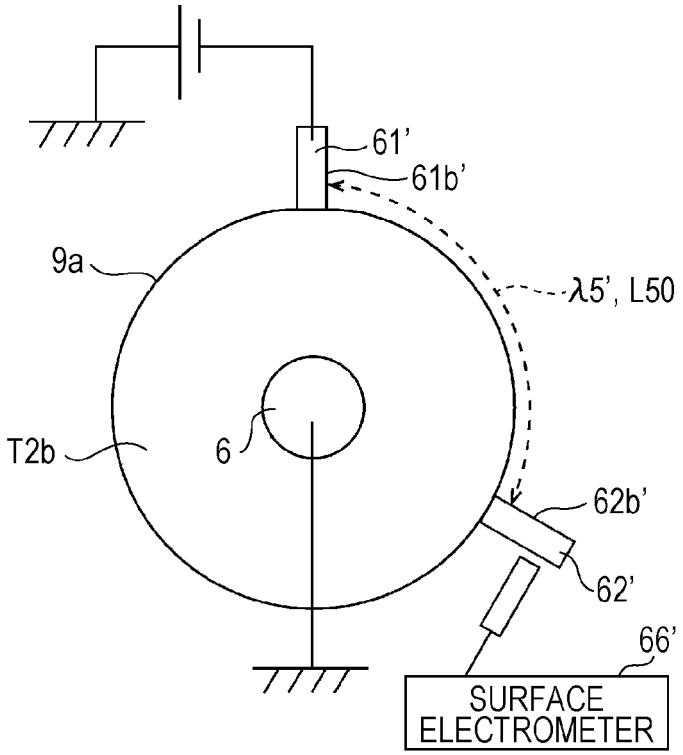
FIG. 23 illustrates a measurement method for measuring a change in electric potential of the transfer roller.

FIG. 23 illustrates a measurement method for measuring a change in electric potential of the transfer roller.

Referring to FIG. 23, in the experiment for measuring the relationship between the ratio τv/τs and the distance L50, a transfer roller in which τs and τv have been adjusted is used. In the experiment, metallic plates 61' and 62' similar to the metallic plates 61 and 62 used for measuring the time constants τs and τv are used for measuring the electric potential. Specifically, when the time constant τs in the surface direction and the time constant τv in the volume direction of the second-transfer roller T2*b* are displayed as (τs [ms], τv [ms]), the experiment is performed on three second-transfer rollers T2*b* with (3.6, 4.5), (67.6, 80), and (23.9, 26.7), respectively. The metallic plates 61' and 62' used each have a thickness of 2 mm. The metallic plates 61' and 62' are spaced apart from each other by λ5' and are disposed on the outer surface 9*a* of the transfer roller. In this case, the metallic plates 61' and 62' are pressed against the outer surface 9*a* of the roller layer 7 such that they are engaged therewith by 0.2 mm. Furthermore, a surface electrometer 66' is disposed facing the second metallic plate 62'. Then, a voltage of −100 is applied to the first metallic plate 61'. In this case, the peripheral length λ5' between the right surface 61*b'* of the first metallic plate 61' and the left surface 62*b'* of the second metallic plate 62', at which the surface potential of the second metallic plate 62' becomes −50 V, is measured as L50.

Figures 24A, 24B:
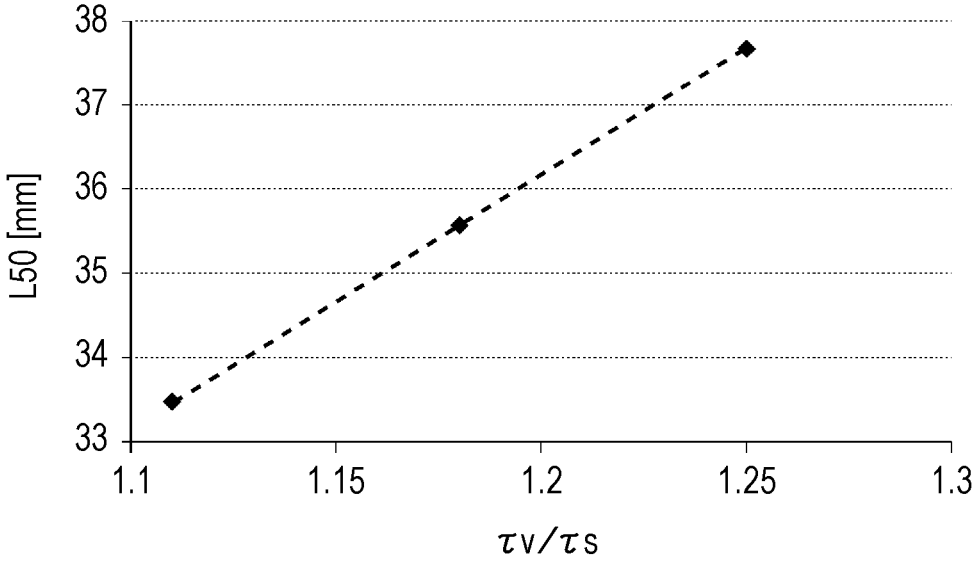
FIGS. 24A and 24B illustrate measurement results obtained in accordance with the fourth exemplary embodiment, FIG. 24A illustrating a time constant in the surface direction and a time constant in the volume direction, FIG. 24B illustrating the relationship between the ratio of the time constants and a reference distance.

FIGS. 24A and 24B illustrate the measurement results obtained in accordance with the fourth exemplary embodiment. Specifically, FIG. 24A illustrates a time constant in the surface direction and a time constant in the volume direction, and FIG. 24B illustrates the relationship between the ratio of the time constants and the reference distance.

The measurement results are shown in FIGS. 24A and 24B. When τv/τs=1.25, L50 is measured to be 37.7 mm. In this case, the half-perimeter of ϕ24 is 24π/2, and 24π/2≈37.7. Thus, the distance L50 is equivalent to the half-perimeter of ϕ24. Therefore, it is confirmed that an electric potential of 50 V occurs in the entire 180° rotation-angle range of the second-transfer roller T2*b* from the nip region. Consequently, when the second-transfer roller T2*b* has ϕ24, if the ratio τv/τs is 1.25 or larger, it is determined that desired cleanability may be ensured regardless of whether the electrostatic brush is disposed at any position on the outer surface of the second-transfer roller T2*b*.

Furthermore, referring to FIG. 24B, when the ratio τv/τs becomes smaller than 1.25, it is confirmed that the distance L50 also decreases in accordance with the value of the ratio τv/τs. In this case, it is confirmed that a linear relationship is established between the distance L50 and the time-constant ratio τv/τs. In other words, the distance L50 is obtained as expression (42) shown below:

$$L50=\{(\tau v/\tau s)/1.25\}\times 12\pi \quad (42)$$

Thus, in order to determine expression (41), La L50 may be satisfied. This relationship is a relational expression related to the perimeter. In this case, if the diameter of the transfer roller is different, the ratio τv/τs may also change, but the distance L50 is determined in accordance with the ratio τv/τs. Therefore, the distance L50 is obtained from the ratio τv/τs in accordance with the diameter of the transfer roller. Thus, this is also applicable to a case where the diameter of the transfer roller is different from ϕ24. Consequently, expression (41) is obtained as a condition for the arrangement distance La.

Accordingly, in the fourth exemplary embodiment that satisfies expression (41), cleanability of the electrostatic brush 103 may be improved, as compared with a case where expression (41) is not satisfied.

Furthermore, in the fourth exemplary embodiment, the cleaning blade 113 is also disposed relative to the second-transfer roller T2*b*. Specifically, in the fourth exemplary embodiment, the cleaning blade 113 and the electrostatic brush 103 are both used. Thus, even if the electrostatic brush 103 is not able to sufficiently clean the second-transfer roller T2*b* and the developer remains on the second-transfer roller T2*b*, the developer is cleaned off therefrom by the cleaning blade 113 disposed downstream. Normally, when a large amount of developer is transported to a cleaning blade, a portion of the developer moves downstream by sliding under the cleaning blade. In other words, a cleaning defect occurs. Therefore, when using a cleaning blade, it is desirable that the developer moving toward the blade be reduced beforehand. In contrast, in the fourth exemplary embodiment, the second-transfer roller T2*b* cleaned by the electrostatic brush 103 subsequently moves to the second cleaning position Q102. Thus, the amount of developer at the second cleaning position Q102 is reduced. Therefore, the developer removing capability of the cleaning blade 113 is less likely to deteriorate. Consequently, in the fourth exemplary embodiment, the developer removing capability of the cleaning blade 113 may be reliably improved, as compared with a case where a large amount of developer is transported to the cleaning blade 113. In other words, cleanability may be improved in the fourth exemplary embodiment.

In addition, in the fourth exemplary embodiment, the surface roughness Rz of the second-transfer roller T2*b* is set to be smaller than or equal to 2.0 μm. In a case where a plate-shaped cleaning member is used, it is desirable that the contact area between the edge of the plate, that is, the edge of the blade, and the surface of the transfer roller be increased. However, when the surface roughness Rz of the second-transfer roller T2*b* is larger than 2 μm, it is difficult to increase the contact area. In contrast, in the fourth exemplary embodiment, the surface roughness Rz is smaller than or equal to 2 μm, so that the contact area between the edge of the blade and the surface of the second-transfer roller T2*b* may be readily increased. Therefore, contactability between the cleaning blade 113 and the second-transfer roller T2*b* may be readily ensured. Consequently, the developer is less likely to pass under the blade, whereby cleanability of the cleaning blade may be improved.

In contrast, in the fourth exemplary embodiment, the electrostatic brush 103, which is electrically conductive, is connected to ground so that the cleaning electric field E11 is generated between the electrostatic brush 103 and the second-transfer roller T2*b*. In this electric field E11, transfer electric voltage is utilized so as to remove the developer from the second-transfer roller T2*b*. In addition, the cleaning blade 113 disposed downstream is also used for removing the developer from the second-transfer roller T2*b*. Thus, in the fourth exemplary embodiment, the developer may be readily removed from the second-transfer roller T2*b* without having to switch the polarities of the electric field. Consequently, in the fourth exemplary embodiment, cleanability with respect to the second-transfer roller T2*b* may be readily ensured with a simple configuration, as compared with a case where a transfer power source that switches polarities is provided.

Experimental Example 3-1

Next, experiments for checking the effects of the fourth exemplary embodiment are performed.

In the following description, descriptions regarding configurations similar to those in the experiments for checking the effects of the first to third exemplary embodiments will be omitted.

In an experimental example 3-1, an experiment for checking the effects of the fourth exemplary embodiment is performed by using the printer U.

With regard to the backup roller T2*a*, the shaft 1 has a diameter of 14 mm, the roller layer 2 has a thickness of 5 mm, the hardness H1 is an Asker C hardness of 60 degrees, and the volume resistance value is 6.5 log Ω at an applied voltage of 1 kV.

With regard to the second-transfer roller T2*b*, the shaft 6 has a diameter of 14 mm, and the roller layer 7 has a double-layer configuration in which the base layer 8 has a thickness of 5 mm and the surface layer 9 has a thickness of 20 μm. The time constant τs in the surface direction of the second-transfer roller T2*b* according to the experimental example 3-1 is set to 23.9 ms. The time constant τv in the volume direction is set to 26.7 ms. The time constants τs and τv are adjusted by independently controlling the blending of electrical-conductivity additives in the base layer 8 and the surface layer 9. Furthermore, in the second-transfer roller T2*b* according to the experimental example 3-1, the surface roughness Rz is set to 1 μm.

With regard to the electrostatic brush 103, the shaft 103*a* has a diameter of 5 mm, 2-denier nylon thread with a length of 2.5 mm is implanted with a density of 120 kF/inch$^2$ in the shaft 103*a*. The nylon thread has a thread resistance of 7.5 log Ω at an applied voltage of 1 kV. Furthermore, the electrostatic brush 103 is also used as a supplying member for applying the lubricant 104. The lubricant 104 used is composed of ZnSt. The shaft 103*a* is electrically connected to ground. The arrangement distance La of the electrostatic brush 103 according to the experimental example 3-1 is set to 30 mm. Since τs=23.9 and τv=26.7, $\{(\tau v/\tau s)/1.25\}\times 12\pi \approx 33.7$. Thus, La=30<33.7, so that the arrangement distance La satisfies expression (41).

The second-transfer load is set to 6.4 kgf.

The evaluation experiment is performed at an ambient temperature of 22° C. and a relative humidity of 55%.

In the evaluation method according to the experimental example 3-1, 50,000 sheets of size-A3 J paper are successively fed as evaluation paper while setting the rotation speed v of the second-transfer roller T2*b* at 528 mm/s. In this case, a 20×20 [mm$^2$] toner patch equivalent to Cin 100% (9.0 g/m$^2$) for each of YMCK colors and a 20×20 [mm$^2$] toner patch equivalent to Cin 200%(9.0 g/m$^2$) for each of RGB colors are formed in the inter-image area between recording sheets S. The voltage to be applied by the power source E1 is applied while performing control such that the transfer current becomes −110 μA (negative polarity) (constant current control). Then, with regard to the last one of successively-fed sheets of J paper, contamination on the reverse face thereof, which faces toward the second-transfer roller T2*b*, is evaluated.

Experimental Example 3-2

In an experimental example 3-2, the cleaning blade 113 is disposed downstream of the electrostatic brush 103. The cleaning blade 113 according to the experimental example 3-2 is composed of urethane rubber with an Asker C hardness of 78 degrees. The engagement pressure is set to 1.7 gf/mm. The pressing angle is set to 10°. The pressing angle is an angle formed between the electrostatic brush 103 and the surface of the second-transfer roller T2*b* in a state where the electrostatic brush 103 does not bend. Other conditions and the evaluation method are the same as those in the experimental example 3-1.

Experimental Example 3-3

In an experimental example 3-3, the surface roughness Rz of the second-transfer roller T2*b* is set to 3 μm. Other conditions and the evaluation method are the same as those in the experimental example 3-2.

Experimental Example 3-4

In an experimental example 3-4, the surface roughness Rz of the second-transfer roller T2*b* is set to 2 μm. Other conditions and the evaluation method are the same as those in the experimental example 3-2.

Experimental Example 3-5

In an experimental example 3-5, the arrangement distance La of the electrostatic brush 103 is set to 35 mm. Since τs=23.9 and τv=26.7, $\{(\tau v/\tau s)/1.25\}\times 12\pi \approx 33.7$. Thus, La=35>33.7, so that the arrangement distance La in the experimental example 3-5 does not satisfy expression (41). Other conditions and the evaluation method are the same as those in the experimental example 3-1.

Comparative Example 3-1

In a comparative example 3-1, the ground connection of the shaft 103*a* of the electrostatic brush 103 is released. Specifically, the shaft 103*a* is not connected to a power source and is not connected to ground. In other words, the shaft 103*a* is in a floating state. Other conditions and the evaluation method are the same as those in the experimental example 3-1.

Experimental Results of Experimental Examples 3-1 to 3-5 and Comparative Example 3-1

FIG. 25 illustrates conditions and experimental results of the experimental examples 3-1 to 3-5 and the comparative example 3-1.

Referring to FIG. 25, contamination on the reverse face of evaluation paper is evaluated based on visual observation or observation using a loupe having 25× magnification as an example of a magnifying glass. If contamination on the reverse face of evaluation paper is clearly confirmable based on visual observation, an "x" is given. If contamination on the reverse face of evaluation paper is confirmable based on visual observation but is minor, a triangle is given. If contamination on the reverse face of evaluation paper is not confirmable based on visual observation but if minor adhesion of toner on the reverse face of evaluation paper is confirmable based on observation using a loupe, a circle is given. If contamination on the reverse face of evaluation paper is not confirmable based on visual observation and adhesion of toner is not confirmable based on observation using a loupe, a double circle is given. In other words, an "x" indicates a non-permissible level, and contamination on the reverse face decreases in the following order: triangle, circle, double circle.

Referring to FIG. 25, in the experimental examples 3-1 to 3-5 in which the second-transfer roller T2*b* satisfying $\tau s<\tau v$ is used and in which the electrostatic brush 103 is electrically connected to ground, evaluation results indicating a triangle, circles, and double circles are obtained. In contrast, in the comparative example 3-1 in which the second-transfer roller T2*b* satisfying $\tau s<\tau v$ is used but in which the electrostatic brush 103 is in a floating state, an evaluation result indicating an "x" is obtained. Therefore, it is confirmed that, when the second-transfer roller T2*b* satisfies expression (11), the second-transfer roller T2*b* is cleaned by electrically connecting the electrostatic brush 103 to ground.

In particular, in each of the experimental examples 3-1 to 3-4 in which the electrostatic brush 103 is connected to ground and the arrangement distance La satisfies the relationship expressed by expression (41), the evaluation result of reverse-face contamination indicates a circle or a double circle. In contrast, in the experimental example 3-5 in which the electrostatic brush 103 is connected to ground and the arrangement distance La does not satisfy the relationship expressed by expression (41), the evaluation result of reverse-face contamination indicates a triangle. Therefore, it is confirmed that, even when the second-transfer roller T2*b* satisfies expression (11) and the electrostatic brush 103 is connected to ground, cleanability with respect to the second-transfer roller T2*b* may be more improved when the arrangement distance La satisfies the relationship expressed by expression (41).

With further reference to the experimental results, the electrostatic brush 103 is in a floating state in the Comparative Example 3-1. Thus, the potential difference is less likely to spread relative to the surface potential of the second-transfer roller T2*b*, as compared with a case where the electrostatic brush 103 is connected to ground. Therefore, in the comparative example 3-1, it is determined that the electric field E11 is less likely to occur. Furthermore, in the experimental example 3-5, the cleaning position Q101 is far away from the nip region 16 so that the electric potential at the cleaning position Q101 is low. Thus, in the experimental example 3-5, it is determined that, even when the electrostatic brush 103 is connected to ground, the potential difference between the electrostatic brush 103 and the second-transfer roller T2*b* is less likely to spread. In other words, although the experimental example 3-5 achieves an improved evaluation of evaluation paper relative to the comparative example 3-1, it is determined that the cleaning electric field E11 is small. In contrast, in the experimental examples 3-1 to 3-4, it is determined that a sufficient potential difference occurs between the second-transfer roller T2*b* and the electrostatic brush 103 so that a large cleaning electric field E11 is generated.

As compared with the experimental example 3-1, reverse-face contamination is suppressed in the experimental examples 3-2 and 3-4 in which the cleaning blade 113 is additionally used. Therefore, it is confirmed that cleanability may be further improved in the configuration in which the cleaning blade 113 and the electrostatic brush 103 are both used. However, although the cleaning blade 113 is additionally used in the experimental example 3-3, the evaluation result thereof is not improved as much as those in the experimental examples 3-2 and 3-4. It is determined that this is due to the surface roughness Rz of the second-transfer roller T2*b* being larger than 2.0 μm in the experimental example 3-3. Specifically, it is determined that, because the surface of the transfer roller is rough, contactability between the cleaning blade 113 and the second-transfer roller T2*b* is lost, resulting in reduced cleanability of the cleaning blade 113. Thus, it is confirmed that the surface roughness Rz of the second-transfer roller T2*b* is desirably 2.0 μm or smaller.

In the experimental examples 3-1 to 3-5, the voltage to be applied by the power source E1 is applied while performing control, including performing control on the inter-image area, such that the transfer current value becomes −110 μA (negative polarity) (constant current control). Specifically, when facing the inter-image area and also when facing an image area, the switching of polarities of voltage to be applied to the second-transfer roller T2*b* is not performed. Nonetheless, the evaluation results for reverse-face contamination indicate a triangle, circles, and double circles. In particular, in the experimental examples 3-1 to 3-4, the evaluation results for reverse-face contamination indicate circles and double circles. Consequently, it is confirmed that it may be unnecessary to switch polarities of applied voltage in this exemplary embodiment.

Fifth Exemplary Embodiment

Next, a fifth exemplary embodiment of the present invention will be described. In the description of the fifth exemplary embodiment, components that correspond to those in the first to fourth exemplary embodiments are given the same reference characters, and detailed descriptions thereof will be omitted.

The fifth exemplary embodiment differs from the first exemplary embodiment in the following points but is similar to the first exemplary embodiment in other points.

Figure 26A:
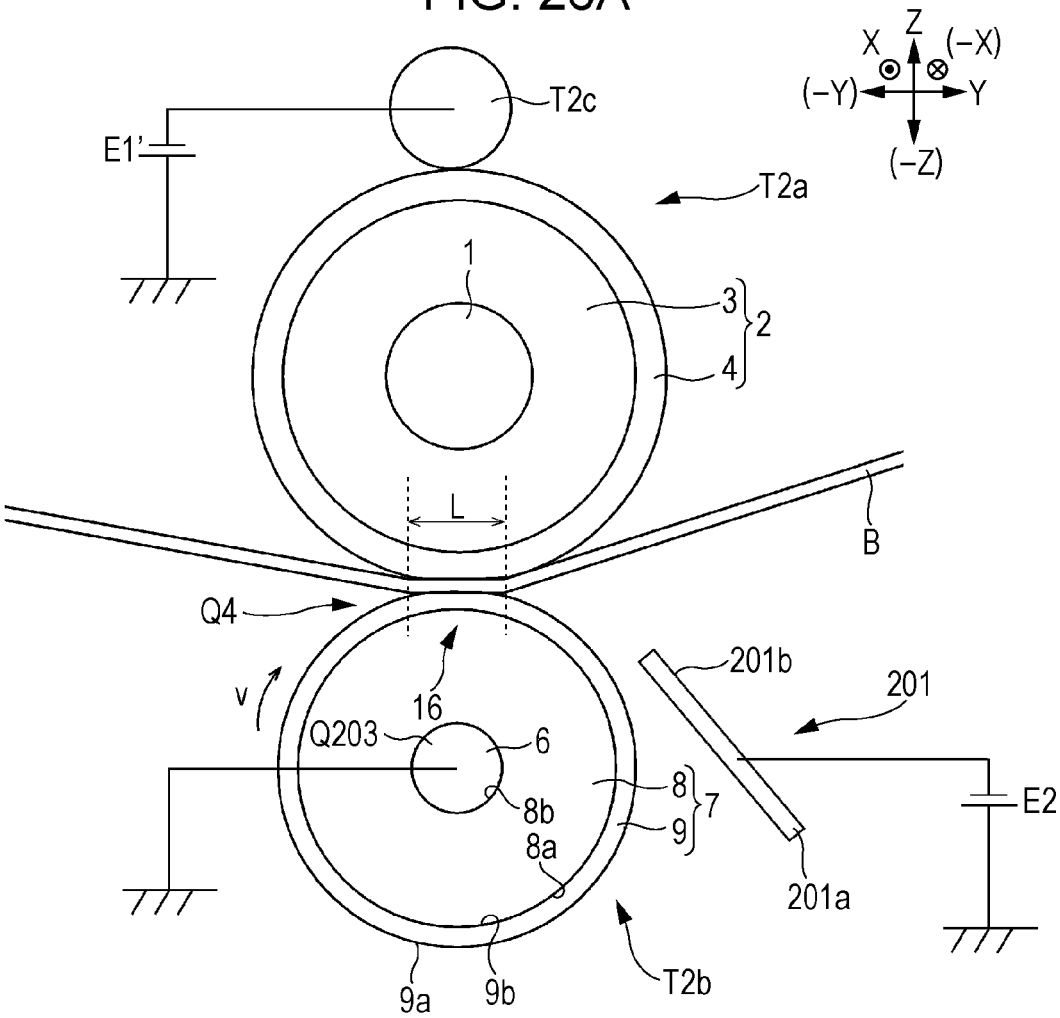
FIGS. 26A and 26B illustrate a relevant part of a transfer device according to a fifth exemplary embodiment of the present invention, FIG. 26A corresponding to FIG. 3, FIG. 26B illustrating a detach saw.
Figure 26B:
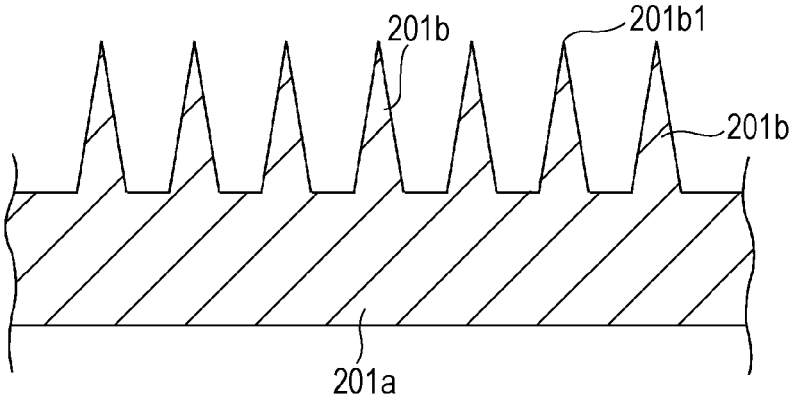

FIGS. 26A and 26B illustrate a relevant part of a transfer device according to the fifth exemplary embodiment of the present invention. Specifically, FIG. 26A corresponds to FIG. 3, and FIG. 26B illustrates a detach saw.

Referring to FIGS. 26A and 26B, the second-transfer unit T2 as an example of a transfer device according to the fifth exemplary embodiment has a second-transfer roller T2*b* similar to that in the first exemplary embodiment. Specifically, with regard to the second-transfer roller T2*b* according to the fifth exemplary embodiment, the time constant $\tau s$ in the surface direction and the time constant $\tau v$ in the volume direction are set such that $\tau s<\tau v$. The contact roller T2*c* is connected to a power source E1'. The power source E1' according to the fifth exemplary embodiment applies voltage with a polarity for transferring a visible image on the intermediate transfer belt B onto a recording sheet S. Specifically, the power source E1' according to the fifth exemplary embodiment applies voltage with the same polarity as the charge polarity of toner Tn as an example of a developer to the backup roller T2*a* via the contact roller T2*c*. The shaft 6 of the second-transfer roller T2*b* is electrically connected to ground.

Referring to FIG. 26A, a detach saw 201 as an example of an electricity removal member is disposed to the right of the second-transfer roller T2*b*. Specifically, the detach saw 201 is disposed downstream of the nip region 16 in the transport direction of the recording sheet S. Referring to FIG. 26B, the detach saw 201 according to the fifth exemplary embodiment has a plate-shaped body portion 201*a* extending in the front-rear direction. A serrated sharp portion 201*b* is formed on the body portion 201*a*. The sharp portion 201*b* has tip ends that are tapered toward the nip region 16. The detach saw 201 is composed of an electrically-conductive metallic material. The detach saw 201 according to the fifth exemplary embodiment is connected to a power source E2. The power source E2 applies, to the detach saw 201, voltage with the same polarity as the polarity applied to the backup roller T2*a* by the power source E1'.

Figure 27:
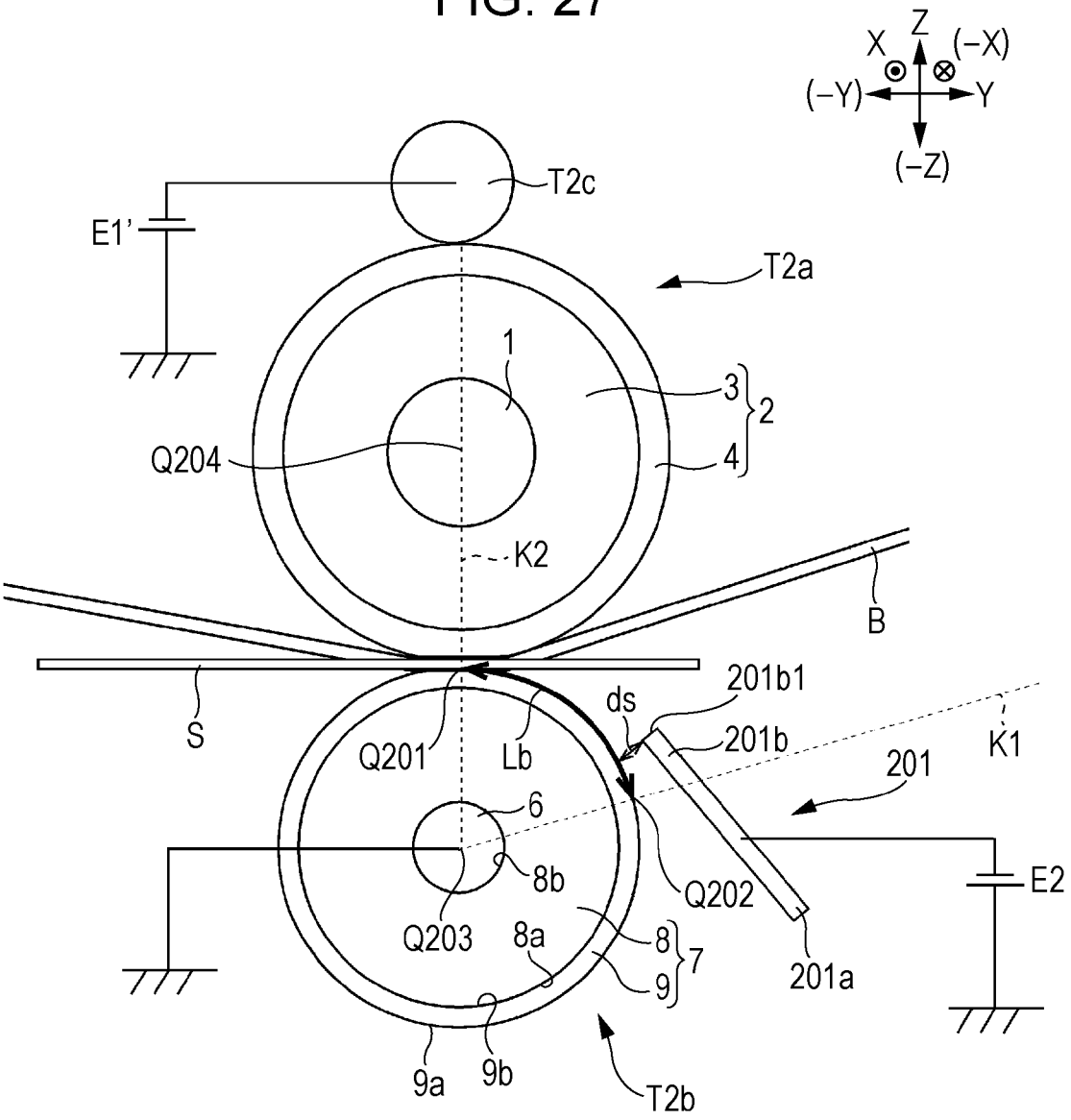
FIG. 27 illustrates an arrangement position of the detach saw according to the fifth exemplary embodiment of the present invention.

FIG. 27 illustrates an arrangement position of the detach saw according to the fifth exemplary embodiment of the present invention.

Referring to FIG. 27, the detach saw 201 according to the fifth exemplary embodiment is disposed based on a downstream position Q202, which is located away from a central position Q201 of the nip region 16 by a predetermined peripheral length Lb in the rotational direction of the second-transfer roller T2*b*. Specifically, a half line K1 is set as an example of an imaginary line extending from a rotation axis Q203 of the second-transfer roller T2*b* and passing through the downstream position Q202. In this case, an end 201*b*1 of the sharp portion 201*b* as an example of an electricity removal portion is disposed upstream of the half line K1 in the rotational direction of the second-transfer roller T2*b*.

The peripheral length Lb is set based on expression (51) shown below:

$$Lb=\{(\tau v/\tau s)/1.94\}\times 6\pi \quad (51)$$

The central position Q201 in the fifth exemplary embodiment is set based on an imaginary line K2 that connects a rotation axis Q204 of the backup roller T2*a*, as an example of an opposing member and a nipping member, and the rotation axis Q203 of the second-transfer roller T2*b*. Specifically, a position where the imaginary line K2 and the nip region 16 intersect is set as the central position Q201 of the nip region 16.

Operation of Fifth Exemplary Embodiment

In the printer U according to the fifth exemplary embodiment having the above-described configuration, when an image is to be recorded onto a recording sheet S, the second-transfer unit T2 receives a second-transfer voltage from the power source E1'. Thus, a transfer electric field in accordance with the second-transfer voltage is generated between the intermediate transfer belt B and the second-transfer roller T2*b*. Therefore, the transfer electric field acts on a visible image on the intermediate transfer belt B so that the visible image becomes transferred from the intermediate transfer belt B to the recording sheet S. In the second-transfer roller T2*b* according to the fifth exemplary embodiment, expression (11) and expression (12) are satisfied. Therefore, the fifth exemplary embodiment is similar to the first exemplary embodiment in that concentration of electric discharge may be alleviated, and transferability onto thick paper may be ensured.

The recording sheet S is electrostatically charged when passing through the second-transfer region Q4. When the recording sheet S is electrostatically charged, the electrostatically-charged recording sheet S receives an electrostatic force. Thus, after the recording sheet S passes through the nip region 16, the recording sheet S may sometimes be bent toward the intermediate transfer belt B. This may cause the recording sheet S to electrostatically attach to the intermediate transfer belt B, resulting in a so-called paper jam. In particular, if the recording sheet S is thin paper, the rigidity, that is, so-called elasticity, of the recording sheet S is weak, thus increasing the possibility of a jam. Thus, a jam tends to occur if the recording sheet S remains in an electrostatically-charged state.

Figure 28A:
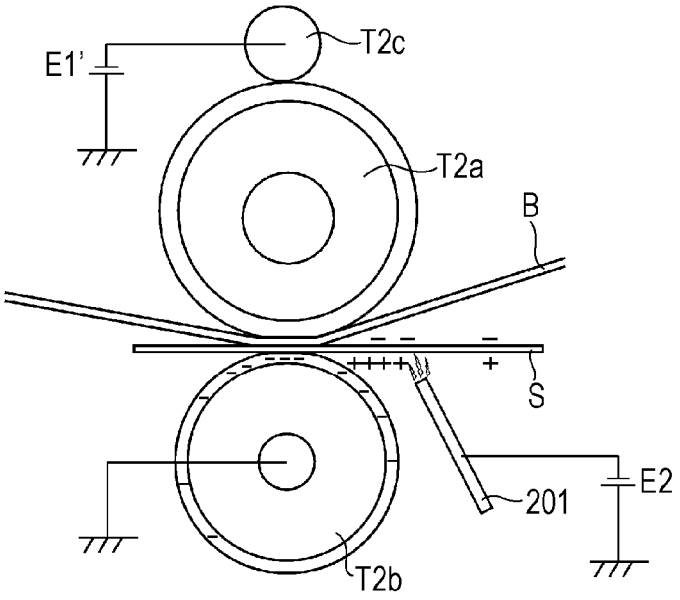
FIGS. 28A to 28C illustrate a comparison between the fifth exemplary embodiment of the present invention and the related art, FIG. 28A illustrating the operation of a second-transfer roller according to the fifth exemplary embodiment, FIG. 28B illustrating a second-transfer roller according to the related art, FIG. 28C illustrating a position where a recording sheet is detached.
Figure 28B:
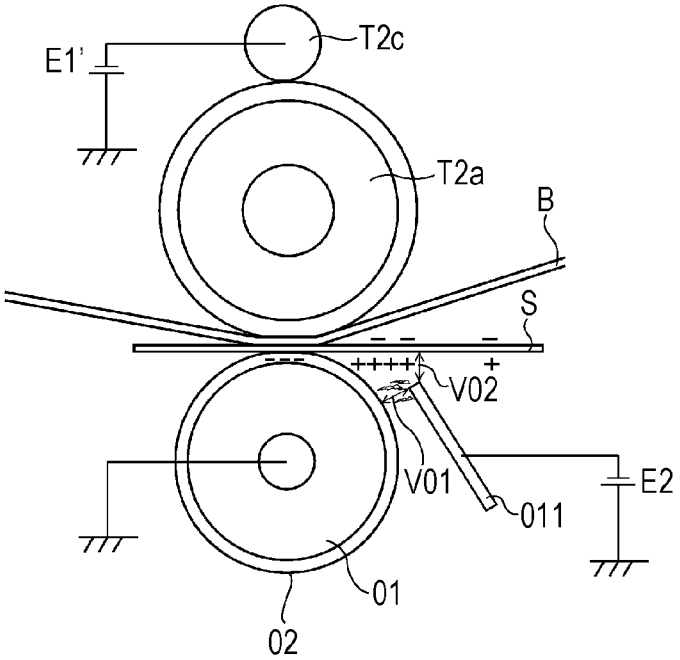
Figure 28C:
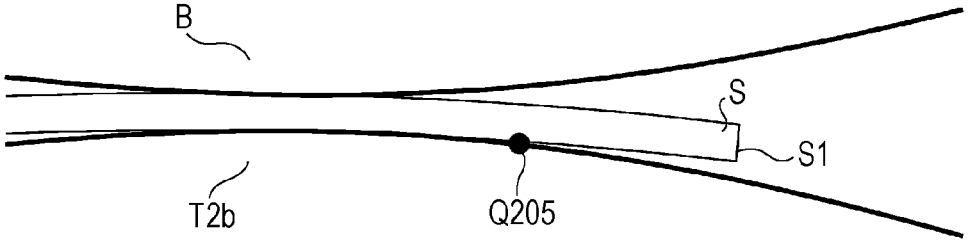

FIGS. 28A to 28C illustrate a comparison between the fifth exemplary embodiment of the present invention and the related art. Specifically, FIG. 28A illustrates the operation of the second-transfer roller T2*b* according to the fifth exemplary embodiment, FIG. 28B illustrates a second-transfer roller according to the related art, and FIG. 28C illustrates a position where the recording sheet is detached.

Referring to FIG. 28A, in the fifth exemplary embodiment, the detach saw 201 is disposed downstream of the second-transfer region Q4 in the sheet transport direction. The detach saw 201 receives voltage from the power source E2. Thus, a large potential difference tends to occur between the electrostatically-charged recording sheet S and the detach saw 201. Therefore, when the electrostatically-charged recording sheet S passes, electric discharge occurs between the detach saw 201 and the reverse face of the recording sheet S, whereby the electric charge is removed from the recording sheet S. In other words, the detach saw 201 removes electricity from the recording sheet S. Therefore, in the fifth exemplary embodiment, an electrostatic force is less likely to occur between the intermediate transfer belt B and the recording sheet S, so that a sheet transport defect, such as a jam, may be reduced.

Referring to FIG. 28B, in the transfer roller 01 in which $\tau s>\tau v$, even when a transfer electric field is effective, an electric potential tends to occur only within the nip region 03. Thus, the electric potential is less likely to change outside the nip region 03. An electricity removal member 011 receives voltage with the same polarity as that of the voltage applied to the backup roller T2*a*. Therefore, when the electricity removal member 011 is disposed relative to the transfer roller 01 according to the related art at a position facing outside the nip region 03, a potential difference V01 between the outer surface of the transfer roller 01 and the electricity removal member 011 tends to increase.

Normally, with regard to an electricity removal member, electricity removability thereof increases with increasing potential difference V02 between the reverse face of the recording sheet S and the electricity removal member. However, when the voltage applied to the electricity removal member is increased, the potential difference V01 between the transfer roller and the electricity removal member also tends to increase. Thus, electric discharge tends to occur between the transfer roller and the electricity removal member. When electric discharge occurs between the transfer roller and the electricity removal member, the charge amount of the electricity removal member decreases, thus making it difficult to remove electricity from the recording sheet S. Moreover, electric discharge occurring between the transfer roller and the electricity removal member may damage the transfer roller, thus reducing the lifespan of the transfer roller.

Therefore, in the related-art configuration in which the potential difference V01 between the outer surface of the transfer roller 01 and the electricity removal member 011 tends to increase, the voltage is increased by increasing the distance between the outer surface of the transfer roller 01 and the electricity removal member 011, or the distance between the reverse face of the recording sheet S and the electricity removal member is reduced by increasing the distance between the outer surface 02 of the transfer roller 01 and the electricity removal member 011. Then, electricity is removed from the recording sheet S. However, it is desirable that the removal of electricity from the recording sheet S start from a position Q205 where a leading edge S1 of the recording sheet S separates from the second-transfer roller T2*b*. In other words, referring to FIG. 28C, it is desirable that the electricity removal member be disposed at a position near the position Q205.

A configuration in which an insulating member is disposed between the electricity removal member and the transfer roller is also conceivable.

In contrast, in the second-transfer roller T2*b* according to the fifth exemplary embodiment, the time constant τs in the surface direction and the time constant τv in the volume direction satisfy the relationship expressed by expression (11). Thus, in the second-transfer roller T2*b* according to the fifth exemplary embodiment, when a transfer electric field is effective, an electric potential tends to also spread outside the nip region 16. The detach saw 201 receives voltage with the same polarity as that of the voltage applied to the backup roller T2*a*. Therefore, the polarity of the electric potential of the detach saw 201 corresponds to the electric potential of the nip region of the second-transfer roller T2*b* and also corresponds to the polarity of the electric potential spreading outside the nip region 16. Consequently, the potential difference between the detach saw 201 and the second-transfer roller T2*b* tends to become small as compared with a case where the electric potential does not spread. In other words, in the fifth exemplary embodiment, electric discharge is less likely to occur. Therefore, in the fifth exemplary embodiment, the voltage to be applied to the detach saw 201 may be readily increased, and the detach saw 201 may be readily disposed close to the position Q205 in the nip region 16.

In particular, in the fifth exemplary embodiment, the end 201*b*1 of the detach saw 201 is disposed upstream, in the rotational direction of the second-transfer roller T2*b*, of the imaginary line K1 extending through the downstream position Q202 of the peripheral length Lb defined by expression (51), as shown in FIG. 27. Expression (51) is an experimentally-determined expression that expresses a condition in which electric discharge is particularly less likely to occur. Therefore, in the fifth exemplary embodiment, electric discharge may be less likely to occur, as compared with a case where expression (51) is not satisfied.

Expression (51) will now be described. When the second-transfer roller T2*b* satisfies expression (11), an electric potential in accordance with the transfer electric field tends to occur also outside the nip region 16 in the second-transfer roller T2*b*. However, when the position on the outer surface of the second-transfer roller T2*b* is different, the electric potential of the surface of the second-transfer roller T2*b* varies. Therefore, there is a possibility that electric discharge may occur readily depending on how the electric potential spreads from the nip region 16. Thus, a particularly desired condition for the position at which the detach saw 201 is disposed is defined.

First, with regard to the electricity removal member and the transfer roller, conditions for electric discharge and potential difference will be discussed. When the electricity removal member and the second-transfer roller T2*b* are positioned the closest to each other, a distance ds therebetween of 0.5 mm may generally be considered as the limit in terms of design. Therefore, the distance ds between the electricity removal member and the transfer roller tends to be larger than 0.5 mm. When the distance ds is equal to 0.5 mm, electric discharge tends to occur most readily. Thus, with a potential difference at which electric discharge is less likely to occur when ds=0.5 mm, electric discharge is less likely to occur at that potential difference even when ds 0.5 mm. It is experimentally confirmed that, when the distance ds is equal to 0.5 mm, electric discharge does not occur so long as the potential difference is lower than or equal to 3 kV. This condition also satisfies Paschen's Law. Therefore, it is conceivable that a desirable condition is a condition in which the electricity removal member is positioned such that the distance ds between the transfer roller and the electricity removal member is equal to 0.5 mm and the potential difference between the transfer roller and the electricity removal member is lower than or equal to 3 kV.

Furthermore, the maximum value of voltage to be applied to the nip region 16 of the second-transfer roller T2*b* is normally 10 kV. When the applied voltage is at maximum, the recording sheet S tends to be electrostatically charged most readily, and the magnitude of voltage to be applied to the electricity removal member is also at maximum. Therefore, it is conceivable that electric discharge tends to occur between the transfer roller and the electricity removal member when the magnitude of voltage to be applied to the nip region 16 is 10 kV.

Assuming that the magnitude of voltage to be applied to the electricity removal member is set to 10 kV based on the configuration of a normal power source, when a voltage of 10 kV is applied to the second-transfer roller T2*b*, the potential difference between the second-transfer roller T2*b* and the electricity removal member becomes 3 kV or smaller in a range from the voltage application position to a position at which the magnitude of the electric potential decreases to 7 kV. Therefore, when a voltage of 10 kV is applied, the peripheral length Lb from the voltage application position to the position at which the magnitude of the electric potential decreases to 7 kV is measured. Then, if the electricity removal member is disposed upstream of the peripheral length Lb in the rotational direction of the second-transfer roller T2*b*, it is conceivable that electric discharge between the electricity removal member 201 and the second-transfer roller T2*b* is suppressed in normal use.

However, the spreading of electric potential varies depending on the time constants τs and τv of the second-transfer roller T2*b*. Therefore, similar to the distance L50 in the fourth exemplary embodiment, it is conceivable that a desired peripheral length Lb changes in accordance with the time-constant ratio τv/τs.

Thus, an experiment for measuring the relationship between the ratio τv/τs and the peripheral length Lb is performed.

Figure 29:
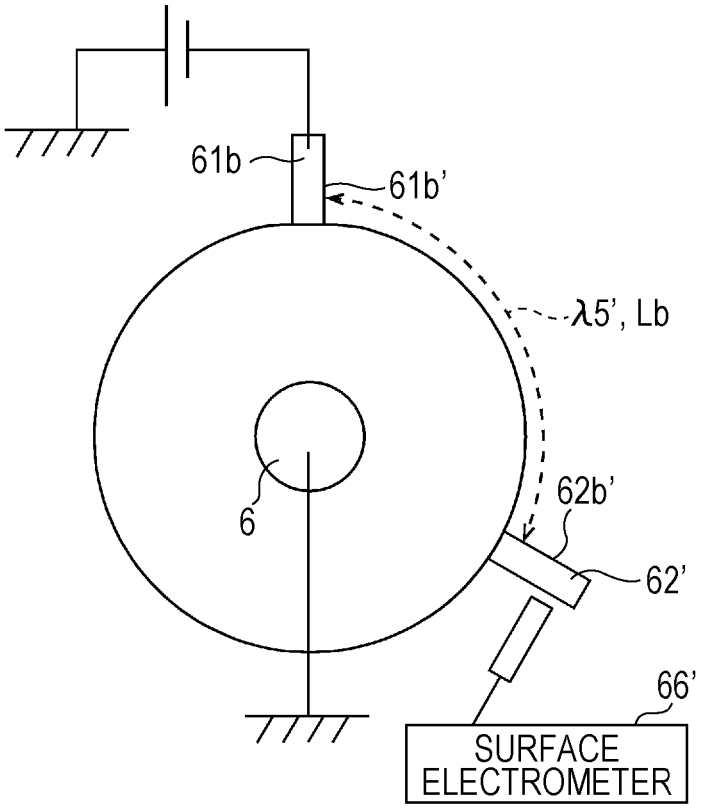
FIG. 29 illustrates a measurement method for measuring a change in electric potential of the transfer roller according to the fifth exemplary embodiment of the present invention.

FIG. 29 illustrates a measurement method for measuring a change in electric potential of the transfer roller according to the fifth exemplary embodiment of the present invention.

Referring to FIG. 29, in the experiment for measuring the relationship between the ratio τv/τs and the peripheral length Lb, a transfer roller in which τs and τv have been adjusted is used. The measurement experiment according to the fifth exemplary embodiment is performed in a manner similar to that in the measurement method for measuring a change in electric potential of the transfer roller according to the fourth exemplary embodiment. However, the measurement experiment according to the fifth exemplary embodiment is performed on five second-transfer rollers T2*b* with time constants (τs [ms], τv [ms]) of (3.6, 7), (61.2, 76.3), (57.6, 80), (49.8, 83.4), and (23.9, 26.7), respectively. The peripheral length λ5' when the surface potential of the second metallic plate 62' becomes −7 kV by applying a voltage of −10 kV to the first metallic plate 61' is measured such that Lb=λ5'. Since other points are the same as those in the measurement according to the fourth exemplary embodiment, a detailed description of the measurement experiment according to the fifth exemplary embodiment will be omitted.

Figures 30A, 30B:
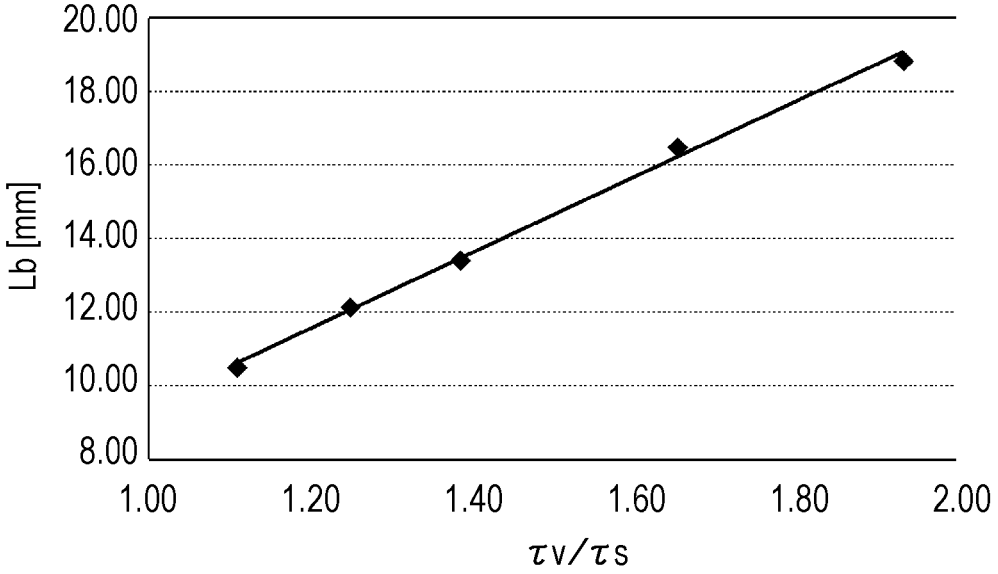
FIGS. 30A and 30B illustrate measurement results obtained in accordance with the fifth exemplary embodiment, FIG. 30A illustrating a time constant in the surface direction and a time constant in the volume direction, FIG. 30B illustrating the relationship between the ratio of the time constants and a peripheral length.

FIGS. 30A and 30B illustrate the measurement results obtained in accordance with the fifth exemplary embodiment. Specifically, FIG. 30A illustrates a time constant in the surface direction and a time constant in the volume direction, and FIG. 30B illustrates the relationship between the ratio of the time constants and the peripheral length.

The measurement results are shown in FIGS. 30A and 30B. Referring to FIG. 30A, when the time constants are (3.6, 7), that is, when τv/τs=1.94, the peripheral length Lb is measured to be 18.85 mm. In this case, the quarter-perimeter of ϕ24 is 24π/4, and 24π/4≈18.85. Thus, the peripheral length Lb is equivalent to the quarter-perimeter of ϕ24. Specifically, it is confirmed that an electric potential of 7 kV or higher occurs in a 90° rotation-angle range of the second-transfer roller T2*b* from the nip region 16. Consequently, when the second-transfer roller T2*b* has ϕ24, if the ratio τv/τs is 1.94 or larger, it is determined that electric discharge between the second-transfer roller T2*b* and the electricity removal member is particularly reduced by disposing the electricity removal member within the 90° rotation-speed range of the second-transfer roller T2*b* from the nip region 16.

Furthermore, referring to FIG. 30B, when the ratio τv/τs becomes smaller than 1.94, it is confirmed that the peripheral length Lb also decreases in accordance with the value of the ratio τv/τs. In this case, it is confirmed that a linear relationship is established between the peripheral length Lb and the time-constant ratio τv/τs. In other words, approximation is possible based on a straight line. Therefore, with regard to the position at which the electricity removal member is disposed, the peripheral length Lb for defining a particularly desired condition is obtained as expression (51) shown below:

$$Lb=\{(\tau v/\tau s)/1.94\}\times 6\pi \quad (51)$$

Thus, in the fifth exemplary embodiment in which the end 201*b*1 of the detach saw 201 is disposed upstream, in the rotational direction of the second-transfer roller T2*b*, of the imaginary line K1 extending through the downstream position Q202 defined by Lb, electric discharge is less likely to occur, as compared with a case where the end 201*b*1 is disposed downstream of the imaginary line K1. Therefore, the voltage of the detach saw 201 may be readily increased, and the detach saw 201 may be readily brought closer to the position Q205 by being disposed closer toward the nip region 16. Consequently, in the fifth exemplary embodiment, electricity removability may be readily improved.

In the related art, there is a configuration that performs transferring onto a recording sheet S by attaching the recording sheet S to an endless belt member, that is, a so-called transport belt, in the second-transfer region Q4, and transporting the recording sheet S thereon. In such a configuration that uses the transport belt, a jam caused by the sheet S attaching to the intermediate transfer belt B is less likely to occur. However, this configuration that uses the transport belt has a larger number of components than the configuration that uses the transfer roller.

In contrast, in the fifth exemplary embodiment, the second-transfer roller T2*b* is used in the second-transfer region Q4. Moreover, the detach saw 201 removes electricity from the recording sheet S passing through the second-transfer region Q4.

Experimental Example 4-1

Next, experiments for checking the effects of the fifth exemplary embodiment are performed.

In the following description, descriptions regarding configurations similar to those in the experiments for checking the effects of the first to third exemplary embodiments will be omitted.

In an experimental example 4-1, an experiment for checking the effects of the fifth exemplary embodiment is performed by using the printer U.

With regard to the backup roller T2*a*, the shaft 1 has a diameter of 14 mm, the roller layer 2 has a thickness of 5 mm, and the volume resistance value is 8.0 log Ω at an applied voltage of 1 kV.

With regard to the second-transfer roller T2*b*, the shaft 6 has a diameter of 14 mm, and the roller layer 7 has a double-layer configuration in which the base layer 8 has a thickness of 5 mm and the surface layer 9 has a thickness of 20 μm. Furthermore, in the experimental example 4-1, the volume resistance value Rv of the second-transfer roller T2*b* is set to 7.5 log Ω at an applied voltage of 1 kV. The time constant τs in the surface direction of the second-transfer roller T2*b* according to the experimental example 4-1 is set to 3.6 ms. The time constant τv in the volume direction is set to 7 ms. The time constants τs and τv are adjusted by independently controlling the blending of electrical-conductivity additives in the base layer 8 and the surface layer 9.

The detach saw 201 is disposed such that the end 201*b*1 is positioned on an imaginary line K1' extending through the position at which the peripheral length from the central position Q201 is 16.9 mm and also through the rotation axis Q203. The distance ds between the second-transfer roller T2*b* and the detach saw 201 is set to 0.5 mm. According to expression (51), in the second-transfer roller T2*b* according to the experimental example 4-1, Lb={(7/3.6)/1.94}×6π=18.89. Thus, Lb=18.89>16.9. In the experimental example 4-1, the detach saw 201 is positioned upstream of the imaginary line K1 of the second-transfer roller T2*b* in the rotational direction of the second-transfer roller T2*b*.

The second-transfer load is set to 6.4 kgf.

The evaluation experiment is performed at an ambient temperature of 10° C. and a relative humidity of 15%.

In the evaluation method according to the experimental example 4-1, it is checked whether or not a paper jam and electric discharge have occurred. In detail, an image forming process is performed with the second-transfer roller T2*b* rotating at a rotation speed of 528 mm/s. Specifically, while changing the condition of a voltage Vd applied to the detach saw 201, duplex printing is performed on evaluation paper under each condition of the voltage Vd. Duplex printing is performed on 50 sheets of 52-gsm plain paper and 50 sheets of 64-gsm coated paper as the evaluation paper. Then, it is checked whether or not a sheet transport defect, that is, a jam, has occurred in the second-transfer region Q4. Moreover, it is checked whether or not electric discharge has occurred from the detach saw 201 to the second-transfer roller T2*b*. The occurrence of electric discharge is checked based on whether or not a drastic change in electric current has occurred by installing an ammeter between the detach saw 201 and the power source. In addition, the occurrence of spark discharge is also checked by using a high-sensitivity camera as an example of an observation device. The voltage Vd is changed in units of 1 kV between −3 kV and −10 kV.

Experimental Example 4-2

In an experimental example 4-2, the time constant τs in the surface direction of the second-transfer roller T2*b* is set to 57.6 ms. The time constant τv in the volume direction is set to 80 ms. According to expression (51), in the second-transfer roller T2*b* according to the experimental example 4-2, $Lb=\{(80/57.6)/1.94\}\times 6\pi=13.49$. Thus, $Lb=13.49<16.9$. In the experimental example 4-2, the detach saw 201 is disposed downstream of the imaginary line K1 of the second-transfer roller T2*b* in the rotational direction of the second-transfer roller T2*b*. The voltage Vd is changed in units of 1 kV between −3 kV and −7 kV. Other conditions and the evaluation method are the same as those in the experimental example 4-1.

Experimental Example 4-3

In an experimental example 4-3, the time constant τs in the surface direction of the second-transfer roller T2*b* is set to 23.9 ms. The time constant τv in the volume direction is set to 26.7 ms. According to expression (51), in the second-transfer roller T2*b* according to the experimental example 4-3, $Lb=\{(26.7/23.9)/1.94\}\times 6\pi=10.85$. Thus, $Lb=10.85<16.9$. In the experimental example 4-3, the detach saw 201 is disposed downstream of the imaginary line K1 of the second-transfer roller T2*b* in the rotational direction of the second-transfer roller T2*b*. The voltage Vd is changed in units of 1 kV between −3 kV and −6 kV. Other conditions and the evaluation method are the same as those in the experimental example 4-1.

Comparative Example 4-1

In a comparative example 4-1, the time constant τs in the surface direction of the second-transfer roller T2*b* is set to 67.6 ms. The time constant τv in the volume direction is set to 62 ms. Therefore, the second-transfer roller according to the comparative example 4-1 does not satisfy expression (11). A value corresponding to Lb is calculated using expression (51) as follows: $Lb=\{(62/67.6)/1.94\}\times 6\pi=8.91$. Voltages of −3 kV and −4 kV are used as the voltage Vd. Other conditions and the evaluation method are the same as those in the experimental example 4-1.

Comparative Example 4-2

In a comparative example 4-2, the time constant τs in the surface direction of the second-transfer roller T2*b* is set to 67.6 ms. The time constant τv in the volume direction is set to 26.7 ms. A value corresponding to Lb is calculated using expression (51) as follows: $Lb=\{(26.7/67.6)/1.94\}\times 6\pi=3.84$. Voltages of −3 kV, −4 kV, and −5 kV are used as the voltage Vd. Other conditions and the evaluation method are the same as those in the experimental example 4-1.

Experimental Results of Experimental Examples 4-1 to 4-3 and Comparative Examples 4-1 and 4-2

Figures 31A, 31B:
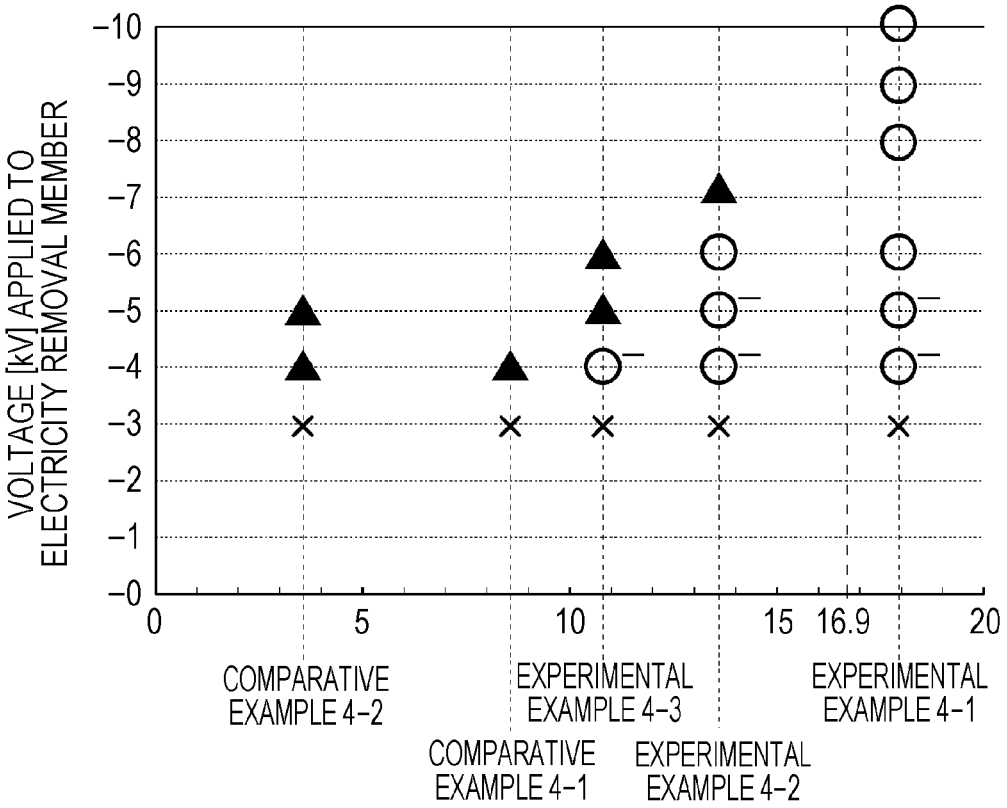
FIGS. 31A and 31B illustrate conditions and experimental results of an experimental example 4-1, an experimental example 4-2, an experimental example 4-3, a Comparative Example 4-1, and a comparative example 4-2, FIG. 31A illustrating the conditions, FIG. 31B illustrating the experimental results.

FIGS. 31A and 31B illustrate conditions and experimental results of the experimental example 4-1, the experimental example 4-2, the experimental example 4-3, the Comparative Example 4-1, and the comparative example 4-2. Specifically, FIG. 31A illustrates the conditions, and FIG. 31B illustrates the experimental results.

Referring to FIGS. 31A and 31B, a circle is given when passing of both plain paper and coated paper is confirmed and electric discharge has not occurred. A circle with a minus symbol is given when passing of one of plain paper and coated paper is confirmed and electric discharge has not occurred, while non-passing of the other one of plain paper and coated paper, that is, a jam, is confirmed. An "x" is given when it is confirmed that both plain paper and coated paper are jammed. A triangle is given when it is confirmed that electric discharge has occurred between the detach saw 201 and the second-transfer roller T2*b*.

Referring to FIG. 31B, in each of the experimental examples 4-1 to 4-3 in which the second-transfer roller T2*b* satisfying τs<τv is used, an evaluation result indicating a circle with a minus symbol or a circle is obtained. Thus, it is confirmed that there is a case where the detach saw 201 may remove electricity from the evaluation paper. It is also confirmed that there is a case where electric discharge does not occur. On the other hand, in each of the comparative examples 4-1 and 4-2 in which the transfer roller with τs>τv is used, only an evaluation result indicating an "x" or a triangle is obtained. In other words, it is confirmed that there is a possibility that the second-transfer roller T2*b* may be damaged due to the occurrence of a jam or electric discharge. Therefore, it is confirmed that, when the second-transfer roller T2*b* satisfies expression (11), electric discharge is less likely to occur between the second-transfer roller T2*b* and the detach saw 201. In other words, it is confirmed that the detach saw 201 may be more readily disposed closer to the nip region 16 and the electricity removability may be more readily improved by using the second-transfer roller T2*b* satisfying τs<τv.

With further reference to the experimental results, a jam has occurred on evaluation paper at −3 kV in all of the experimental examples 4-1 to 4-3 and the comparative examples 4-1 and 4-2. This is conceivably due to the fact that the voltage of −3 kV is too low, making it difficult to remove electricity from the evaluation paper.

Furthermore, in each of the comparative examples 4-1 and 4-2 in which the transfer roller with τs>τv is used, electric discharge occurs between the electricity removal member and the transfer roller before reaching a potential difference at which electricity is removed from coated paper.

In the experimental example 4-3 in which the transfer roller satisfying τs<τv is used, a sheet transport defect occurs on coated paper when the voltage applied to the detach saw 201 is low. However, sheet transportability is ensured for plain paper by increasing the applied voltage. If the applied voltage is further increased, electric discharge is confirmed.

In the experimental example 4-2, a sheet transport defect occurs when the applied voltage is low. However, sheet transportability is ensured as the voltage Vd is increased. When the voltage Vd is −6 kV, satisfactory sheet transportability is ensured for both plain paper and coated paper. However, when the applied voltage is further increased, electric discharge is confirmed.

In contrast, in the experimental example 4-1 in which the detach saw 201 is positioned upstream of the imaginary line K1 based on expression (51) in the rotational direction, neither a jam nor electric discharge is confirmed even when the applied voltage is increased. Therefore, in the experimental example 4-1, the voltage may be readily increased without causing electric discharge to occur, and the voltage range in which sheet transportability of thin paper may be readily ensured is wide. Moreover, in the experimental example 4-1, it is confirmed that the possibility of damaging the transfer roller is also reduced.

There is a case where alternating-current voltage is applied to the electricity removal member or alternating-current voltage is superimposed on direct-current voltage for the purpose of, for example, suppressing scattering of the developer. This exemplary embodiment of the present invention is effective for such a case. Even when alternative current is applied (or alternating current is superimposed), an average voltage value (direct-current component) thereof causes electric discharge.

Modifications

Although the exemplary embodiments of the present invention have been described in detail above, the present invention is not to be limited to the above exemplary embodiments and permits various modifications within the technical scope of the invention defined in the claims. Modifications H01 to H09 will be described below.

In a first modification H01, the image forming apparatus according to each of the above exemplary embodiments is not limited to the printer U, but may be, for example, a copying apparatus, a facsimile apparatus, or a multifunction apparatus having multiple functions of such apparatuses. Furthermore, each of the above exemplary embodiments is not limited to an image forming apparatus of a multicolor developing type and may alternatively be applied to a so-called monochrome image forming apparatus.

The second exemplary embodiment relates to an example in which the surface layer 9' is formed by generating an electric field such that the electrical-conductivity additive 14 is distributed lopsidedly toward the outer surface 9*a*. Alternatively, for example, in a second modification H02, the electrical-conductivity additive 14 may be distributed lopsidedly toward the outer surface 9*a* by utilizing the difference in specific gravity between the resin 13 and the electrical-conductivity additive 14. Furthermore, for example, in a case where the electrical-conductivity additive 14 is magnetic, the electrical-conductivity additive 14 may be distributed lopsidedly toward the outer surface 9*a* by drawing the electrical-conductivity additive 14 toward the outer surface 9*a* by utilizing magnetic force.

In each of the above exemplary embodiments, the roller layer 7 of the second-transfer roller T2*b* has a double-layer structure constituted of the base layer 8 and the surface layer 9 as an example. Alternatively, for example, in a third modification H03, a multilayer structure having three or more layers, such as the base layer 8, the surface layer 9, and a third layer interposed therebetween, is also permissible. In this case, it is desirable that the blending quantities of electrical-conductivity additives 12 and 14 are larger for outer layers.

In each of the above exemplary embodiments, the roller layer 7 of the second-transfer roller T2*b* has a double-layer structure constituted of the base layer 8 and the surface layer 9 as an example. Alternatively, for example, in a fourth modification H04, a single-layer structure is also permissible. In this case, the electrical-conductivity additive 14 may be distributed lopsidedly toward the outer surface of the single layer such that $\tau s<\tau v$ is achieved.

In the fourth exemplary embodiment, the second-transfer roller T2*b* is desirably supplied with the lubricant 104. Alternatively, in a fifth modification H05, the configuration for supplying the lubricant 104 may be omitted.

In the fourth exemplary embodiment, the lubricant 104 is desirably supplied to the second-transfer roller T2*b* via the electrostatic brush 103. Alternatively, in a sixth modification H06, a supplying member that applies the lubricant to the second-transfer roller T2*b* may be provided in addition to the electrostatic brush 103 such that the lubricant is supplied from the supplying member.

In the fifth exemplary embodiment, the detach saw 201 is provided as an example of the electricity removal member. Alternatively, for example, in a seventh modification H07, an electricity removal member that uses a wire, that is, a so-called corotron, may be used.

In the fifth exemplary embodiment, the detach saw 201 is configured to receive direct-current voltage as an example. Alternatively, for example, in an eighth modification H08, the detach saw 201 may receive alternating-current voltage alone or direct-current voltage with alternating-current voltage superimposed thereon.

As a ninth modification H09 of the fourth and fifth exemplary embodiments, the electrostatic brush 103 and the detach saw 201 may both be disposed relative to the second-transfer roller T2*b*.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer member comprising:

a shaft; and a body that is supported by the shaft, wherein when a measurement member extending in an axial direction of the shaft is brought into contact with an outer surface of the body and voltage applied to the measurement member is changed by electrically connecting the shaft to ground, a time constant measured based on a change in electric potential occurring on a surface of the measurement member is defined as a first time constant $\tau v$ [s], wherein when a first measurement member extending in the axial direction is brought into contact with the outer surface of the body, a second measurement member extending in the axial direction is brought into contact with the outer surface of the body while being spaced apart from the first measurement member by a predetermined distance in a circumferential direction of the outer surface of the body, and voltage applied to the first measurement member is changed by electrically connecting the shaft to ground, a time constant measured based on a change in electric potential occurring on a surface of the second measurement member is defined as a second time constant $\tau s$ [s], and wherein the first time constant $\tau v$ [s] is larger than the second time constant $\tau s$ [s].

2. The transfer member according to claim 1, wherein when an Asker C hardness of the outer surface of the body is defined as H, the Asker C hardness H, the first time constant $\tau v$ [s], and the second time constant $\tau s$ [s] are set in the body such that $(1/H)\times 0.5<\tau s<\tau v$ is satisfied.

3. The transfer member according to claim 1, wherein the body has an electrical-conductivity additive blended therein, and wherein the electrical-conductivity additive is distributed more densely toward the outer surface of the body from the shaft.

4. The transfer member according to claim 1, wherein the body has an electrical-conductivity additive blended therein, and wherein the electrical-conductivity additive is uniformly distributed in the circumferential direction of the outer surface of the body.

5. The transfer member according to claim 1, wherein the body has an electrical-conductivity additive blended therein, and wherein the electrical-conductivity additive is distributed in the body such that a distance between portions of the electrical-conductivity additive in the circumferential direction of the outer surface of the body is shorter than a distance between portions of the electrical-conductivity additive in a direction extending from the shaft toward the outer surface of the body.

6. An image forming apparatus comprising:

an endless-belt-shaped image bearing member;

the transfer member according to claim 1 that transfers a visible image on a surface of the image bearing member onto a medium; and a fixing device that fixes the visible image transferred on the medium.

7. The image forming apparatus according to claim 6, further comprising:

an electrically-conductive cleaning member that is disposed downstream, in a rotational direction of the transfer member, of a facing region in which the transfer member faces the image bearing member and that cleans the transfer member, the cleaning member being electrically connected to ground.

8. The image forming apparatus according to claim 7, wherein when a distance from a downstream end of the facing region in the rotational direction of the transfer member to a position where the cleaning member comes into contact with the transfer member is defined as La [mm], the cleaning member is disposed at a position that satisfies:

$$La \leq \{(\tau v/\tau s)/1.25\} \times 12\pi.$$

9. The image forming apparatus according to claim 7, wherein the cleaning member includes a first cleaning member that has a brush portion having a plurality of bristles, and a second plate-shaped cleaning member that is disposed downstream of the first cleaning member in the rotational direction of the transfer member and that cleans the transfer member.

10. The image forming apparatus according to claim 9, wherein the transfer member has a surface whose ten-point medium height is set to 2.0 μm or smaller.

11. The image forming apparatus according to claim 9, wherein the first cleaning member has a rotation shaft and the brush portion having the bristles extending radially around the rotation shaft, and wherein the image forming apparatus further comprises:

a supplying section that supplies a lubricant, which lubricates the transfer member and the second cleaning member, by coming into contact with the brush portion at an upstream side, in a rotational direction of the first cleaning member, of a position where the first cleaning member comes into contact with the transfer member.

12. The image forming apparatus according to claim 7, further comprising:

a power source that applies voltage between the image bearing member and the transfer member, the power source being capable of only applying voltage with a polarity for transferring the visible image on the surface of the image bearing member onto the medium.

13. The image forming apparatus according to claim 6, further comprising:

an electricity removal member that removes electricity from the medium at a downstream side, in a transport direction of the medium, of a facing region in which the transfer member faces the image bearing member.

14. The image forming apparatus according to claim 13, wherein the electricity removal member has an electricity removal section that removes electricity from the medium, the electricity removal section being disposed upstream, in a rotational direction of the transfer member, of an imaginary line that connects a position on the transfer member, at which a distance Lb [mm] from a central position of the facing region of the transfer member in the rotational direction of the transfer member satisfies $Lb=\{(\tau v/\tau s)/1.94\}\times 6\pi$, and a rotation axis of the transfer member.

15. An image forming apparatus comprising:

an image bearing member;

a latent-image forming device that forms a latent image onto a surface of the image bearing member;

a developing device that develops the latent image on the surface of the image bearing member into a visible image;

an endless-belt-shaped intermediate transfer body that is disposed facing the image bearing member;

a first-transfer unit that transfers the visible image on the surface of the image bearing member onto a surface of the intermediate transfer body;

a support member that supports the intermediate transfer body in a movable manner;

a transfer member that is disposed facing the intermediate transfer body and that transfers the visible image on the surface of the intermediate transfer body onto a medium passing through a facing region in which the transfer member faces the intermediate transfer body, the transfer member having a shaft and a body supported by the shaft, wherein when a measurement member extending in an axial direction of the shaft is brought into contact with an outer surface of the body and voltage applied to the measurement member is changed by electrically connecting the shaft to ground, a time constant measured based on a change in electric potential occurring on a surface of the measurement member is defined as a first time constant τv [s], wherein when a first measurement member extending in the axial direction is brought into contact with the outer surface of the body, a second measurement member extending in the axial direction is brought into contact with the outer surface of the body while being spaced apart from the first measurement member by a predetermined distance in a circumferential direction of the outer surface of the body, and voltage applied to the first measurement member is changed by electrically connecting the shaft to ground, a time constant measured based on a change in electric potential occurring on a surface of the second measurement member is defined as a second time constant τs [s], wherein a volume resistance value of the body is defined as Rv [Ω], wherein a surface resistance value of the body is defined as Rs [Ω], wherein a peripheral speed of the outer surface of the body is defined as v [mm/s], wherein a length of the facing region in a transport direction of the medium is defined as L [mm], and wherein the first time constant τv [s], the second time constant τs [s], the volume resistance value Rv [Ω] of the body, the surface resistance value Rs [Ω] of the body, the peripheral speed v [mm/s] of the outer surface of the body, and the length L [mm] of the facing region in the transport direction of the medium are set such that $(L/v)\times(Rv/Rs)<\tau s<\tau v$ is satisfied; and a fixing device that fixes the visible image transferred on the medium.

* * * * *